US005273866A

United States Patent [19]

Fujita et al.

[11] Patent Number: 5,273,866

[45] Date of Patent: Dec. 28, 1993

[54] SILVER HALIDE COLOR PHOTOGRAPHIC MATERIAL

[75] Inventors: Munehisa Fujita; Katsuro Nagaoka; Shinsuke Bando, all of Kanagawa, Japan

[73] Assignee: Fuji Photo Film Co., Ltd., Kanagawa, Japan

[21] Appl. No.: 860,207

[22] Filed: Mar. 27, 1992

Related U.S. Application Data

[63] Continuation of Ser. No. 598,474, Oct. 16, 1990, abandoned.

[30] Foreign Application Priority Data

Oct. 16, 1989 [JP] Japan ..... 1-268579
Oct. 17, 1989 [JP] Japan ..... 1-269558
Oct. 17, 1989 [JP] Japan ..... 1-269559

[51] Int. Cl.[5] ..... G03C 1/46

[52] U.S. Cl. ..... 430/503; 430/507; 430/512; 430/559; 430/570

[58] Field of Search ..... 430/503, 504, 506, 507, 430/512, 542, 556, 559, 560, 570, 600, 603, 607, 611, 613, 931

[56] References Cited

U.S. PATENT DOCUMENTS 3,764,331 10/1976 Ohyama et al. ..... 430/503
4,803,149 2/1989 Takahashi et al. ..... 430/512
4,828,972 5/1989 Ihama et al. ..... 430/570
4,925,782 5/1990 Okada et al. ..... 430/512
4,946,767 8/1990 Yamagami ..... 430/503
4,948,717 8/1990 Diehl et al. ..... 430/512
4,954,429 9/1990 Urata ..... 430/570
4,956,269 9/1990 Ikeda et al. ..... 430/507
4,965,170 10/1990 Ukai et al. ..... 430/507

FOREIGN PATENT DOCUMENTS 0209118 1/1987 European Pat. Off. .
0278510 8/1988 European Pat. Off. .
0299435 1/1989 European Pat. Off. .
63-89843 4/1988 Japan .
WO8804794 6/1988 PCT Int'l Appl. .

*Primary Examiner*—Hoa Van Le
*Attorney, Agent, or Firm*—Sughrue, Mion, Zinn, Macpeak & Seas

[57] ABSTRACT

A silver halide color photographic material comprising: a support; at least a blue-sensitive emulsion layer, a green-sensitive emulsion layer, and a red-sensitive emulsion layer on the support, and one or more hydrophilic colloidal layers thereon containing a dispersion of microcrystals of at least one compound represented by general formulae (I), (II), (III), (IV), (V), and (VI); and at least one light-sensitive silver halide emulsion layer having a silver density (d) of 0.4 g/cm$^3$ or more, wherein d is N/V; where N represents the total number of grams of silver in said one or more light-sensitive silver halide emulsion layers and V represents the cm$^3$ of said light-sensitive silver halide emulsion layer.

11 Claims, No Drawings

SILVER HALIDE COLOR PHOTOGRAPHIC MATERIAL

This is a continuation of application Ser. No. 07/598,474 filed Oct. 16, 1990, now abandoned.

FIELD OF THE INVENTION

The present invention relates to a silver halide color photographic material which exhibits improved sharpness and preservability.

BACKGROUND OF THE INVENTION

In the field of silver halide photographic materials, particularly for photography, high sensitive silver halide photographic materials having excellent picture quality have always been desired.

Various approaches for improving sharpness, which is the most important picture quality, have been known. One approach is to inhibit light scattering. Another is to improve the edge effect.

It is known that silver halide photographic materials having a dye in their constituent layers absorb light of a specified wavelength and inhibit light scattering. Because of this, it has been a conventional practice to color a hydrophilic colloidal layer with a dye.

More specifically, colloidal silver has been previously used to absorb yellow light and inhibit halation. However, colloidal silver does not provide a maximum increase in sharpness because incorporating it causes an increase in fogging of a light-sensitive silver halide emulsion layer adjacent to the colloidal silver layer.

In an approach described in International Patent WO 88/04794, a dye dispersion is used as a substitute for colloidal silver. Although this enables a reduction in the rise of fogging of the adjacent layers, it also causes a drop in the light-sensitive silver halide emulsion layer activity of solution physical development, which results in a drop in the edge effect, thus making it impossible to thoroughly improve sharpness.

It is known that sharpness can be improved by using silver halide emulsion grains having a diameter large enough for light scattering. However, grains with such a large diameter cause a deterioration in visual graininess.

Another known approach is to drastically reduce the coated amount of silver. However, in drastically reducing the coated amount of silver, the number of active points is reduced which causes a deterioration in graininess.

Other approaches similar to reducing the coated silver involve reducing the content of gelatin, couplers, or coupler solvents or the like in the coating solution. However, these approaches generally cause a deterioration in coating properties or color density.

Examples of approaches for improving the edge effect include the use of an unsharp mask and the use of DIR couplers for color negative films. The use of an unsharp mask is limited in its practicality because it is a complicated process. DIR couplers are known in many ways.

Examples of useful DIR couplers include the compounds described in JP-B-55-34933 (the term "JP-B" as used herein refers to an "examined Japanese patent publication"), JP-A-57-93344 (the term "JP-A" as used herein refers to a "published unexamined Japanese patent application"), and U.S. Pat. Nos. 3,227,554, 3,615,506, 3,617,291 and 3,701,793. However, if a DIR coupler is used to intensify the edge effect, Modulation Transfer Function (MTF) can be improved in a low frequency range, but MTF cannot be improved at the higher frequency ranges required for high power magnification. Furthermore, DIR couplers cause an undesirable side effect such as a sensitivity or density drop.

If a DIR coupler capable of attaining its effects at a remote distance, such as a diffusive DIR, is used, this drop of sensitivity or density can be reduced. However, this approach only causes a further shift in the MTF improvement range to the low frequency side. Thus, high power magnification cannot be expected.

As a result of extensive studies, the inventors found that the edge effect can be dramatically enhanced by increasing the silver density of the light-sensitive silver halide emulsion layer. However, this increases fogging as well as causes a deterioration in the preservability of the light-sensitive material.

In the present invention, the silver density of the light-sensitive silver halide emulsion layer is predetermined to a high range not only to enhance the activity of solution physical development which results in an increase in the edge effect and also to reduce the film thickness per unit of silver, providing an unexpected increase in sharpness. That is, sharpness is increased beyond the expected increase attained using each of the above approaches. The present process does not suffer from any deterioration in preservability, which has been heretofore unavoidable when the silver density is raised.

SUMMARY OF THE INVENTION

An object of the present invention is to provide a silver halide color photographic material which exhibits excellent sharpness and color reproducibility and has improved preservability and desilverability.

The object of the present invention is satisfied by a silver halide color photographic material comprising a support; at a blue-sensitive emulsion layer, a green-sensitive emulsion layer and a read-sensitive emulsion layer on said support, and comprising one or more hydrophilic colloidal layers containing a dispersion of microcrystals of at least one compound represented by general formulae (I), (II), (III), (IV), (V) and (VI):

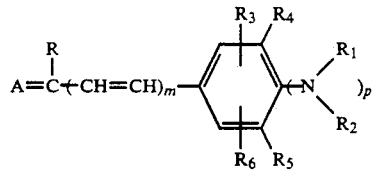

(I)

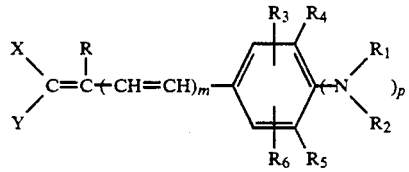

(II)

$$A{=}L_1{-}(L_2{=}L_3)_n{-}A' \quad \text{(III)}$$

$$A{=}(L_1{-}L_2)_{2-q}{=}B \quad \text{(IV)}$$

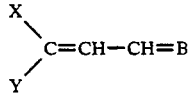

(V)

-continued

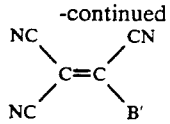

(VI)

wherein A and A′ may be the same or different and each represents an acidic nucleus; B represents a basic nucleus; X and Y may be the same or different and each represents an electrophilic group; R represents a hydrogen atom or an alkyl group; $R_1$ and $R_2$ each represents an alkyl group, an aryl group, an acyl group or a sulfonyl group and may be connected to each other to form a 5- or 6-membered ring; $R_3$ and $R_6$ each represents a hydrogen atom, a hydroxyl group, a carboxyl group, an alkoxy group or a halogen atom; $R_4$ and $R_5$ each represents a hydrogen atom or a nonmetallic atom group required to connect $R_1$ and $R_4$ or $R_2$ and $R_5$ to each other to form a 5- or 6-membered ring; $L_1$, $L_2$ and $L_3$ each represents a methine group; m represents an integer 0 or 1; n and q each represents an integer 0, 1 or 2; p represents an integer 0 or 1; and B′ represents a carboxyl group, a sulfamoyl group or a heterocyclic group containing a sulfonamide group, with the proviso that when p is 0, $R_3$ is a hydroxyl group or a carboxyl group and $R_4$ and $R_5$ each represents a hydrogen atom and that the compound represented by general formula (I), (II), (III), (IV), (V) or (VI) contains per molecule at least one dissociative group having a pKa value of 4 to 11 in a 1/1 mixture by volume of water and ethanol; and at least one light-sensitive silver halide emulsion layer having a silver density (d) of 0.4 g/cm$^3$ or more, wherein d is N/V; where N represents the total number of grains of silver in said one or more light-sensitive silver halide emulsion layers and V represents the volume in cm$^3$ of said light-sensitive silver halide emulsion layer.

The object of the present invention is also satisfied by a silver halide color photographic material containing at least one compound represented by general formulae (I), (II), (III), (IV), (V), and (VI), as described above, wherein said at least one light-sensitive silver halide emulsion layer is spectrally sensitized by the addition of a photographic sensitizing dye at a temperature of 50° C. or higher.

The object of the present invention is further satisfied by a silver halide color photographic material containing at least one compound represented by general formulae (I), (II), (III), (IV), (V), and (VI), as described above that further comprises wherein said at least one light-sensitive silver halide emulsion layer is spectrally sensitized by the addition of a photographic sensitizing dye at a temperature of 50° C. or higher, as described above, wherein said photographic sensitizing dye is added to said at least one light-sensitive silver halide emulsion layer before the completion of the formation of grains or between the completion of the formation of grains and the completion of chemical sensitization.

The object of the present invention is still further satisfied by a silver halide color photographic material containing at least one compound represented by general formula (I), (II), (III), (IV), (V), and (VI), as described above, wherein said at least one light-sensitive silver halide emulsion layer contains silver halide grains containing silver iodide wherein the average silver iodide content in said at least one light-sensitive silver halide emulsion layer is about 8 mol % or less.

In addition, the object of the present invention is also satisfied by a silver halide color photographic material containing at least one compound represented by general formulae (I), (II), (III), (IV), (V), and (VI), as described above, that further comprises an emulsion layer containing at least one compound represented by general formula (VII):

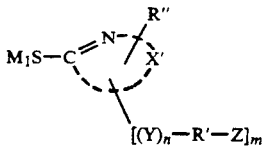

(VII)

wherein $M_1$ represents a hydrogen atom, a cation, or a protective group for a mercapto group which undergoes cleavage by an alkali; X′ represents an atomic group required for the formation of a 5- or 6-membered heterocyclic group containing sulfur, selenium, nitrogen, or oxygen as hetero atoms and which may be substituted or part of a condensed ring; R′ represents a straight or branched chain alkylene group, a straight or branched chain alkenylene group, a straight or branched chain aralkylene group, or an arylene group; R″ represents a hydrogen atom or a group which can substitute for the hydrogen atom; Z represents a polar substituent; Y represents

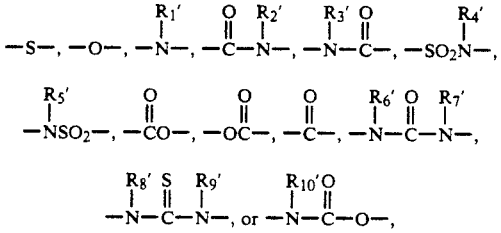

in which $R'_1$, $R'_2$, $R'_3$, $R'_4$, $R'_5$, $R'_6$, $R'_7$, $R'_8$, $R'_9$, and $R'_{10}$ each represents a hydrogen atom, a substituted or unsubstituted alkyl group, an aryl group, an alkenyl group, or an aralkyl group; n represents 0 or 1; and m represents 0, 1, or 2.

DETAILED DESCRIPTION OF THE INVENTION

The compounds represented by general formulae (I), (II), (III), (IV), (V), and (VI) are described in detail below.

The acidic nucleus represented by A or A′ preferably represents 2-pyrazoline-5-one, rhodanine, hydantoin, thiohydantoin, 2,4-oxazolidinedione, isooxazolidinone, barbituric acid, thiobarbituric acid, indandione, pyrazolopyridine, or hydroxypyridone.

The basic nucleus represented by B preferably represents pyridine, quinoline, indolenine, oxazole, benzoxazole, naphthoxazole, or pyrrole.

Examples of the heterocyclic group represented by B′ include a pyrrole group, an indole group, a thiophene group, a furan group, an imidazole group, a pyrazole group, an indolizine group, a quinoline group, a carbazole group, a phenothiazine group, a phenoxazine group, an indoline group, a thiazole group, a pyridine group, a pyridazine group, a thiadiazine group, a pyran group, a thiopyran group, an oxadiazole group, a benzoquinolizine group, a thiadiazole group, a pyrrolothiazole group, a pyrrolopyridazine group, and a tetrazole group.

The group containing a dissociative proton having a pKa (acid dissociation constant) value of 4 to 11 in a 1/1 by volume mixture of water and ethanol is not specifically limited in kind and position of substitution in a dye molecule so long as it makes a dye molecule substantially water-insoluble at pH 6 or less and substantially water-soluble at pH 8 or more. Preferably, such a dissociative group is a carboxyl group, a sulfamoyl group, a sulfonamide group, or a hydroxyl group; more preferably a carboxyl group. The dissociative group may substitute a dye molecule either directly or via a divalent connecting group such as an alkylene group and a phenylene group. Examples of dissociative groups which substitute a dye molecule via a divalent connecting group include a 4-carboxyphenyl group, a 2-methyl-3-carboxyphenyl group, a 2,4-dicarboxyphenyl group, a 3,5-dicarboxyphenyl group, a 3-carboxyphenyl group, a 2,5-dicarboxyphenyl group, a 3-ethylsulfamoylphenyl group, a 4-phenylsulfamoylphenyl group, a 2-carboxyphenyl group, a 2,4,6-trihydroxyphenyl group, a 3-benzenesulfonamidophenyl group, a 4-(p-diaminobenzenesulfonamido)phenyl group, a 3-hydroxyphenyl group, a 2-hydroxyphenyl group, a 4-hydroxyphenyl group, a 2-hydroxy-4-carboxyphenyl group, a 3-methoxy-4-carboxyphenyl group, a 2-methyl-4-phenylsulfamoylphenyl group, a 4-carboxybenzyl group, a 2-carboxybenzyl group, a 3-sulfamoylphenyl group, a 4-sulfamoylphenyl group, a 2,5-disulfamoylphenyl group, a carboxymethyl group, a 2-carboxyethyl group, a 3-carboxypropyl group, a 4-carboxybutyl group, and an 8-carboxyoctyl.

The alkyl group represented by R, $R_3$, or $R_6$ is preferably a $C_{1-10}$ alkyl group such as a methyl group, an ethyl group, an n-propyl group, an isoamyl group, and an n-octyl group.

The alkyl group represented by $R_1$ or $R_2$ is preferably a $C_{1-20}$ alkyl group such as a methyl group, an ethyl group, an n-propyl group, an isobutyl, and an isopropyl group. Such an alkyl group may contain substituents such as a halogen atom (e.g., chlorine, bromine); a nitro group; a cyano group; a hydroxyl group; a carboxyl group; an alkoxy group (e.g., methoxy, ethoxy); an alkoxycarbonyl group (e.g., methoxycarbonyl, i-propoxycarbonyl); an aryloxy group (e.g., phenoxy); a phenyl group; an amide group (e.g., acetylamino, methanesulfonamide); a carbamoyl group (e.g., methylcarbamoyl, ethylcarbamoyl); and a sulfamoyl group (e.g., methylsulfamoyl, phenylsulfamoyl).

The aryl group represented by $R_1$ or $R_2$ is preferably a phenyl group or a naphthyl group which may contain substituents. Examples of such substituents include those described with reference to the alkyl group represented by $R_1$ and $R_2$ (e.g., methyl, ethyl).

The acyl group represented by $R_1$ or $R_2$ is preferably a $C_{2-10}$ acyl group such as an acetyl group, a propionyl group, an n-octanoyl group, an n-decanoyl group, an isobutanoyl and a benzoyl group. Examples of the alkylsulfonyl or arylsulfonyl group represented by $R_1$ or $R_2$ include a methanesulfonyl group, an ethanesulfonyl group, an n-butanesulfonyl group, an n-octanesulfonyl group, a benzenesulfonyl group, a p-toluenesulfonyl group and an o-carboxybenzenesulfonyl group.

The alkoxy group represented by $R_3$ or $R_6$ is preferably a $C_{1-10}$ alkoxy group such as a methoxy group, an ethoxy group, an n-butoxy group, an n-octoxy group, a 2-ethylhexyloxy group, an isobutoxy group, and an isopropoxy group. Examples of the halogen atom represented by $R_3$ or $R_6$ include chlorine, bromine, and fluorine.

An example of the ring formed by the connection of $R_1$ to $R_4$ or $R_2$ to $R_5$ is a julolidine ring.

Examples of the 5- or 6-membered ring formed by the connection of $R_1$ to $R_2$ include a piperidine ring, a morpholine ring, and a pyrrolidine ring.

The methine ring represented by $L_1$, $L_2$, or $L_3$ may contain substituents such as a methyl group, an ethyl group, a cyano group, a phenyl group, a chlorine atom, and a hydroxypropyl group.

The electrophilic groups represented by X or Y may be the same or different and each represents a cyano group; a carboxyl group; an alkylcarbonyl group (which may be substituted, for example, with an acetyl group, a propionyl group, a heptanoyl group, a dodecanoyl group, a hexadecanoyl group, a 1-oxo-7-chloroheptyl group); an arylcarbonyl group (which may be substituted, for example, with a benzoyl group, a 4-ethoxycarbonylbenzoyl group, a 3-chlorobenzoyl group); an alkoxycarbonyl group (which may be substituted, for example, with a methoxycarbonyl group, an ethoxycarbonyl group, a butoxycarbonyl group, a t-amyloxycarbonyl group, a hexyloxycarbonyl group, a 2-ethylhexyloxycarbonyl group, an octyloxycarbonyl group, a decyloxycarbonyl group, a dodecyloxycarbonyl group, a hexadecyloxycarbonyl group, an octadecyloxycarbonyl group, a 2-butoxyethoxycarbonyl group, a 2-methylsulfonylethoxycarbonyl group, a 2-cyanoethoxycarbonyl group, a 2-(2-chloroethoxy)ethoxycarbonyl group, a 2-[2-(2-chloroethoxy)ethoxy]ethoxycarbonyl group); an aryloxycarbonyl group (which may be substituted, for example, with a phenoxycarbonyl group, a 3-ethylphenoxycarbonyl group, a 4-ethylphenoxycarbonyl group, a 4-fluorophenoxycarbonyl group, a 4-nitrophenoxycarbonyl group, a 4-methoxyphenoxycarbonyl group, a 2,4-di(t-amyl)-phenoxycarbonyl group); a carbamoyl group (which may be substituted, for example, with an ethylcarbamoyl group, a dodecylcarbamoyl group, a phenylcarbamoyl group, a 4-methoxyphenylcarbamoyl group, a 2-bromophenylcarbamoyl group, a 4-chlorophenylcarbamoyl group, a 4-ethoxycarbonylphenylcarbamoyl group, a 4-propylsulfonylphenylcarbamoyl group, a 4-cyanophenylcarbamoyl group, a 3-methylphenylcarbamoyl group, a 4-hexyloxyphenylcarbamoyl group, a 2,4-di(t-amyl)phenylcarbamoyl group, a 2-chloro-3-(dodecyloxycarbamoyl)phenylcarbamoyl group, a 3-(hexyloxycarbonyl)phenylcarbamoyl group); a sulfonyl group (e.g., a methylsulfonyl group, a phenylsulfonyl group); or a sulfamoyl group (which may be substituted, for example, with a sulfamoyl group, a methylsulfamoyl group).

Specific examples of dyes represented by general formulae (I), (II), (III), (IV), (V), and (VI) that can be used in the present invention are set forth below (the Roman numeral preceding each dye indicates which general formula represents each specific example):

I-1
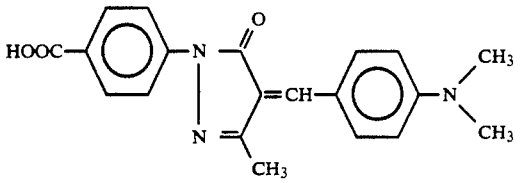
I-2
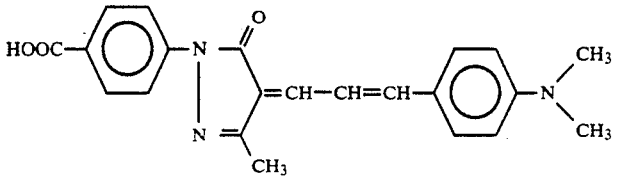
I-3
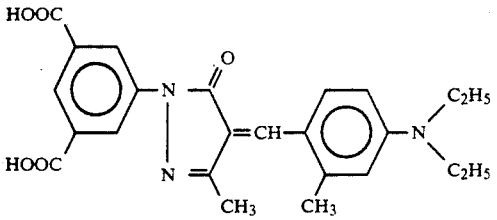
I-4
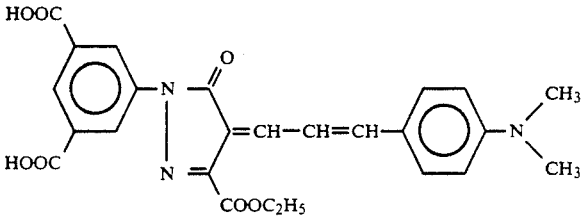
I-5
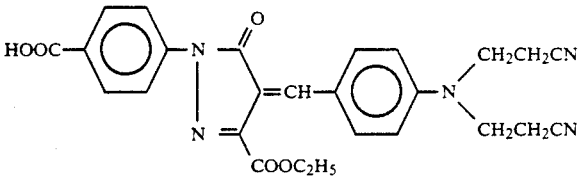
I-6
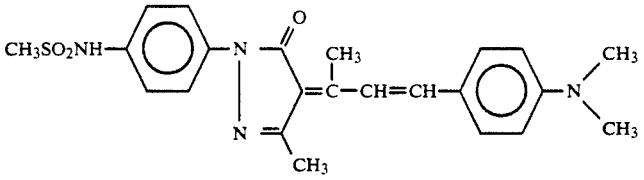
I-7
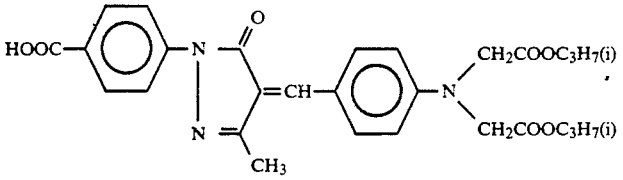
I-8
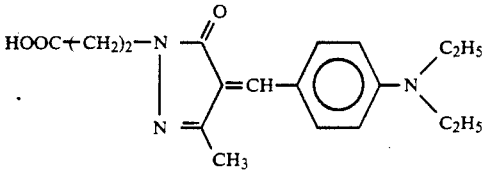

-continued
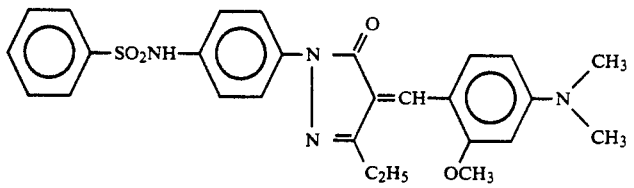
I-9
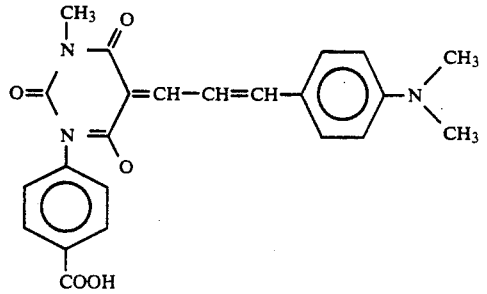
I-10
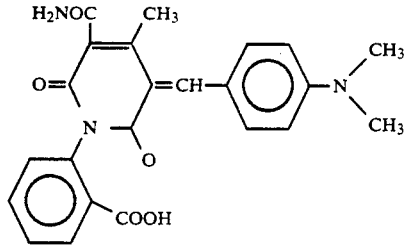
I-11
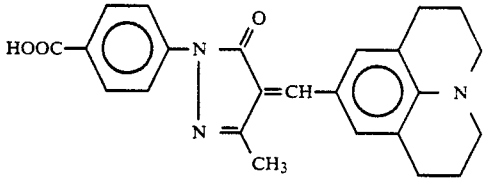
I-12
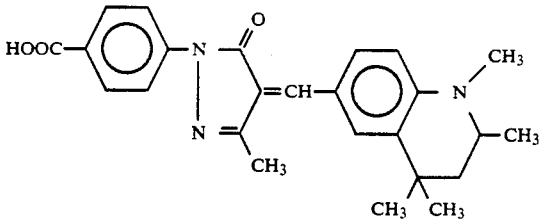
I-13
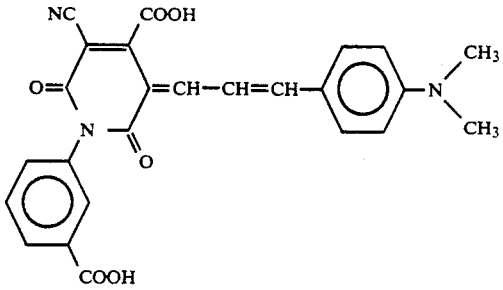
I-14

-continued
I-15
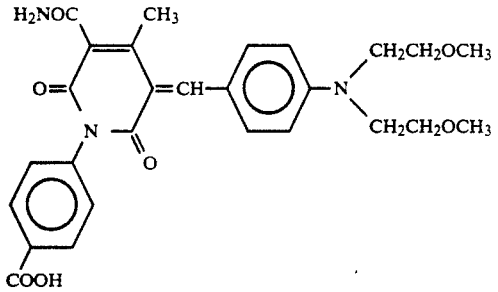
I-16
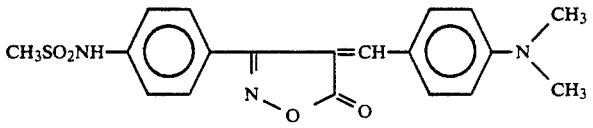
I-17
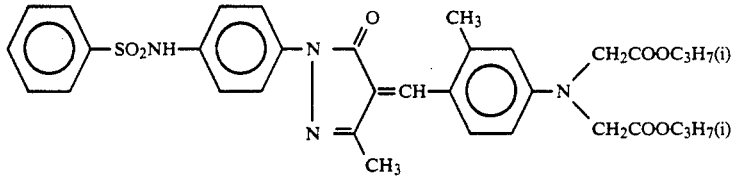
I-18
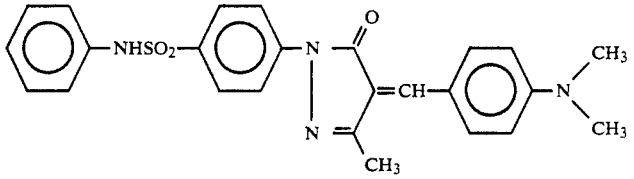
I-19
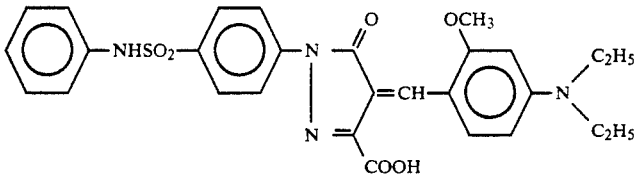
I-20
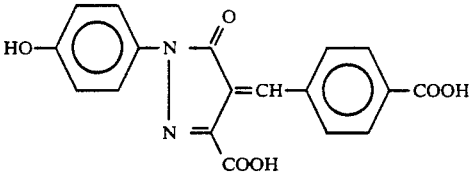
I-21
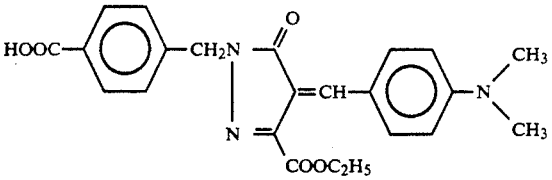
I-22
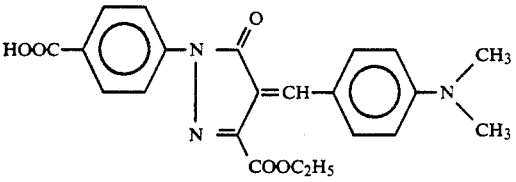

-continued
I-23
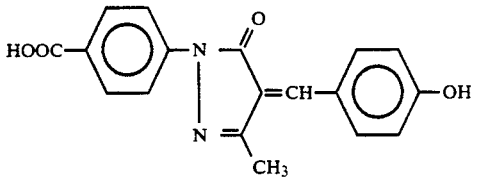
I-24
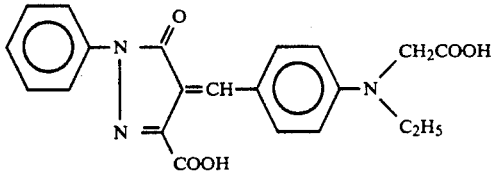
I-25
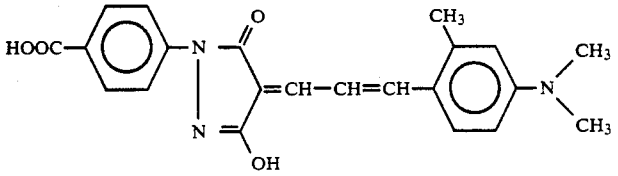
I-26
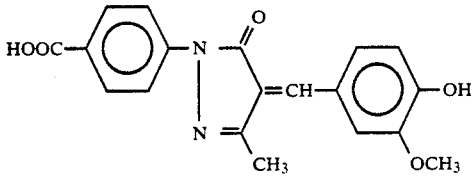
II-1
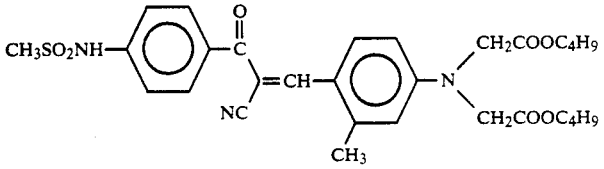
II-2
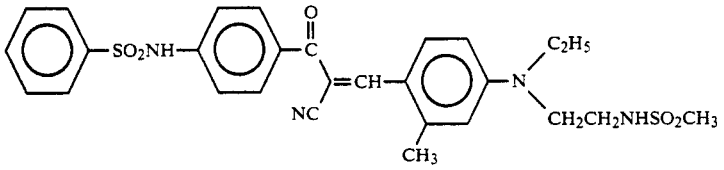
II-3
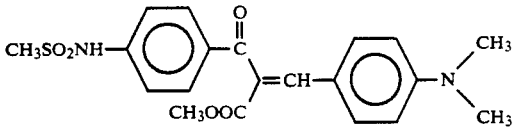
II-4
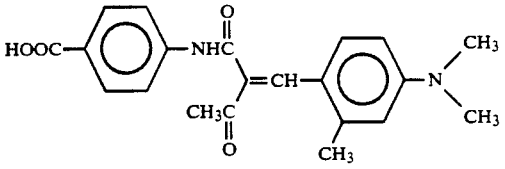
II-5
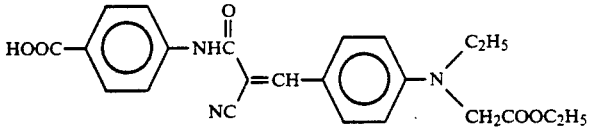

-continued
II-6
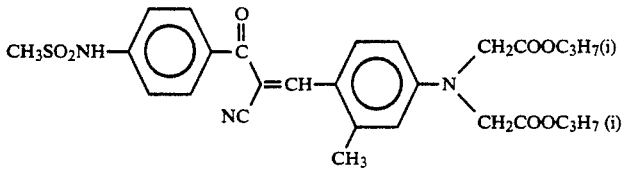
III-1
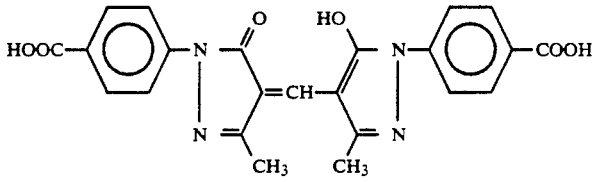
III-2
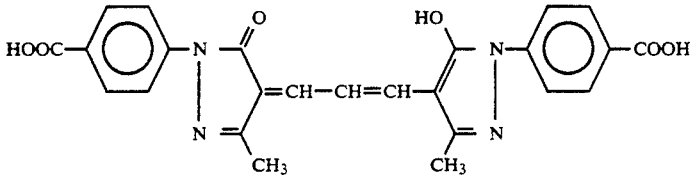
III-3
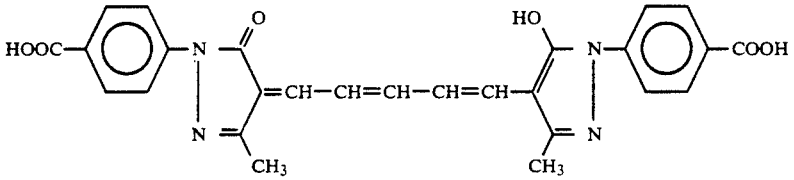
III-4
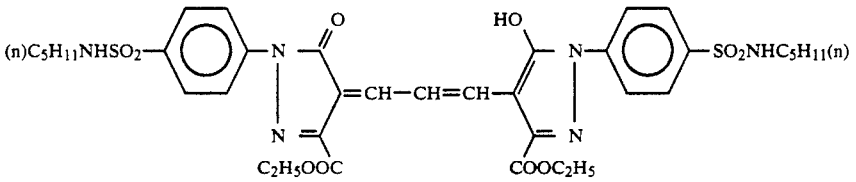
III-5
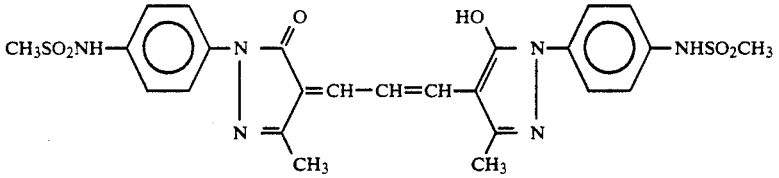
III-6
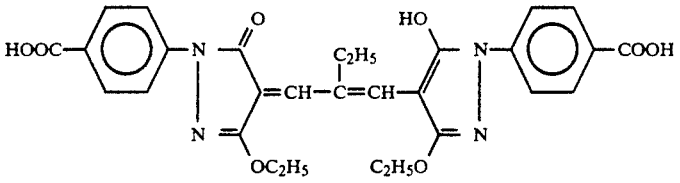
III-7
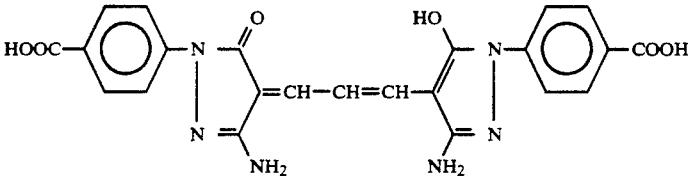

-continued
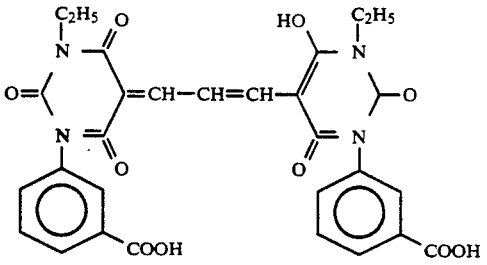
III-8
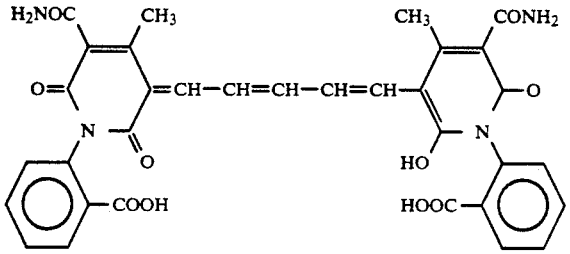
III-9
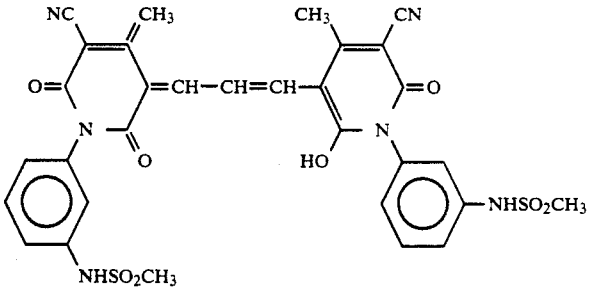
III-10
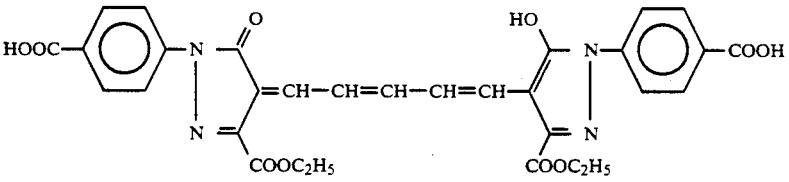
III-11
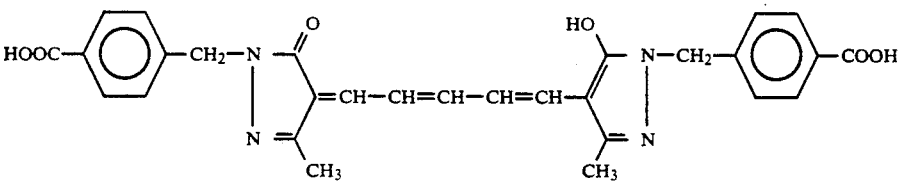
III-12
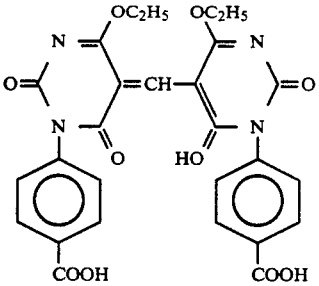
III-13

-continued
III-14
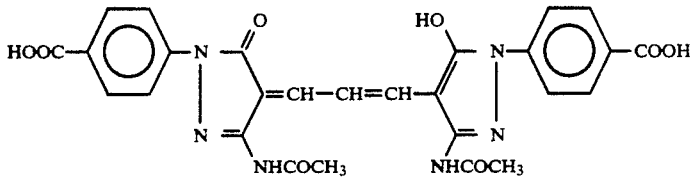
III-15
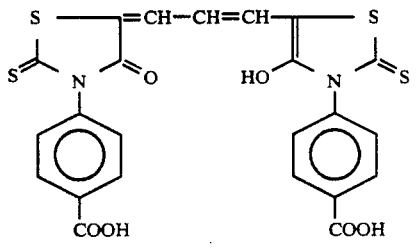
III-16
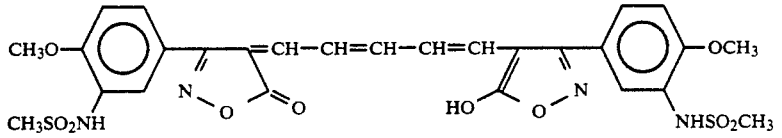
III-17
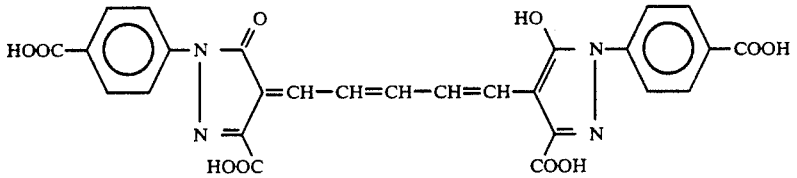
III-18
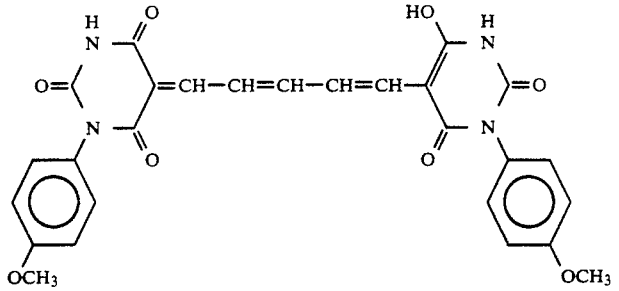
III-19
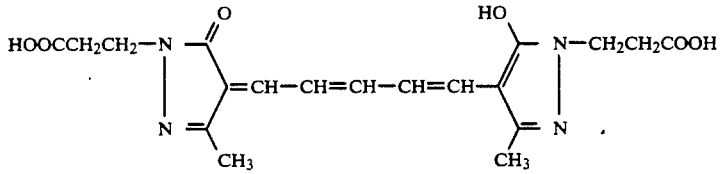
III-20
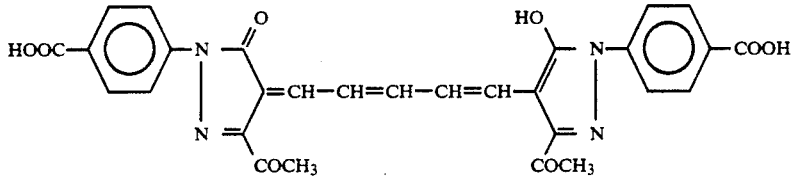

-continued
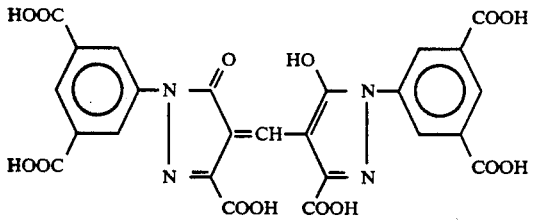
III-21
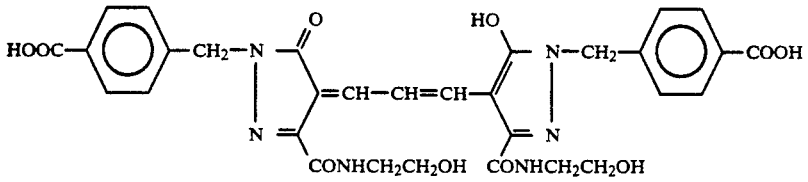
III-22
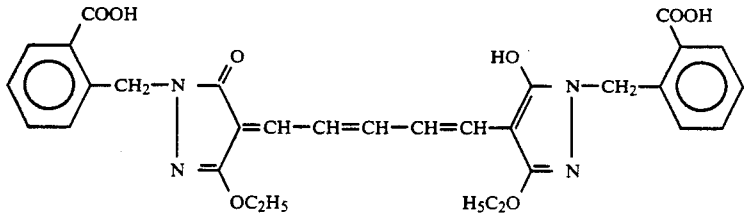
III-23
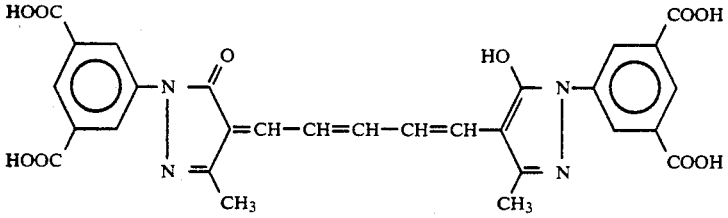
III-24
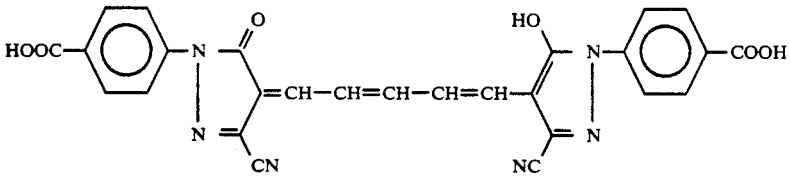
III-25
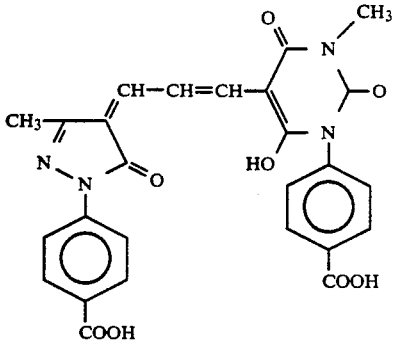
III-26

-continued
III-27
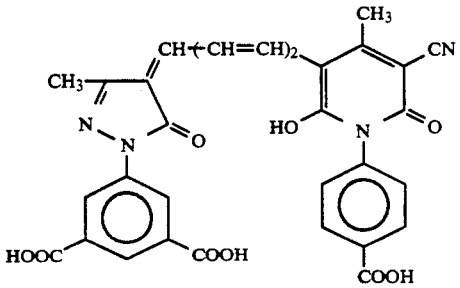
III-28
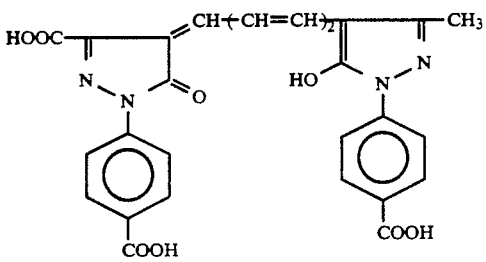
III-29
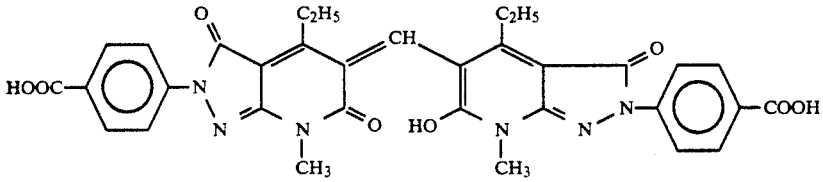
III-30
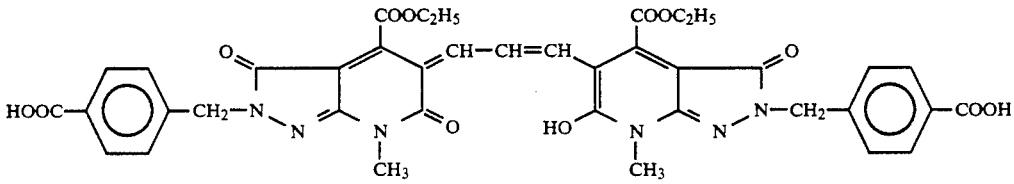
III-31
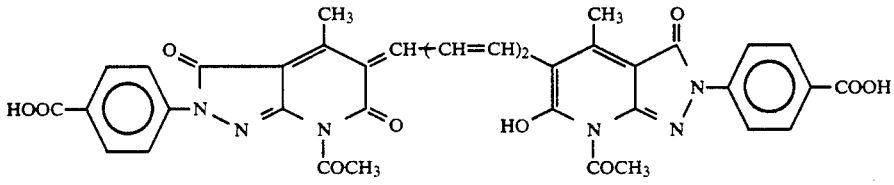
III-32
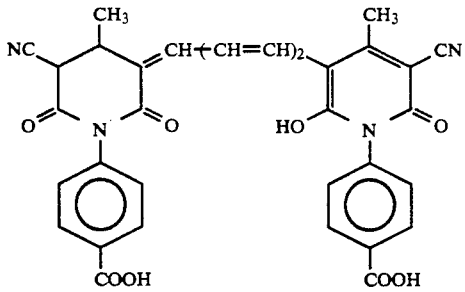
III-33
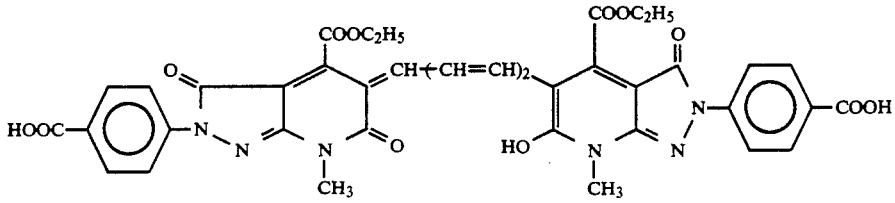

-continued
III-34
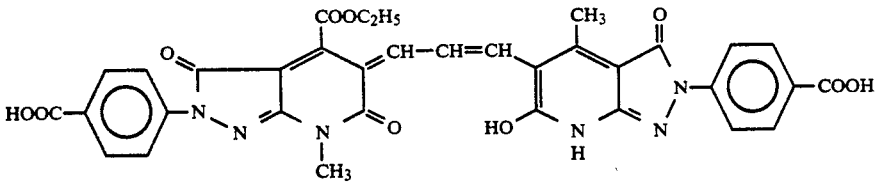
III-35
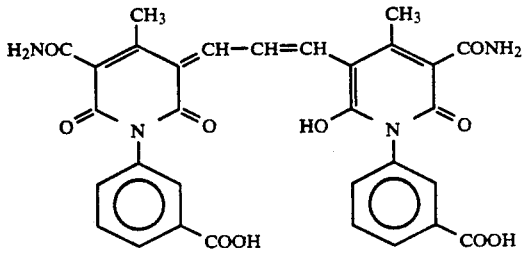
IV-1
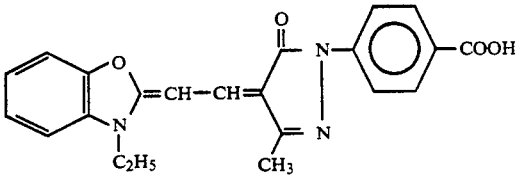
IV-2
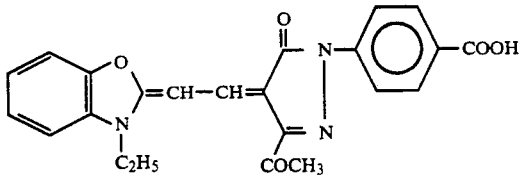
IV-3
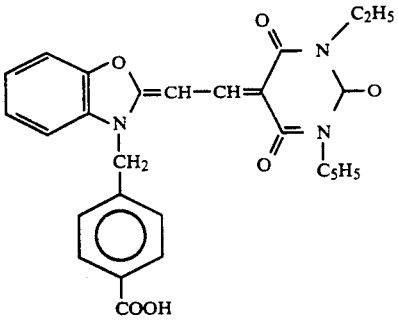
IV-4
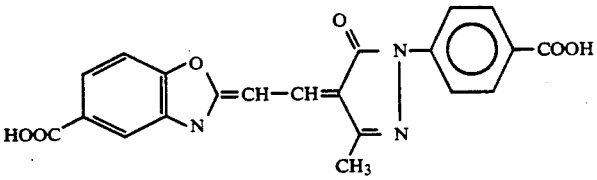
IV-5
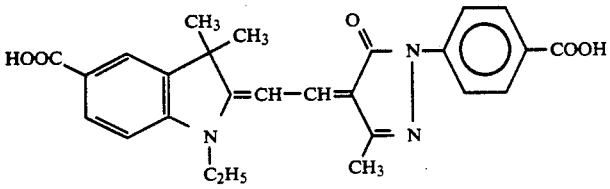

-continued
IV-6
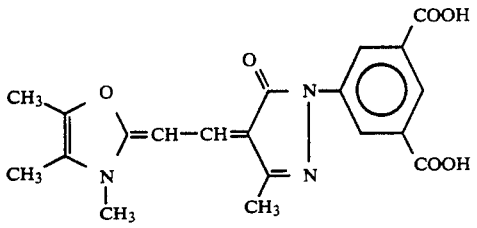
IV-7
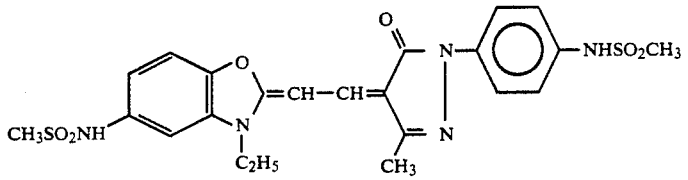
IV-8
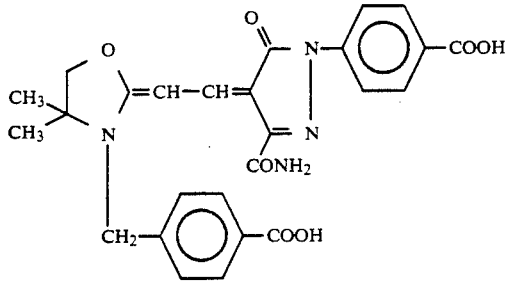
IV-9
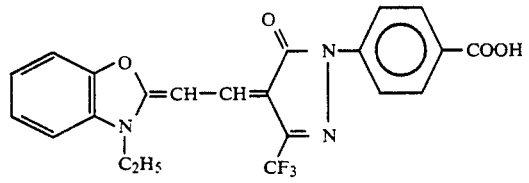
IV-10
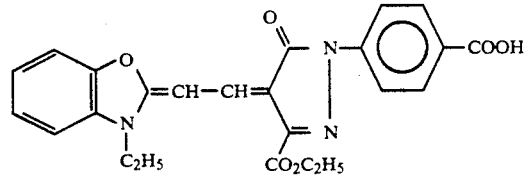
IV-11
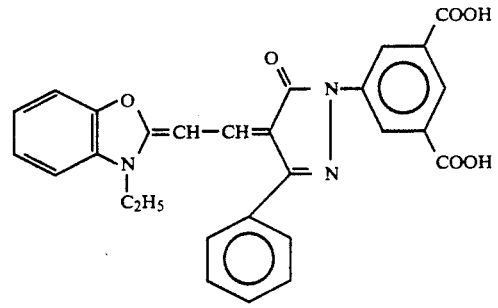

-continued
IV-12
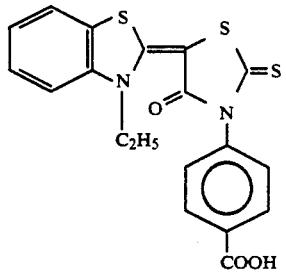
IV-13
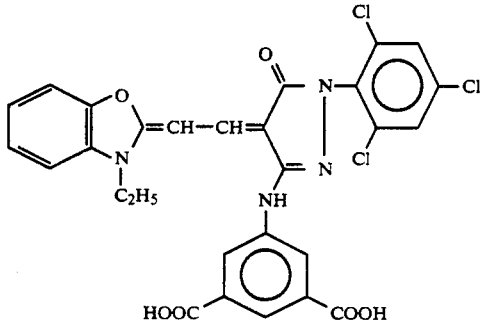
IV-14
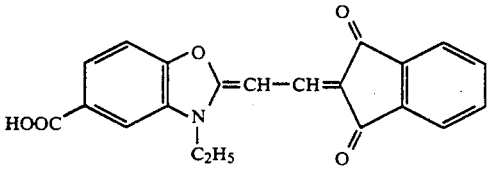
IV-15
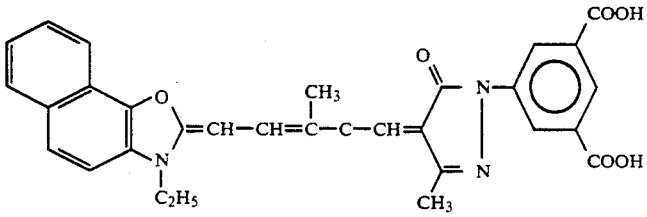
IV-16
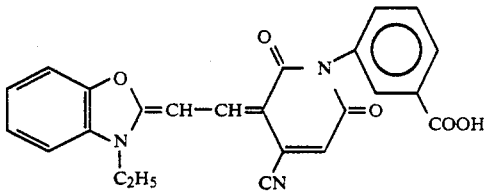
V-1
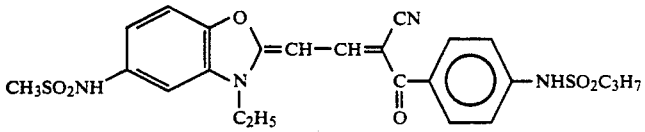
V-2
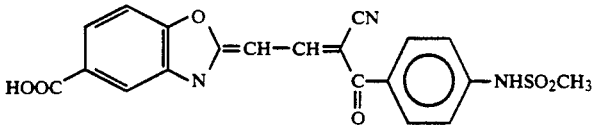
V-3
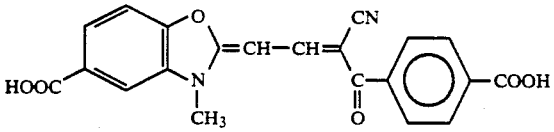

-continued
V-4
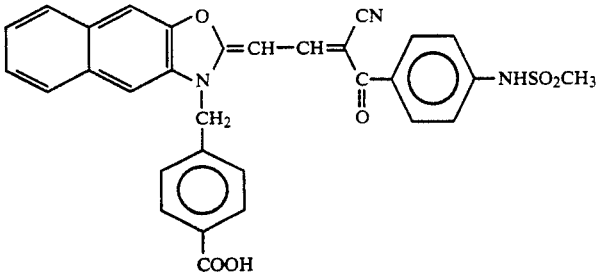
V-5
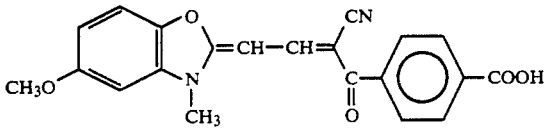
V-6
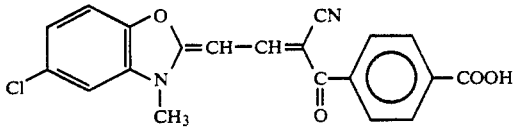
V-7
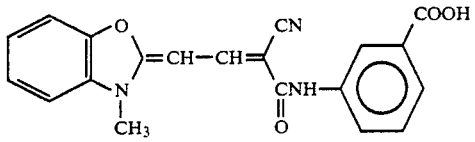
VI-1
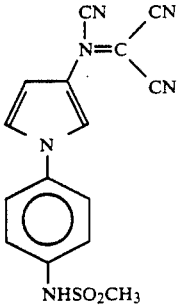
VI-2
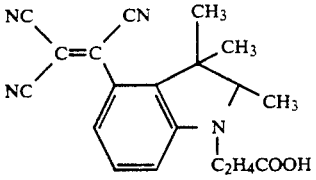
VI-3
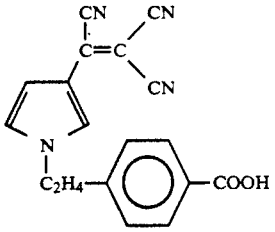
VI-4
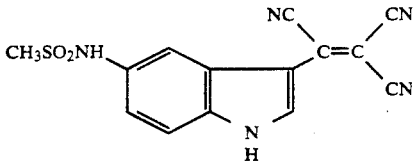

-continued
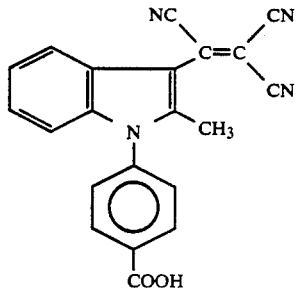
VI-5
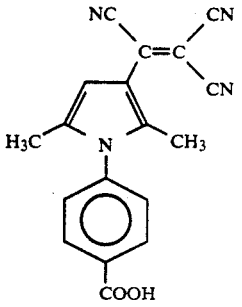
VI-6
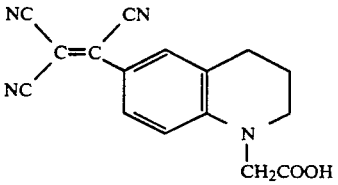
VI-7
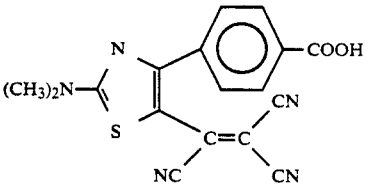
VI-8
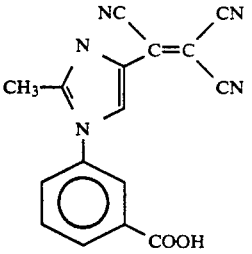
VI-9
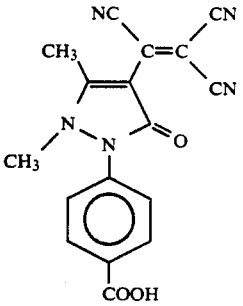
VI-10

-continued

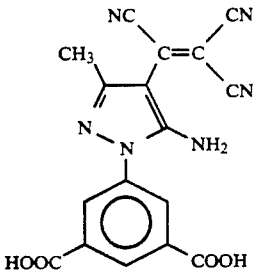

VI-11

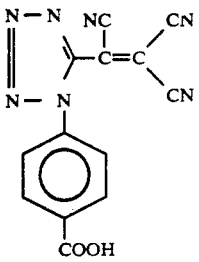

VI-12

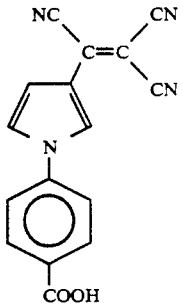

VI-13

The synthesis of dyes that can be used in the present invention can be accomplished using any suitable method. Examples of suitable methods are described in International Patent WO 88/04794, European Patents 0,274,723Al, 276,566 and 299,435, JP-A-52-92716, JP-A-55-155350, JP-A-55-155351, JP-A-61-205934, JP-A-48-68623, and U.S. Pat. Nos. 2,527,583, 3,486,897, 3,746,539, 3,933,798, 4,130,429 and 4,040,841.

The dyes of the present invention are incorporated as a dispersion of finely divided solid into a layer of the emulsion such as a hydrophilic colloidal layer to be coated on a photographic element. Such a dispersion can be prepared by precipitating a dye in the form of dispersion and/or by subjecting a dye to fine grinding by a known grinding means such as ball mill (e.g., a ball mill, a vibrating ball mill, or a planetary ball mill), a sand mill, a colloid mill, a jet mill, or a roller mill in the presence of a dispersant. In this case, a solvent (e.g., water or alcohol) may be present.

Alternatively, such a dispersion can be prepared by dissolving a dye in a proper solvent, and then adding a nonsolvent of the dye to the solution to cause precipitation of the dye in the form of powder of microcrystal. Optionally, a surface active agent for dispersion may be used.

Yet another method for preparing such a dispersion is to dissolve a dye in a proper solvent while properly adjusting the pH value of the solvent, and then changing the pH to crystallize the dye.

Dye grains of the dispersion should have a mean diameter of 10 μm or less, preferably 2 μm or less, particularly 0.5 μm or less. More preferably, the dye grain is in the form of finely divided powder having a diameter of 0.1 μm or less.

The content of the dye used in the present invention is in the range of 1 to 1,000 mg/m$^2$, preferably 5 to 800 mg/m$^2$.

The present dye dispersion can be-incorporated in any layer regardless of whether it is an emulsion layer or interlayer.

Colloidal silver which are normally incorporated in the yellow filter layer and antihalation layer can be partly or entirely replaced by the present dye dispersion to attain the effects of the present invention more remarkably.

In the present invention, the volume of an emulsion layer is the product of coated area and dried film thickness.

In the present invention, the silver density should be in the range of 0.4 g/cm$^3$ or more to accomplish the objects of the present invention. In view of graininess and fogging, the silver density should be in the range of 2 g/cm$^3$ or less, more preferably 0.6 to 1.5 c/cm$^3$, particularly 0.8 to 1 g/cm$^3$.

A silver halide emulsion layer having the above silver density may be present in any layer in the light-sensitive material. Preferably, the silver halide emulsion layer having the above silver density is located as close as possible to the layer containing the solid dye dispersion of the present invention, to better accomplish the objects of the present invention. More preferably, the silver halide emulsion layer having the above silver density is located adjacent to the layer containing the solid dye dispersion of the present invention.

At least one layer having the above described silver density needs to be present in the light-sensitive material. More preferably, two or more such layers are present in the light-sensitive material. In a multicolor light-sensitive material comprising a blue-sensitive layer, a green-sensitive layer and a red-sensitive layer, if these respective color-sensitive layers consist of two or more light-sensitive emulsion layers having different sensitivities, the silver density of at least one of the light-sensitive emulsion layer having the lowest sensitivity in these respective color-sensitive layers is preferably within the above described range. More preferably, all the light-sensitive emulsion layers constituting these color-sensitive layers have the above described silver density of the present invention.

The method for incorporating the sensitizing dye is described below.

The temperature at which the sensitizing dye is incorporated is preferably in the range of 50° C. or higher, more preferably 60° C. or higher to reduce fog. The sensitizing dye can be incorporated at any time between before the beginning of the formation of grains and the actual coating, e.g., between after the chemical ripening and before the coating; during the chemical ripening; during the desalting step; or during the grain formation step. Alternatively, the reaction vessel can be previously charged with sensitizing dye before the formation of grains.

It is preferred that sensitizing dye be incorporated before or during the chemical ripening, or before or during the formation of grains in order to intensify the adsorption of the sensitizing dye and attain a higher sensitization.

Generally, if sensitizing dye is incorporated into the system at an elevated temperature, the adsorption of the dye is intensified which often causes the desilvering speed to be lowered when the photographic material is developed. In the present invention, however, the desilvering speed is not reduced.

The sensitizing dye in the present invention can be incorporated in the system either batchwise or continuously during a specified period of time. Alternatively, the sensitizing dye can be incorporated in the silver halide emulsion in the form of solution in water or an organic solvent. As disclosed in JP-A-60-196749, a substantially water-insoluble sensitizing dye- can be used in the form of dispersion in an aqueous solvent.

Any known sensitizing dye can be used in the present invention. Examples of such a sensitizing dye include a methine dye such as a cyanine dye, a merocyanine dye, a hemicyanine dye, a rhodacyanine dye, an oxonol dye, a hemioxonol dye, and a styryl dye. Useful among these dyes are monomethine and trimethine cyanine dyes containing one or two sulfone or sulfoalkyl groups as substituents. Particularly useful among these dyes are oxacarbocyanine, thiocarbocyanine, and benzimidacarbocyanine dyes containing one or two sulfoalkyl groups as substituents.

Spectral sensitizing dyes that can be used are described in West German Patent 929,080, U.S. Pat. Nos. 2,493,748, 2,503,776, 2,519,001, 2,912,329, 3,656,959, 3,672,897, 3,694,217,4,025,349, 4,046,572, 2,688,545, 2,977,229, 3,397,060, 3,522,062, 3,527,641, 3,617,293, 3,628,964, 3,666,480, 3,672,898, 3,679,428, 3,703,377, 3,814,609, 3,837,862, and 4,026,707, British Patents 1,242,588, 1,344,281, and 1,507,803, JP-B-44-14030, JP-B-52-24844, JP-B-43-4936, JP-B-53-12375, JP-A-52-110618, JP-A-52-109925, and JP-A-50-80827.

Among these sensitizing dyes, those particularly useful for the present invention are cyanine dyes. Specific examples of useful cyanine dyes of the present invention include those represented by general formula (VIII):

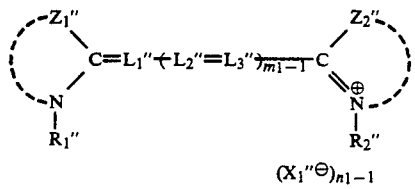

(VIII)

wherein $Z''_1$ and $Z''_2$ each represents an atomic group required for the formation of a heterocyclic nucleus commonly incorporated in a cyanine dye, particularly a thiazole nucleus, a thiazoline nucleus, a benzothiazole nucleus, a naphthothiazole nucleus, an oxazole nucleus, an oxazoline nucleus, a benzoxazole nucleus, a naphthoxazole nucleus, a tetrazole nucleus, a pyridine nucleus, a quinoline nucleus, an imidazoline nucleus, an imidazole nucleus, a benzimidazole nucleus, a naphthoimidazole nucleus, a selenazole nucleus, a selenazoline nucleus, a benzoselenazole nucleus, a naphthoselenazole nucleus or an indolenine nucleus. These nuclei may be substituted by a lower alkyl group such as a methyl group, a halogen atom, a phenyl group, a hydroxyl group, a $C_{1-4}$ alkoxy group, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, or a nitro group, for example.

$L''_1$, $L''_2$ or $L''_3$ each represents a methine group or a substituted methine group. Examples of such a substituted methine group include a methine group having a lower alkyl group such as a methyl group or an ethyl group, and an aralkyl group such as a phenyl group, a substituted phenyl group, a methoxy group, an ethoxy group, or an aralkyl group such as a phenethyl group as a substituent.

$L''_1$ and $R''_1$, $L''_3$ and $R''_2$, and, if ml is 3, $L''_2$ and $L''_2$ may be crosslinked to each other with alkylene to form a 5- or 6-membered ring.

$R''_1$ and $R''_2$ each represents a lower alkyl group (preferably a $C_{1-6}$ alkyl group), or a substituted alkyl group having a carboxyl group, a sulfo group, a hydroxyl group, a halogen atom, a $C_{1-4}$ alkoxy group, a phenyl group, or a substituted phenyl group as a substituent (preferably containing $C_{1-5}$ alkylene portion) (e.g., β-sulfoethyl, γ-sulfopropyl, γ-sulfobutyl, δ-sulfobutyl, 2-[2-(3-sulfopropoxy)ethoxy]ethyl, 2-hydroxysulfopropyl, 2-chlorosulfopropyl, 2-methoxyethyl, 2-hydroxyethyl, carboxymethyl, 2-carboxyethyl, 2,2,3,3-tetrafluoropropyl, 3,3,3-trifluoroethyl, allyl), or a substituted alkyl group commonly used as the N-substituent of a cyanine dye. The suffix $m_1$ represents an integer 1, 2 or 3. $X''_1{}^{\ominus}$ represents an acid anion group commonly incorporated in a cyanine dye such as an iodine ion, a bromine ion, a p-toluenesulfonic acid ion, or a perchloric acid ion. The suffix $n_1$ represents an integer 1 or 2. If the cyanine dye has a betaine structure, $n_1$ is 1.

Further examples of useful cyanine dyes include:

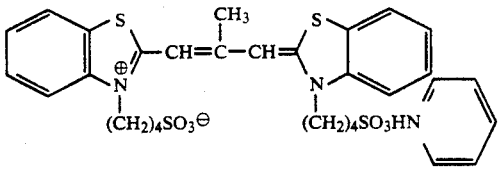
(Dye 1)
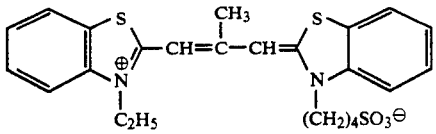
(Dye 2)
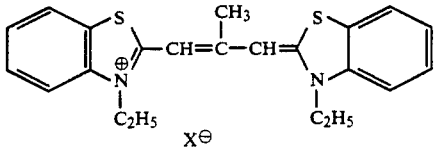
(Dye 3)
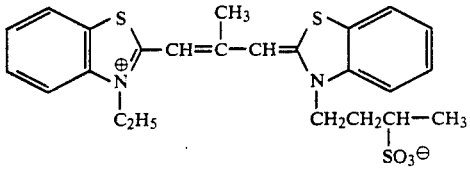
(Dye 4)
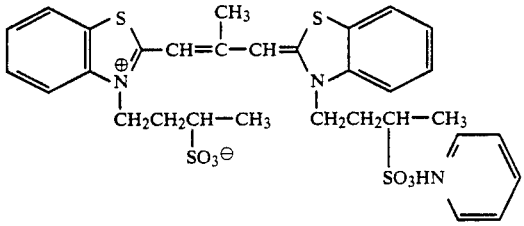
(Dye 5)
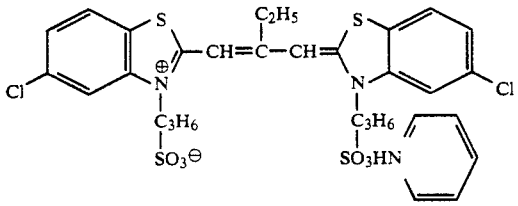
(Dye 6)
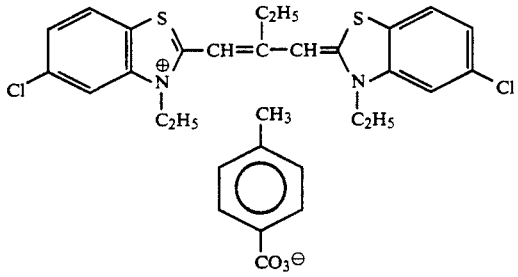
(Dye 7)
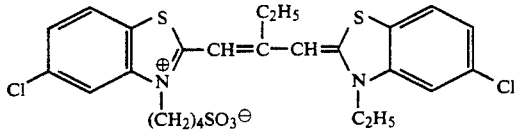
(Dye 8)

-continued
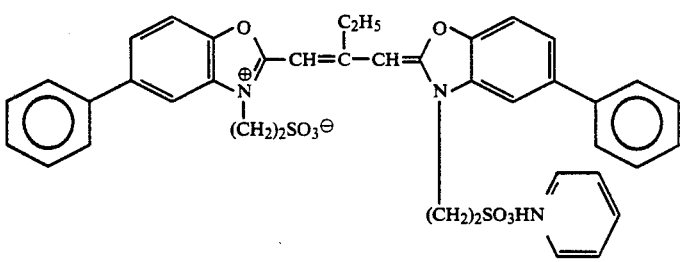
(Dye 9)
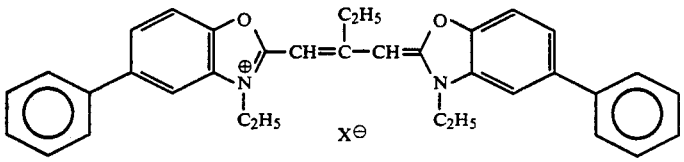
(Dye 10)
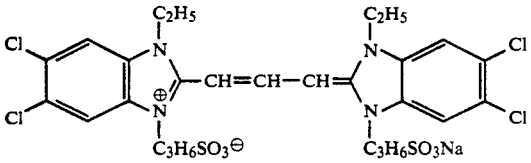
(Dye 11)
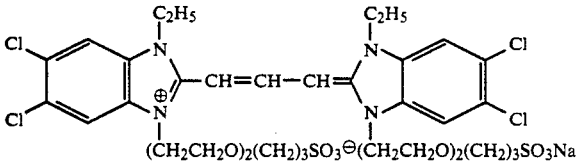
(Dye 12)
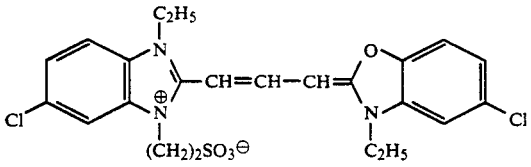
(Dye 13)
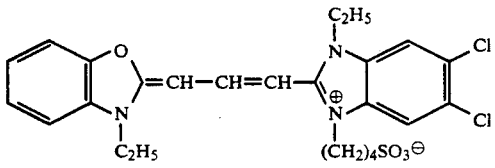
(Dye 14)
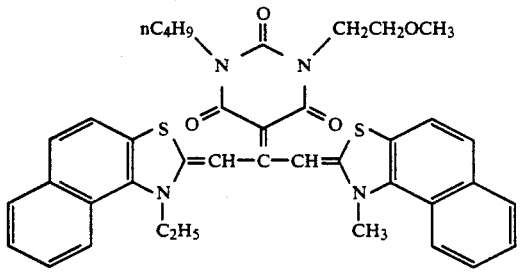
(Dye 15)

-continued
(Dye 16)
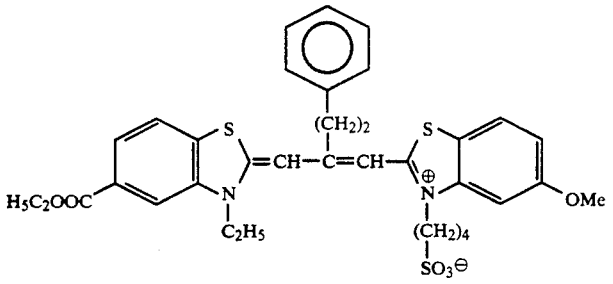
(Dye 17)
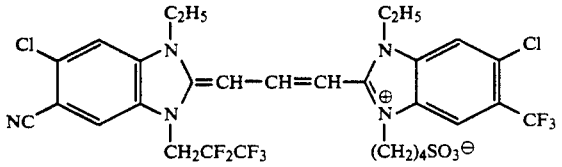
(Dye 18)
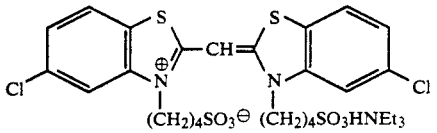
(Dye 19)
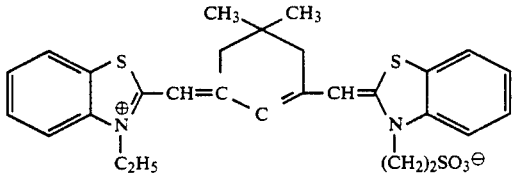
(Dye 20)
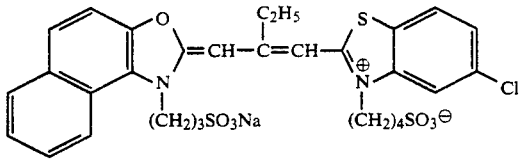
(Dye 21)
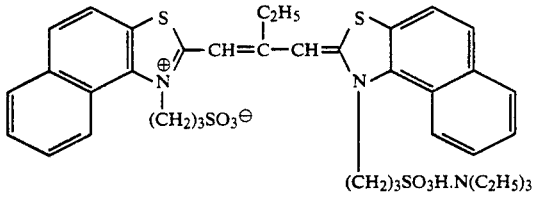
(Dye 22)
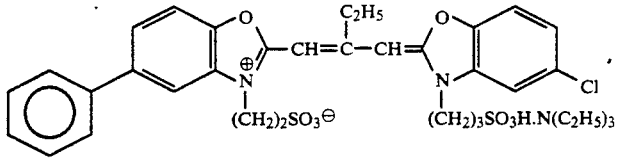
(Dye 23)
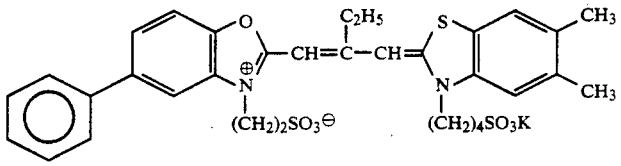

-continued

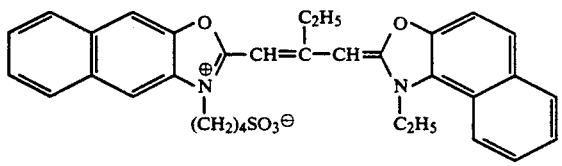

(Dye 24)

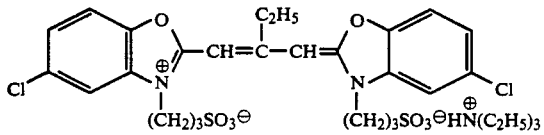

(Dye 25)

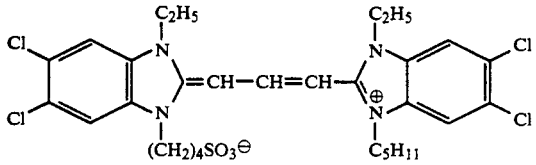

(Dye 26)

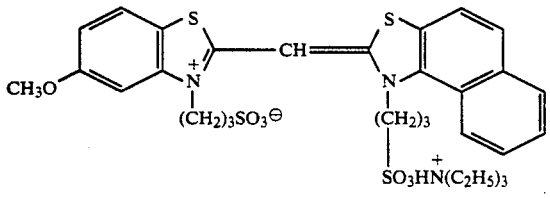

(Dye 27)

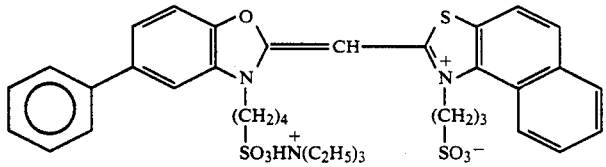

(Dye 28)

The amount of sensitizing dye to be incorporated during the preparation of the silver halide emulsion depends on the kind of the sensitizing dyes or the silver halide content and cannot be unequivocally specified. In general, however, the sensitizing dye can be used in substantially the same amount as that used in the conventional process.

The compound represented by general formula (VII) is described below.

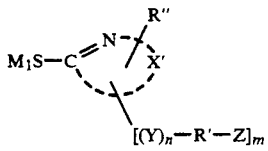

(VII)

wherein $M_1$represents a hydrogen atom, a cation, or a protective group for a mercapto group which undergoes cleavage with an alkali. More particularly, $M_1$ represents a hydrogen atom; a cation (e.g., a sodium ion, a potassium ion, an ammonium ion); or a protective group of a mercapto group which undergoes cleavage with an alkali (e.g., —COR', —COOR', —$CH_2CH_2$-COR' in which R' represents a hydrogen atom, an alkyl group, an aralkyl group or an aryl group).

X' represents an atomic group required for the formation of a 5- or 6-membered heterocyclic group which contains as a hetero atom sulfur, selenium, nitrogen, or oxygen. X' may be substituted or condensed.

Examples of such a 5- or 6-membered heterocyclic group include tetrazole, triazole, imidazole, oxazole, thiadiazole, pyridine, pyrimidine, triazine, azabenzimidazole, purine, tetraazaindene, triazaindene, pentaazaindene, benzotriazole, benzimidazole, benzoxazole, benzothiazole, benzoselenazole, and naphthoimidazole.

R' represents a straight or branched chain alkylene group, a straight or branched chain alkenylene group, a straight or branched chain aralkylene group or arylene group. Z represents a polar substituent. Y represents —S—, —O—,

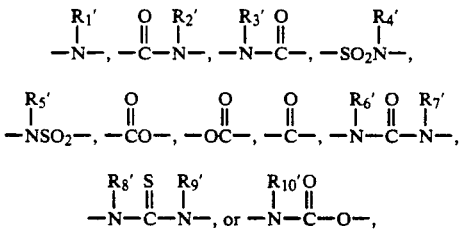

in which $R'_1$, $R'_2$, $R'_3$, $R'_4$, $R'_5$, $R'_6$, $R'_7$, $R'_8$, $R'_9$ and $R'_{10}$ each represents a hydrogen atom, or a substituted or unsubstituted alkyl, aryl, alkenyl, or aralkyl group. R'' represents a hydrogen atom or a group which can substitute for a hydrogen atom. The suffix n represents the integer 0 or 1. The suffix m represents the integer 0, 1, or 2.

Examples of the polar substituent represented by Z include a substituted or unsubstituted amino group (which may or may not be in the form of salt); a quaternary ammonium group; an alkoxy group; an aryloxy group; an alkylthio group; an arylthio group; a heterocyclic oxy group; a heterocyclic thio group; a sulfonyl group; a carbamoyl group; a sulfamoyl group; a carbonamide group; a sulfonamide group; an acyloxy group; a ureido group; an acyl group; an aryloxycarbonyl group; a thioureido group; a sulfonyloxy group; a heterocyclic group; a hydroxyl group; and a carboxyl group.

$R'_1$, $R'_2$, $R'_3$, $R'_4$, $R'_5$, $R'_6$, $R'_7$, $R'_8$, $R'_9$ and $R'_{10}$ each represents a hydrogen atom, a substituted or unsubstituted alkyl group, a substituted or unsubstituted aryl group, a substituted or unsubstituted alkenyl group, or a substituted or unsubstituted aralkyl group.

R'' represents a hydrogen atom, a fluorine atom, a chlorine atom, a bromine atom, a $C_{1-6}$ substituted or unsubstituted alkyl group, a $C_{6-12}$ substituted or unsubstituted aryl group, a $C_{1-6}$ substituted or unsubstituted alkoxy group, a $C_{6-12}$ substituted or unsubstituted aryloxy group, a $C_{1-12}$ sulfonyl group, a $C_{1-12}$ sulfonamide group, a $C_{1-12}$ sulfamoyl group, a $C_{1-12}$ carbamoyl group, a $C_{1-12}$ amide group, a $C_{1-12}$ ureido group, a $C_{1-12}$ aryloxy or alkoxycarbonyl group, a $C_{1-12}$ aryloxy or alkoxycarbonylamino group, and a cyano group.

In general formula (VII), it is preferred that R' be a substituted or unsubstituted alkylene group. It is preferred that Y be

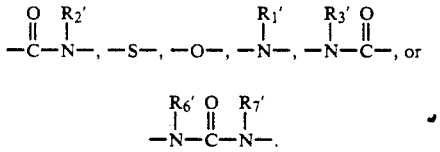

It is preferred that $R'_2$, $R'_3$, $R'_6$ and $R'_7$ be a hydrogen atom. It is preferred that Z be a substituted or unsubstituted amino group, a salt of an amino group, or a heterocyclic group.

Specific preferred examples of the compound represented by general formula (VII) are described below.

(VII-1)

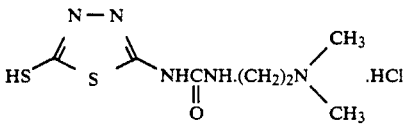

(VII-2)

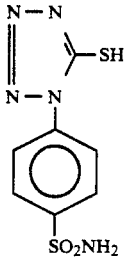

-continued (VII-3)

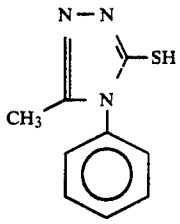

(VII-4)

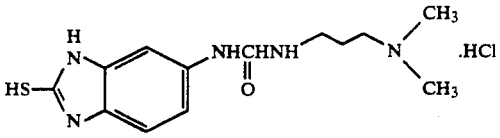

(VII-5)

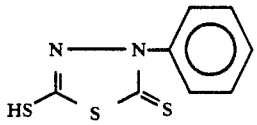

(VII-6)

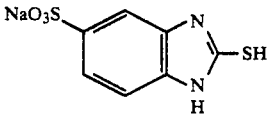

(VII-7)

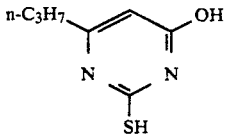

(VII-8)

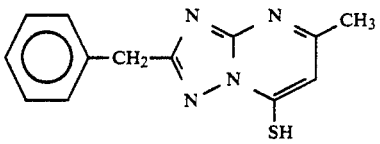

(VII-9)

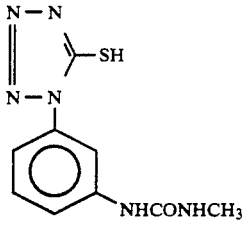

(VII-10)

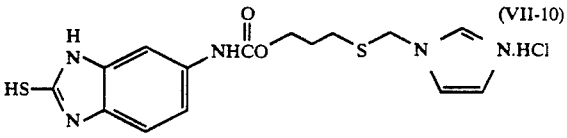

(VII-11)

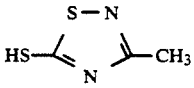

(VII-12)

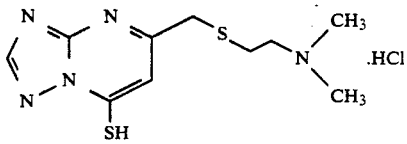

-continued

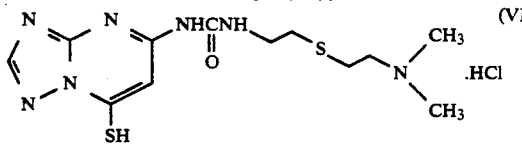

(VII-13)

Particularly preferred among these compounds are Compounds VII-1, VII-4, VII-10, and VII-13.

The compound represented by general formula (VII) is used in an amount of from $10^{-7}$ to $10^{-2}$ mol, preferably $10^{-6}$ to $10^{-3}$ mol, more preferably $10^{-5}$ to $10^{-3}$ mol, per mol of silver halide in the emulsion in which it is to be incorporated.

The compound of general formula (VII) can be incorporated into the emulsion at any time between before the beginning of the formation of grains and the actual coating, more precisely after chemical ripening and before coating, during chemical ripening, during the desilvering step, or during the grain formation step. Alternatively, the sensitizing dye can be charged into the reaction vessel prior to the formation of grains.

The color photographic light-sensitive material of the present invention can comprise at least one blue-sensitive layer, at least one green-sensitive layer, and at least one red-sensitive layer on a support. The number of silver halide emulsion layers and light-insensitive layers and the order of arrangement of these layers are not specifically limited. In a typical embodiment, the silver halide photographic material of the present invention comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In such a multilayer silver halide color photographic material, these unit light-sensitive layers are normally arranged in the following order: red-sensitive layer, green-sensitive layer, blue-sensitive layer, support. However, the order of arrangement can be reversed depending on the purpose of the application. Alternatively, two unit light-sensitive layers having the same color sensitivity can be arranged with a unit light-sensitive layer having a different color sensitivity interposed between them.

Light-insensitive layers such as various interlayers can be provided between the silver halide light-sensitive layers, on the uppermost layer, and on the lowermost layer.

These interlayers can comprise couplers such as DIR as described in JP-A-61-43748, JP-A-59-113438, JP-A-59-113440, JP-A-61-20037, and JP-A-61-20038. These interlayers can further comprise a color stain inhibitor as commonly used.

The plurality of silver halide emulsion layers constituting each unit light-sensitive layer are preferably a two-layer structure, i.e., a high sensitivity emulsion layer and a low sensitivity emulsion layer as disclosed in West German Patent 1,121,470 and British Patent 923,045. In general, these layers are preferably arranged in such an order that the light sensitivity decreases towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided in a position relatively far away from the support while a high sensitivity emulsion layer can be provided nearer to the support.

In one embodiment the layers have the following arrangement in a position relatively far away from the support: a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL). In another embodiment the layers have the following arrangement: BH, BL, GL, GH, RH, and RL. In a further embodiment, the layers have the following arrangement: BH, BL, GH, GL, RL, and RH.

As described in JP-B-55-34932, the layers can be arranged as follows: a blue-sensitive layer, GH, RH, GL, and RL in a position relatively far away from the support. Alternatively, as described in JP-A-56-25738 and JP-A-62-63936, the arrangement can be a blue-sensitive layer, GL, RL, GH, and RH.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity decreases towards the support. Even if the layer structure comprises three layers having different light sensitivities, a middle sensitivity emulsion layer, a high sensitivity emulsion layer and a low sensitivity emulsion layer can be so arranged relatively far away from the support in a color-sensitive layer as described in JP-A-59-202464.

Alternatively, a high sensitivity emulsion layer, a low sensitivity emulsion layer and a middle sensitivity emulsion layer or a low sensitivity emulsion layer, a middle sensitivity emulsion layer, and a high sensitivity emulsion layer can be so arranged.

In the case where the layer structure comprises four or more layers, too, the order and arrangement of layers can be altered as described above.

In order to improve the color reproducibility, a donor layer (CL) having an interimage effect and a different spectral sensitivity distribution from a main light-sensitive layer such as BL, GL, and RL is preferably provided adjacent, or close to, the main light-sensitive layer.

As described above, various layer structures and arrangements can be selected depending on the purpose of light-sensitive material.

A suitable silver halide to be incorporated in the photographic emulsion layer of the color light-sensitive photographic material of the present invention is silver bromoiodide, silver chloroiodide, or silver bromochloroiodide containing silver iodide in an amount of about 30 mol % or less. Preferred are silver bromoiodide and silver bromochloroiodide containing silver iodide in an amount of 8 mol % or less, more preferably 6 mol % or less, most preferably 4 mol % or less. In general, if the silver iodide content in the emulsion layer is reduced, fog occurs during storage of the light-sensitive material. Material of the present invention, however, shows no increase in the occurrence of fog and thus exhibits improved preservability.

This effect is particularly remarkable when the entire silver iodide content in light-sensitive silver halide emulsion grains is in the range of 8 mol % or less, preferably 6 mol % or less.

Silver halide grains in the photographic emulsions may be regular grains having a regular crystal form (such as a cubic, octahedral and tetradecahedral form); those having an irregular crystal form (such as a spherical or tabular form); those having a crystal defect such as a twinning plane; or those having a combination of these crystal forms.

The silver halide grains may be either fine grains of about 0.2 μm or smaller in diameter- or giant grains having a projected area diameter of up to about 10 μm. Preferred are fine grains having a diameter of 0.1 to 0.2 μm. The emulsion may be either a monodisperse emulsion or a polydisperse emulsion.

The preparation of the silver halide photographic emulsion which can be used in the present invention can be accomplished by any suitable method. For example, suitable methods are described in *Research Disclosure,* No. 17643 (December, 1978), pages 22–23, "I. Emulsion Preparation and Types"; *Research Disclosure,* No. 18716 (November, 1979), page 648; P. Glafkides, *Chimie et Physique Photographique,* Paul Montel (1967); G. F. Duffin, *Photographic Emulsion Chemistry,* Focal Press, 1966; and V. L. Zelikman et al., *Making and Coating Photographic Emulsions,* Focal Press, 1964.

Furthermore, monodisperse emulsions as described in U.S. Pat. Nos. 3,574,628 and 3,655,394 are preferably used in the present invention.

Tabular grains having an aspect ratio of about 5 or more can be used in the present invention. The preparation of such tabular grains is easily accomplished by any suitable method such as described in Gutoff, *Photographic Science and Engineering,* Vol. 14, pages 248–257 (1970); U.S. Pat. Nos. 4,434,226, 4,414,310, 4,433,048 and 4,439,520, and British Patent-2,112,157.

The individual silver halide crystals may have either a homogeneous structure or a heterogeneous structure composed of a core and an outer shell that differ in halogen composition, or the crystals may have a layered structure. Furthermore, the grains may have fused to them a silver halide having a different halogen composition or a compound other than a silver halide, e.g., silver thiocyanate or lead oxide, by an epitaxial junction.

Mixtures of grains having various crystal forms may also be used.

The silver halide emulsion to be used in the present invention is normally subjected to physical ripening, chemical ripening, and spectral sensitization. Additives to be used in these steps are described in *Research Disclosure,* Nos. 17643 and 18716 a summary of which is presented in Table A below.

Known photographic additives which can be used in the present invention are also described in the above cited *Research Disclosures* and shown in Table A below.

TABLE A

| Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23–24 | Page 648, right column to page 649, right column |
| 4. Brightening Agents | Page 24 | — |
| 5. Antifoggants and Stabilizers | Pages 24–25 | Page 649, right column |
| 6. Light Absorbents, Filter Dyes, and Ultraviolet Absorbents | Pages 25–26 | Page 649, right column to page 650, left column |
| 7. Stain Inhibitors | Page 25, right column | Page 650, left to right columns |
| 8. Dye Image Stabilizers | Page 25 | — |
| 9. Hardening Agents | Page 26 | Page 651, left column |
| 10. Binders | Page 26 | Page 651, left column |
| 11. Plasticizers and Lubricants | Page 27 | Page 650, right column |
| 12. Coating Aids and Surface Active Agents | Pages 26–27 | Page 650, right column |
| 13. Antistatic Agents | Page 27 | Page 650, right column |

In order to inhibit deterioration of photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couplers can be used in the present invention. Specific examples of these are described in *Research Disclosure,* No. 17643, Section VII-C~G.

Preferred yellow couplers are those described in U.S. Pat. Nos. 3,933,501, 4,022,620, 4,326,024, 4,401,752, 4,248,961, 3,973,968, 4,314,023 and 4,511,649, JP-B-58-10739, British Patents 1,425,020 and 1,476,760, and European Patent 249,473A.

Preferred magenta couplers are 5-pyrazolone compounds and pyrazoloazole compounds. Particularly preferred are the compounds described in U.S. Pat. Nos. 4,310,619, 4,351,897, 3,061,432, 3,725,064, 4,500,630, 4,540,654 and 4,556,630, European Patent 73,636, JP-A-60-3552, JP-A-60-43659, JP-A-61-72238, JP-A-60-35730, JP-A-5-118034, JP-A-60-185951, *Research Disclosure,* No. 24220 (June, 1984), *Research Disclosure,* No. 24230 (June, 984), and WO 88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212 and 4,296,199, West German Patent Publication No. 3,329,729, European Patents 121,365A and 249,453A, and JP-A-61-42658.

Colored couplers for correction of unnecessary absorption of developed color preferably include those described in *Research Disclosure,* No. 17643, Section VII-G, U.S. Pat. Nos. 4,163,670, 4,004,929 and 4,138,258, JP-B-57-39413, and British Patent 1,146,368. Furthermore, couplers for correction of unnecessary absorption of developed color by a fluorescent dye released upon coupling as described in U.S. Pat. No. 4,774,181 and couplers containing as a separable group a dye precursor group capable of reacting with a developing agent to form a dye as described in U.S. Pat. No. 4,777,120 are preferably used.

Couplers which form a dye having moderate diffusibility preferably include those described in U.S. Pat. No. 4,366,237, British Patent 2,125,570, European Patent 96,570, and West German Patent Publication No. 3,234,533.

Typical examples of polymerized dye forming couplers are described in U.S. Pat. Nos. 3,451,820, 4,409,320, and 4,576,910, and British Patent 2,102,173.

Couplers capable of releasing a photographically useful residue upon coupling can also be used in the present invention. Preferred examples of DIR couplers which release a developing inhibitor are described in the patents cited in *Research Disclosure,* No. 17643, Section VII-F, JP-A-57-151944, JP-A-57-154234, JP-A-60-184248, and JP-A-63-37346, and U.S. Pat. Nos. 4,248,962 and 4,782,012.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427; polyequivalent couplers as described in U.S. Pat. Nos. 4,283,472, 4,338,393 and 4,310,618; DIR redox compounds, DIR couplers, or DIR coupler releasing couplers as described in JP-A-60-185950 and JP-A-62-24252; couplers capable of releasing a dye which returns to its original color after release as described in European Patent 173,302A; couplers capable of releasing a bleach accelerator as described in *Research Disclosure,* No. 11449, *Research Disclosure,* No. 24241, and JP-A-61-201247; couplers capable of releasing a ligand as described in U.S. Pat. No. 4,553,477; couplers capable of releasing a leuco dye as described in JP-A-63-75747; and couplers capable of releasing a fluorescent dye as described in U.S. Pat. No. 4,774,181.

The incorporation of these couplers in the light-sensitive material can be accomplished by any suitable dispersion method.

Examples of high boiling point solvents to be used in the oil-in-water dispersion process-are described in U.S. Pat. No. 2,322,027.

Specific examples of high boiling point organic solvents having a boiling point of 175° C. or higher at normal pressure which can be used in the oil-in-water dispersion process include phthalic acid esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate); phosphate or phosphonate esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate); benzoic acid esters (e.g., 2-ethylhexyl benzoate, dodecyl benzoate, 2-ethylhexyl-p-hydroxy benzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic acid esters (e.g., bis(2-ethylhexyl)sebacate, dioctyl azelate, glycerol tributylate, isostearyl lactate, trioctyl citrate); aniline derivatives (e.g., N,N-dibutyl-2-butoxy-5-tert-octylaniline); and hydrocarbons (e.g., paraffins, dodecylbenzene, diisopropylnaphthalene). As an auxiliary solvent an organic solvent having a boiling point of about 30° C. or higher, preferably 50° C. to about 160° C. can be used. Typical examples of such an organic solvent include ethyl acetate, butyl acetate, ethyl propionate, methyl ethyl ketone, cyclohexanone, 2-ethoxyethyl acetate, and dimethylformamide.

The process and effects of a method of latex dispersion and specific examples of latexes to be used in dipping are described in U.S. Pat. No. 4,199,363, and West German Patent Application (OLS) Nos. 2,541,274 and 2,541,230.

Various preservatives or antifungal agents such as 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole as described in JP-A-63-257747, JP-A-62-272248, and JP-A-1-80941 are preferably incorporated in the color photographic light-sensitive material of the present invention.

The present invention is applicable to various types of color photographic light-sensitive materials, most particularly preferably to color negative films for common use or motion pictures, color reversal films for slides or television, color papers, color positive films, and color reversal papers.

Suitable supports which can be used in the present invention are described in *Research Disclosure,* No. 17643 (page 28); and *Research Disclosure,* No. 18716 (right column on page 647 to left column on page 648).

In the light-sensitive material of the present invention, the total thickness of all hydrophilic colloidal layers on the emulsion side is preferably in the range of 28 μm or less, more preferably 23 μm or less, most preferably 20 μm or less. The film swelling rate ($T_{\frac{1}{2}}$) is preferably in the range of 30 seconds or less, more preferably 20 seconds or less. In the present invention, the film thickness is determined after the film has been stored at 25° C. and a relative humidity of 55% over 2 days. The film swelling rate ($T_{\frac{1}{2}}$) can be determined by a method known in the art, e.g., by means of a swellometer of the type as described in A. Green, et al., *Photographic Science & Engineering,* Vol. 19, No. 2, pages 124–129. $T_{\frac{1}{2}}$ is defined as the time necessary for one half of the film thickness to be saturated, where a film is considered saturated when its thickness is 90% of the maximum swollen film thickness reached when it is processed with a color developer at a temperature of 30° C. over 195 seconds.

The film swelling rate ($T_{\frac{1}{2}}$) can be adjusted by adding a film hardener to a binder gelatin or altering the aging condition after coating.

The percentage swelling of the light-sensitive material is preferably in the range of 150% to 400%. The percentage swelling can be calculated from the maximum swollen film thickness determined as described above in accordance with the equation: (maximum swollen film thickness—film thickness)/film thickness.

The color photographic light-sensitive material of the present invention can be developed in accordance with known methods such as those described in *Research Disclosure,* No. 17643 (pages 28–29) and *Research Disclosure,* No. 18716 (left column to right column on page 615).

The color developer used to develop the material of the present invention is preferably an alkaline aqueous solution containing as a main component an aromatic primary amine color developing agent. Such a color developing agent that can be effectively used is an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates of these compounds. Particularly preferred among these is 3-methyl-4-amino-N-ethyl-N-β-hydroxyethylaniline sulfate. These compounds can be used in a combination of two or more depending on the purpose of the application.

The color developer used normally contains a pH buffer (such as a carbonate, a borate, or a phosphate of alkali metal); or a development inhibitor or fog inhibitor (such as chlorides, bromides, iodides, benzimidazoles, benzothiazoles, and mercapto compounds). If desired, the color developer used may also contain various preservatives (such as hydroxylamine, diethylhydroxylamine, sulfites, hydrazines like N,N-biscarboxymethyl hydrazine, phenylsemicarbazides, triethanolamine, and catecholsulfonic acids); organic solvents (such as ethylene glycol and diethylene glycol); development accelerators (such as benzyl alcohol, polyethylene glycol, quaternary ammonium salts, and amines); color forming couplers; competing couplers; auxiliary developing agents (such as 1-phenyl-3-pyrazolidone); viscosity imparting agents; various chelating agents (such as aminopolycarboxylic acids, aminopolyphosphonic acids, alkylphosphonic acids, and phosphonocarboxylic acids). Examples of useful phosphonocarboxylic acids are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N,-tetramethylenephosphonic acid, and ethylenediaminedi(o-hydroxyphenylacetic acid) and salts of these acids.

Reversal processing is usually carried out by black-and-white development followed by color development. Black-and-white developers that can be used contain one or more of known black-and-white developing agents, such as dihydroxybenzenes (e.g., hydroquinone, 3-pyrazolidones and 1-phenyl-3-pyrazolidone) and aminophenols (e.g., N-methyl-p-aminophenol).

The color developer or black-and-white developer usually has a pH of from 9 to 12. The replenishment rate of the developer is usually 3 liters or less per square meter of the light-sensitive material, depending on the type of the color photographic material to be processed. The replenishment rate may be reduced to 500 ml/m$^2$ or less by decreasing the bromide ion concentration in the replenisher. When the replenishment rate is reduced, it is preferable to reduce the area of the liquid surface in contact with air in the processing tank to prevent evaporation and air oxidation of the liquid.

The area of the liquid surface in-contact with air can be represented by the opening value defined as follows:

$$\text{Opening Value} = \frac{\text{Area of Liquid Surface in Contact With Air (cm}^3\text{)}}{\text{Volume of LIquid (cm}^3\text{)}}$$

The opening value is preferably in the range of 0.1 or less, more preferably 0.001 to 0.05. The reduction of the opening value can be accomplished by providing a cover such as floating cover on the surface of the photographic processing solution in the processing tank; by a process which comprises the use of a mobile cover (as described in JP-A-1-82033); or a slit development process (as described in JP-A-63-216050). The reduction of the opening value can be applied to both the color development and black-and-white development as well as to the subsequent steps such as bleach, blix, fixing, rinse, and stabilization. The replenishment rate can also be reduced by using a means to suppress accumulation of the bromide ion in the developing solution.

The color development time normally selected is between 2 and 5 minutes. The color development time can be further reduced by carrying out color development at an elevated temperature and a high pH with color developing solution containing a high concentration of color developing agent.

The photographic emulsion layer that has been color developed is normally subjected to bleaching. Bleaching may be done at the same time as the emulsion layer is fixed (i.e., blix), or these two steps may be carried out separately. To speed up processing, bleaching may be followed by blix. Further, any embodiment where two blix baths are connected in series; blix is preceded by fixation; or blix is followed by bleaching may also be used to speed up processing. Bleaching agents that can be used are compounds of polyvalent metals (e.g., iron(III), peroxides, quinones, and nitro compounds). Typical examples of these bleaching agents are organic complex salts of iron(III) with aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid); citric acid; tartaric acid; or malic acid. Of these, aminopolycarboxylic acid-iron(III) complex salts such as (ethylenediaminetetraacetato)iron(III) complex salts and (1,3-diaminopropanetetraacetato)iron(III) complex salts are preferred in order to speed up processing and conserve the environment. In particular, aminopolycarboxylic acid-iron(III) complex salts are useful in both bleaching and blix solutions. Bleaching or blix solution containing an aminopolycarboxylic acid-iron(III) complex salt normally has a pH value of 4.0 to 8.0. For speeding up processing, it is possible to use solutions having a lower pH.

The bleaching bath, blix bath, or a prebath of either can contain, if desired, a bleaching accelerator. Examples of useful bleaching accelerators include compounds containing a mercapto group or a disulfide group (as described in U.S. Pat. No. 3,893,858, West German Patent 1,290,812, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and *Research Disclosure,* No. 17129 (June, 1978)); thiazolidine derivatives (as described in JP-A-50-140129); thiourea derivatives (as described in U.S. Pat. No. 3,706,561); iodides (as described in West German Patent 1,127,715 and JP-A-58-16235); polyoxyethylene compounds (as described in West German Patents 2,966,410 and 2,748,430); polyamine compounds (as described in JP-B-45-8836); and compounds described in JP-A-49-42434, JP-A-49-59644, JP-A-53-94927, JP-A-54-35727, JP-A-55-26506 and JP-A-58-163940; and bromide ions. Preferred among these compounds are compounds that contain a mercapto group or a disulfide group because they have great accelerating effects. In particular, the compounds disclosed in U.S. Pat. No. 3,893,858, West German Patent 1,290,812, JP-A-53-95630 and U.S. Pat. No. 4,552,834 are preferred. These bleach accelerators may be incorporated into the light-sensitive material. These bleaching accelerators are particularly effective for blix of color photographic light-sensitive materials.

The beaching or blix solution used in the present invention preferably also contains an organic acid in addition to the above mentioned compounds in order to inhibit bleach stain. Particularly preferred organic acids are ones having pKa of 2 to 5. Specific examples of such an organic acid are acetic acid and propionic acid.

Fixing agents that can be used are the thiosulfates, thiocyanates, thioethers, thioureas, and a number of iodides. The thiosulfates are normally used; ammonium thiosulfate has the most broad applicability. The thiosulfates are preferably used in combination with thiocyanates, thioether compounds, and thiourea. As a preservative of the fixing or blix bath it is preferable to use sulfites, bisulfites, carbonyl bisulfite adducts, or sulfinic acid compounds as described in European Patent 294,769A. Further, various aminopoly-carboxylic acids or organic phosphonic acids can be added to the fixing bath or blix bath for the purpose of stabilizing the solution. The total desilvering time is preferably short so long as no misdesilvering takes place. The total desilvering time is preferably in the range of 1 to 3 minutes, more preferably 1 to 2 minutes. The desilvering temperature is in the range of 25° to 50° C., preferably 35° to 45° C. In this preferred temperature range, the desilvering rate can be improved, and the occurrence of stain after processing can be effectively inhibited.

In the desilvering step, agitation is preferably intensified as much as possible. In particular, the agitation can be intensified by jetting the processing solution to the surface of the emulsion layer in the light-sensitive material (as described in JP-A-62-183460 and JP-A-62-183461); by using a rotary means (as described in JP-A-62-183461); by moving the light-sensitive material with the emulsion surface in contact with a wiper blade provided in the bath so that a turbulence occurs on the emulsion surface; by increasing the total circulated amount of processing solution (this method can be effectively applied to the bleaching bath, blix bath, or fixing bath). The improved agitation increases the supplying rate of a bleaching agent, fixing agent or the like into the emulsion film, which improves the desilvering rate.

The agitation improving method is more effective when a bleach accelerator is used. Agitation improving not only enhances the bleach accelerating effect but also eliminates the inhibition of fixation by the bleach accelerator.

An automatic developing machine to be used in the present invention is preferably equipped with a light-sensitive material conveying means as described in JP-A-60-191257, JP-A-60-191258 and JP-A-60-191259. In JP-A-60-191257, such a conveying means will remarkably reduce the amount of the processing solution carried over from a bath to its succeeding bath; which greatly inhibits the deterioration of properties of the processing solution. This reduces the processing time at each step as well as the replenishment rate of the processing solution.

It is usual that desilvered silver halide color photographic materials of the present invention are subjected to washing and/or stabilization. The quantity of water used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counterflow system or direct flow system), and various other factors. Of these, the relationship between the number of washing tanks and the quantity of water in a multistage counterflow system can be obtained according to the method described in *Journal of the Society of Motion Picture and Television Engineers,* Vol. 64, pages 248 to 253 (May, 1955).

According to the multistage counterflow system described in the above reference, although the requisite amount of water can be greatly reduced, bacteria still grow due to an increase of the retention time of the water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabendazoles (as disclosed in JP-A-57-8542), chlorine type bactericides (e.g., chlorinated sodium isocyanurate, benzotriazole), and bactericides (as described in Hiroshi Horiguchi, *Bokin Bobaizai no Kagaku* (*Chemistry of Bactericidal and Fungicidal Agents*), Sankyo Shuppan (1986); Association of Sanitary Technique (ed.), *Biseibutsu no Mekkin, Sakkin, Bobaigijutsu* (*Bactericidal and Fungicidal Techniques to Microorganisms*), published by Association of Engineering Technology (1982); and Nippon Bactericidal and Fungicidal Association (ed.), *Bokin Bobaizai Jiten* (*Encyclopedia of Bactericidal and Fungicidal Agents*) (1986).

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10.minutes in time, preferably from 25° to 40° C. in temperature and from 30 seconds to 5 minutes in time. The light-sensitive material of the present invention may be directly processed with a stabilizer in place of the washing step. For the stabilization, any of the known techniques described in JP-A-57-8543, JP-A-58-14834, and JP-A-60-220345 can be used.

If used, the washing step may be followed by stabilization. For example, a stabilizing bath containing a dye stabilizer and a surface active agent can be used as a final bath for color light-sensitive photographic materials. Examples of such a dye stabilizer include aldehydes (such as formalin and glutaraldehyde), N-methylol compounds, hexamethylenetetramine, and aldehyde-sulfurous acid adducts.

The stabilizing bath may also contain various chelating agents or bactericides.

The overflow accompanying replenishment of the washing bath and/or stabilizing bath can be reused in other steps such as desilvering.

In processing using an automatic developing machine, if the processing solutions become concentrated due to evaporation, water is preferably supplied to the system to maintain the proper concentration.

Silver halide color light-sensitive material of the present invention may contain a color developing agent for the purpose of simplifying and expediting processing. Such a color developing agent is preferably used in the form of a precursor. Examples of such precursors include indoaniline compounds (as disclosed in U.S. Pat. No. 3,342,597); Shiff's base type compounds (as disclosed in U.S. Pat. No. 3,342,599, and *Research Disclosure,* Nos. 14850 and 15159); aldol compounds (as disclosed in *Research Disclosure,* No. 13924); metal complexes (as disclosed in U.S. Pat. No. 3,719,492); and urethane compounds (as disclosed in JP-A-53-135628).

The silver halide color light-sensitive material of the present invention may optionally comprise various 1-phenyl-3-pyrazolidones for the purpose of accelerating color development. Typical examples of such compounds are disclosed in JP-A-56-64339, JP-A-57-144547, and JP-A-58-115438.

In the present invention the various processing solutions are used at a temperature of from 10° C. to 50° C. The standard temperature range is normally from 33° C. to 38° C. However, a higher temperature range can be used to accelerate processing, thus reducing the processing time. On the contrary, a lower temperature range can be used to improve the picture quality or the stability of the processing solutions. In order to save silver, processing using cobalt intensification or hydrogen peroxide intensification as disclosed in West German Patent 2,226,770 and U.S. Pat. No. 3,674,499 can be used.

The present silver halide photographic material can also be applied to a heat developable light-sensitive material as disclosed in U.S. Pat. No. 4,500,626, JP-A-60-133449, JP-A-59-218443, JP-A-61-238056, and European Patent 210,660A2.

The present invention will be described further with reference to the following nonlimiting examples. Unless otherwise indicated, all ratios and percentages are by weight.

EXAMPLE 1

Preparation of Sample 101

A multilayer color light-sensitive material was prepared as Sample 101 by coating on a 127 μm thick undercoated cellulose triacetate film support the various layers having the following compositions. The figures indicate the amount of each component added per $m^2$ of light-sensitive material. The effects of the compounds are not limited to the usage described herein.

| First Layer: Antihalation Layer | |
|---|---|
| Black Colloidal Silver | 0.25 g |
| Gelatin | 1.9 g |
| Ultraviolet Absorbent U-1 | 0.04 g |
| Ultraviolet Absorbent U-2 | 0.1 g |
| Ultraviolet Absorbent U-3 | 0.1 g |
| Ultraviolet Absorbent U-6 | 0.1 g |
| High Boiling Point Organic Solvent Oil-1 | 0.1 g |

Second Layer: Low Sensitivity Red-Sensitive Emulsion Layer

Silver Bromoiodide Emulsion Spectrally Sensitized with Sensitizing Dyes 8 and 15 (1/1 mixture of a monodisperse emulsion of cubic silver bromoiodide grains having a mean grain diameter of 0.4 μm and an AgI content of 4.5 mol % and a monodisperse emulsion of cubic silver bromoiodide grains having a mean grain diameter of 0.3 μm and an AgI content of 4.5 mol %)

| | |
|---|---|
| Coated weight as silver | 0.4 g |
| Gelatin | 0.8 g |
| Coupler C-1 | 0.20 g |
| Coupler C-9 | 0.05 g |
| Compound Cpd-D | 10 mg |
| High Boiling Point Organic Solvent Oil-2 | 0.10 g |

Third Layer: Middle Sensitivity Red-Sensitive Emulsion Layer

Silver Bromoiodide Emulsion Spectrally Sensitized with Sensitizing Dyes 8 and 15 (monodisperse emulsion of cubic silver bromoiodide grains having a mean grain diameter of 0.5 μm and an AgI content of 4 mol %)

| | |
|---|---|
| Coated weight as silver | 0.4 g |
| Gelatin | 0.8 g |
| Coupler C-1 | 0.2 g |
| Coupler C-2 | 0.05 g |
| Coupler C-3 | 0.2 g |
| High Boiling Point Organic Solvent Oil-2 | 0.1 g |

Fourth Layer: High Sensitivity Red-Sensitive Emulsion Layer

Silver Bromoiodide Emulsion Spectrally Sensitized with Sensitizing Dyes 8 and 15 (monodisperse emulsion of twin silver bromoiodide grains having a mean grain diameter of 0.7 μm and an AgI content of 2 mol %)

| | |
|---|---|
| Coated weight as silver | 0.4 g |
| Gelatin | 1.1 g |
| Coupler C-3 | 0.7 g |
| Coupler C-1 | 0.3 g |
| Fifth Layer: Interlayer | |
| Gelatin | 0.6 g |
| Dye D-1 | 0.02 g |
| Sixth Layer: Interlayer | |
| Fogged Silver Bromoiodide Emulsion (mean grain diameter: 0.06 μm, AgI content: 0.3 mol %) | 0.02 g |
| Gelatin | 1.0 g |
| Color Stain Inhibitor Cpd-A | 0.2 g |

Seventh Layer: Low Sensitivity Green-Sensitive Emulsion Layer

Silver Bromoiodide Emulsion Spectrally Sensitized with Sensitizing Dyes 6 and 26 (1/1 mixture of a monodisperse emulsion of cubic silver bromoiodide grains having a mean grain diameter of 0.4 μm and an AgI content of 4.5 mol % and a monodisperse emulsion of cubic silver bromoiodide grains having a mean grain diameter of 0.2 μm and an AgI content of 4.5 mol %)

| | |
|---|---|
| Coated weight as silver | 0.5 g |
| Gelatin | 0.5 g |
| Coupler C-4 | 0.20 g |
| Coupler C-7 | 0.10 g |
| Coupler C-8 | 0.10 g |
| Compound Cpd-B | 0.03 g |
| Compound Cpd-D | 10 mg |
| Compound Cpd-E | 0.1 g |
| Compound Cpd-F | 0.1 g |
| Compound Cpd-G | 0.1 g |
| Compound Cpd-H | 0.1 g |
| High Boiling Point Organic Solvent Oil-1 | 0.1 g |
| High Boiling Point Organic Solvent Oil-2 | 0.1 g |

Eighth Layer: Middle Sensitivity Green-Sensitive Emulsion Layer

Silver Bromoiodide Emulsion Spectrally Sensitized with Sensitizing Dyes 6 and 26 (monodisperse emulsion of cubic silver bromoiodide grains having a mean grain diameter of 0.5 μm and an AgI content of 3 mol %)

| | |
|---|---|
| Coated weight as silver | 0.4 g |
| Gelatin | 0.6 g |
| Coupler C-4 | 0.1 g |
| Coupler C-7 | 0.1 g |
| Coupler C-8 | 0.1 g |
| Compound Cpd-B | 0.03 g |
| Compound Cpd-E | 0.1 g |
| Compound Cpd-F | 0.1 g |
| Compound Cpd-G | 0.05 g |
| Compound Cpd-H | 0.05 g |
| High Boiling Point Organic Solvent Oil-2 | 0.01 g |

Ninth Layer: High Sensitivity Green-Sensitive Emulsion Layer

Silver Bromoiodide Emulsion Spectrally Sensitized with Sensitizing Dyes 6 and 26 (monodisperse emulsion of tabular silver bromoiodide grains having a mean grain diameter of 0.6 μm as calculated in terms of sphere, an AgI content of 1.3 mol % and an average diameter/thickness ratio of 7)

| | |
|---|---|
| Coated weight as silver | 0.5 g |
| Gelatin | 1.0 g |
| Coupler C-4 | 0.4 g |
| Coupler C-7 | 0.2 g |
| Coupler C-8 | 0.2 g |
| Compound Cpd-B | 0.08 g |
| Compound Cpd-E | 0.10 g |
| Compound Cpd-F | 0.10 g |
| Compound Cpd-G | 0.10 g |
| Compound Cpd-H | 0.10 g |
| High Boiling Point Organic Solvent Oil-1 | 0.02 g |
| High Boiling Point Organic Solvent Oil-2 | 0.02 g |
| Tenth Layer: Interlayer | |
| Gelatin | 0.6 g |
| Dye D-2 | 0.05 g |
| Eleventh Layer: Yellow Filter Layer | |
| Yellow Colloidal Silver | 0.1 g |
| Coated weight as silver | |
| Gelatin | 1.1 g |
| Color Stain Inhibitor Cpd-A | 0.01 g |
| High Boiling Point Organic Solvent Oil-1 | 0.01 g |

Twelfth Layer: Low Sensitivity Blue-Sensitive Emulsion Layer

Silver Bromoiodide Emulsion Spectrally Sensitized with Sensitizing Dyes 27 and 28 (1/1 mixture of a monodisperse emulsion of cubic silver bromoiodide grains having a mean grain diameter of 0.4 μm and an AgI content of 3 mol % and a monodisperse emulsion of cubic silver bromoiodide grains having a mean grain diameter of 0.2 μm and an AgI content of 3 mol %)

| | |
|---|---|
| Coated weight as silver | 0.6 g |
| Gelatin | 0.8 g |
| Coupler C-5 | 0.6 g |
| High Boiling Point Organic Solvent Oil-2 | 0.02 g |

Thirteenth Layer: Middle Sensitivity Blue-Sensitive Emulsion Layer

Silver Bromoiodide Emulsion Spectrally Sensitized with Sensitizing Dyes 27 and 28 (monodisperse emulsion of cubic silver bromoiodide grains having a mean grain diameter of 0.5 μm and an AgI content of 2 mol %)

| | |
|---|---|
| Coated weight as silver | 0.4 g |
| Gelatin | 0.9 g |
| Coupler C-5 | 0.3 g |
| Coupler C-6 | 0.3 g |
| High Boiling Point Organic Solvent Oil-2 | 0.02 g |

Fourteenth Layer: High Sensitivity Blue-Sensitive Emulsion Layer

Silver Bromoiodide Emulsion Spectrally Sensitized with Sensitizing Dyes 27 and 28 (monodisperse emulsion of tabular silver bromoiodide grains having a mean grain diameter of 0.7 μm as calculated in terms of sphere, an AgI content of 1.5 mol % and an average diameter/thickness ratio of 7)

| | |
|---|---|
| Coated weight as silver | 0.4 g |
| Gelatin | 1.2 g |
| Coupler C-6 | 0.7 g |
| Fifteenth Layer: First Protective Layer | |
| Gelatin | 0.7 g |
| Ultraviolet Absorbent U-1 | 0.04 g |
| Ultraviolet Absorbent U-3 | 0.03 g |
| Ultraviolet Absorbent U-4 | 0.03 g |
| Ultraviolet Absorbent U-5 | 0.05 g |
| Ultraviolet Absorbent U-6 | 0.05 g |
| High Boiling Point Organic Solvent Oil-1 | 0.02 g |
| Formalin Scavenger Cpd-C | 0.8 g |
| Dye D-3 | 0.05 g |

Sixteenth Layer: Second Protective Layer

Fogged Emulsion of Finely Divided Silver Bromoiodide Grains (mean grain diameter: 0.06 μm, AgI content: 1 mol %)

| | |
|---|---|
| Coated weight as silver | 0.1 g |
| Gelatin | 0.4 g |
| Seventeenth Layer: Third Protective Layer | |
| Gelatin | 0.4 g |
| Polymethyl Methacrylate (mean grain diameter: 1.5 μm) | 0.1 g |
| 4/6 (by weight) Copolymer of Methyl Methacrylate and Acrylic Acid (mean grain diameter: 1.5 μm) | 0.1 g |
| Silicone Oil | 0.03 g |
| Surface Active Agent W-1 | 3.0 mg |

To each layer were added Gelatin Hardener H-1 and surface active agents for coating and emulsification.

In the present invention, a monodisperse emulsion has a grain diameter fluctuation coefficient of 20% or less.

C-1

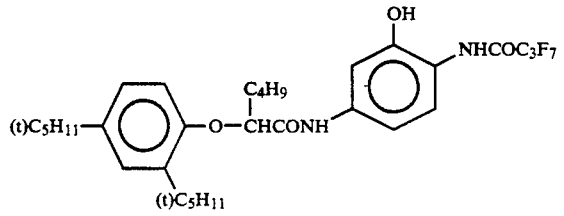

C-2

-continued
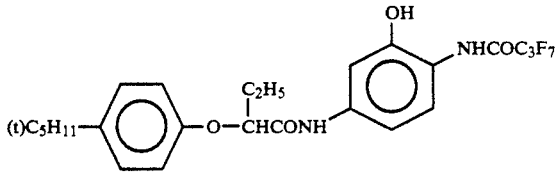
C-3
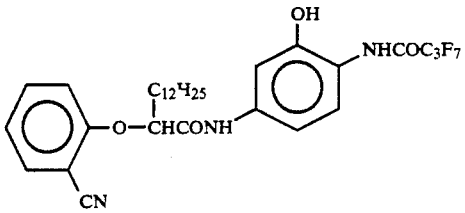
C-4
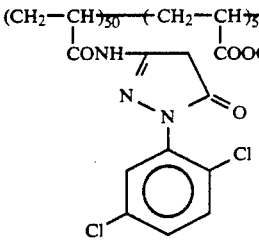
(Figures indicate mol; mean molecular weight: approx. 25,000)
C-5
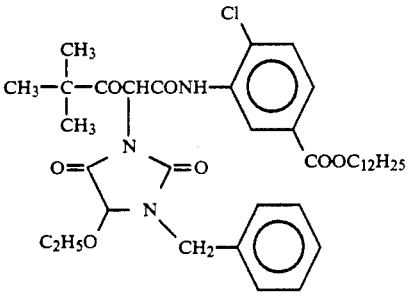
C-6
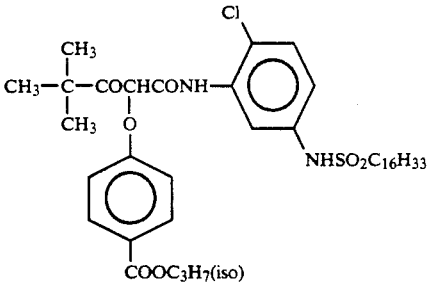
C-7
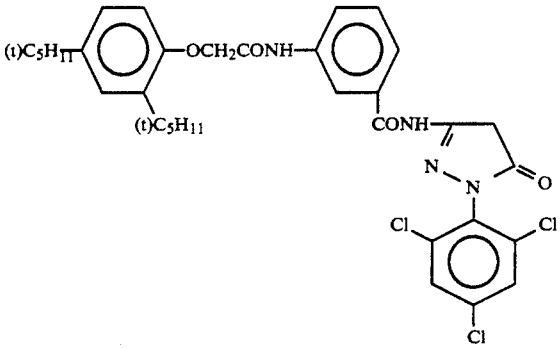
-continued
C-8
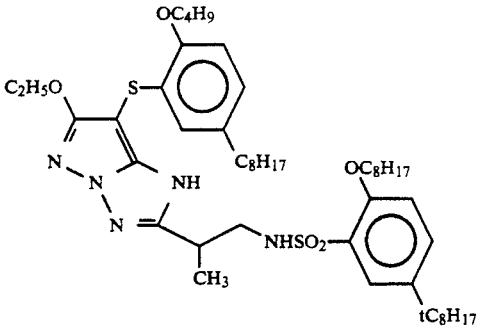
C-9
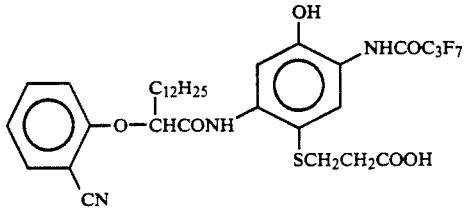
Oil-1 Dibutyl phthalate
Oil-2 Tricresyl phosphate
Oil-3
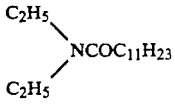
Cpd-A
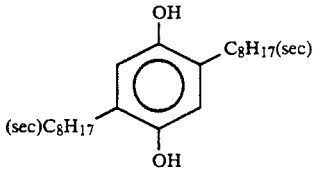
Cpd-B
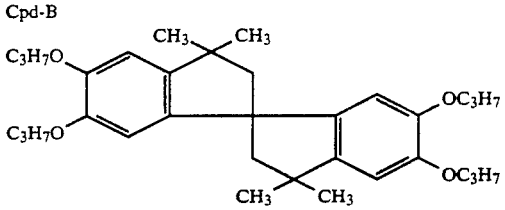
Cpd-C
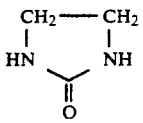
Cpd-D
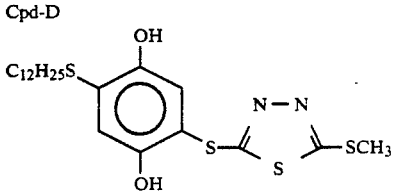
Cpd-E -continued
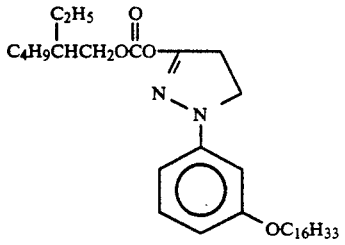
Cpd-F
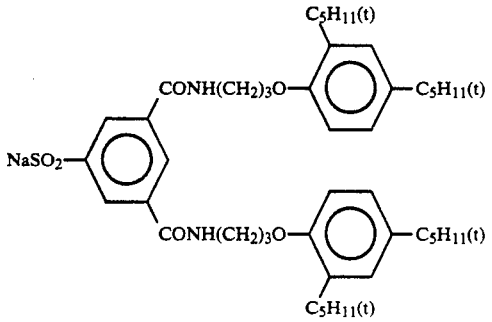
Cpd-G
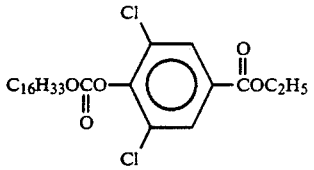
Cpd-H
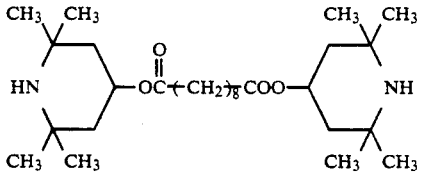
U-1
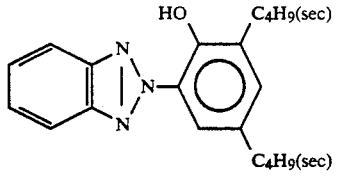
U-2
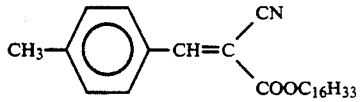
U-3
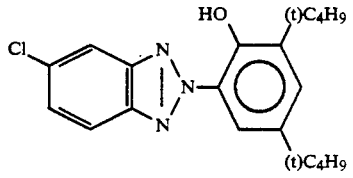
U-4
-continued
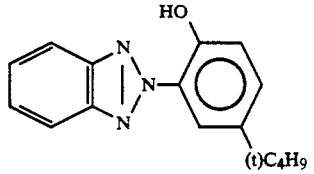
U-5
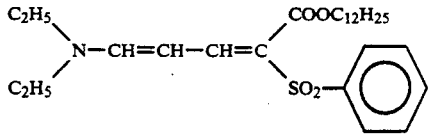
U-6
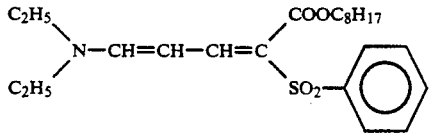
S-1 (Same as Dye 8)
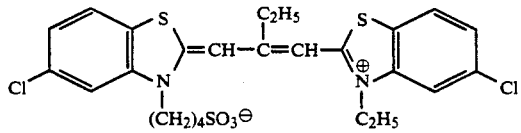
S-2 (Same as Dye 15)
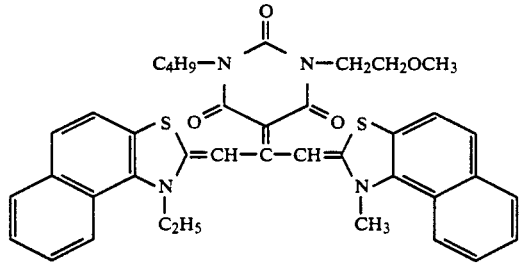
S-3 (Same as Dye 6)
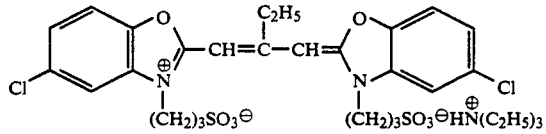
S-4 (Same as Dye 26)
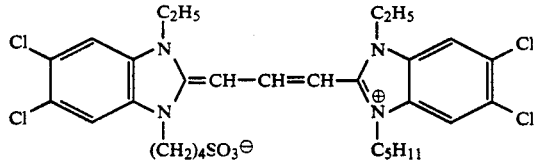
S-5 (Same as Dye 27)
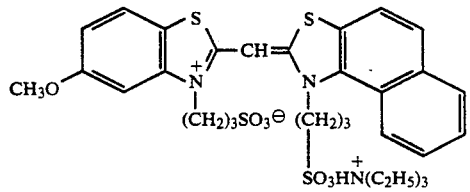
S-6 (Same as Dye 28)

-continued

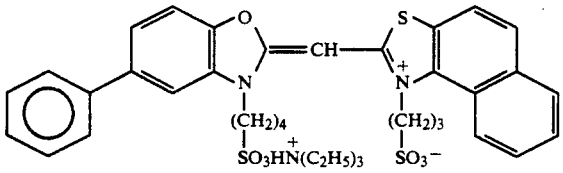

D-1

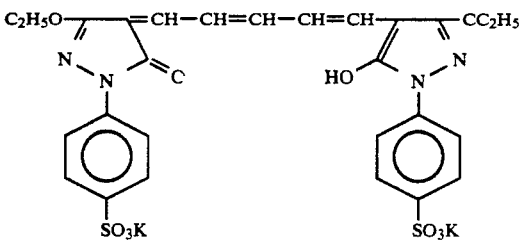

D-2

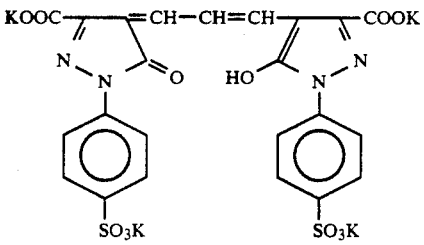

D-3

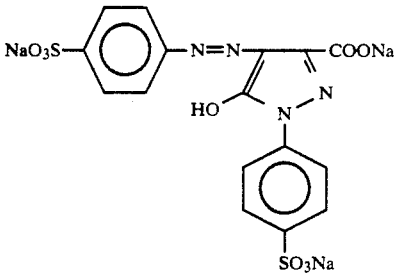

H-1

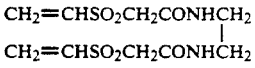

W-1

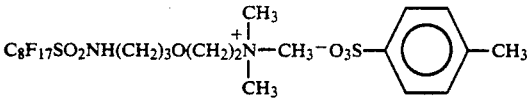

Preparation of Samples 102 to 114

Samples 102 to 114 were prepared in the same manner as in Sample 101 except that the black colloidal silver to be incorporated in the first layer or the yellow colloidal silver to be incorporated in the eleventh layer were replaced by dye dispersions set forth in Table 1 prepared as described below.

Preparation of Dispersion of Finely Divided Dye Powder

The dye was subjected to dispersion in a vibration mill in the following manner:

21.7 ml of water, 3 ml of a 5% aqueous solution of sodium p-octylphenoxyethoxyethanesulfonate, and 0.5 g of a 5% aqueous solution of p-octylphenoxypolyoxyethylene ether (polymerization degree: 10) were charged into a 700 ml pot mill. 1.00 g of the selected dye and 500 ml of zirconium oxide beads (diameter: 1 mm) were then added to the system. The content was subjected to dispersion over 2 hours. The vibration mill used was a Type BO vibration mill available from Chuo Kakoki K. K.

The content was withdrawn and then added to 8 g of a 12.5% aqueous solution of gelatin. The material was then filtered to remove the beads to obtain the gelatin dispersion of dye.

When two or more kinds of dyes were used in combination, the mixing ratio of these dyes was equimolar to each other.

Preparation of Samples 115 to 127 and 132

Samples 115 to 127 and 132 were prepared in the same manner as in Samples 115, 102, 108 and 114 except that the silver density was altered as shown in Table 1 by altering the amount of gelatin to be incorporated in each light-sensitive emulsion layer.

Preparation of Samples 128 to 131

Samples 128 to 131 were prepared in the same manner as Samples 101, 102, and 108 except that an interlayer comprising 0.5 g/m$^2$ of gelatin was provided between the first layer and the second layer (Samples 128 and 131) or between the eleventh layer and the twelfth layer (Samples 129 and 130).

These samples were then exposed to light nd processed as outlined below.

| | Processing Step | | | |
|---|---|---|---|---|
| Step | Time (min) | Temperature (°C.) | Tank Volume (liter) | Replenishment Rate (liter/m$^2$) |
| Black-and-White Development | 6 | 38 | 12 | 2.2 |
| First Washing | 2 | 38 | 4 | 7.5 |
| Reversal | 2 | 38 | 4 | 1.1 |
| Color Development | 6 | 38 | 12 | 2.2 |
| Adjustment | 2 | 38 | 4 | 1.1 |
| Bleaching | 6 | 38 | 12 | 0.22 |
| Fixation | 4 | 38 | 8 | 1.1 |
| Second Washing | 4 | 38 | 8 | 7.5 |
| Stabilization | 1 | 25 | 2 | 1.1 |

The various processing solutions used had the following compositions:

| Black-and-White Developing Solution | | |
|---|---|---|
| | Running Solution | Replenisher |
| Pentasodium Nitrilo-N,N,N-trimethylenephosphonate | 2.0 g | 2.0 g |
| Sodium Sulfite | 30 g | 30 g |
| Hydroquinone Potassium Monosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | 1.4 g |
| Potassium Thiocyanate | 1.2 g | 1.2 g |
| Potassium Iodide | 2.0 mg | — |
| Water to make | 1,000 ml | 1,000 ml |
| pH | 9.60 | 9.60 |

The pH value was adjusted with hydrochloric acid or

-continued

| Black-and-White Developing Solution | Running Solution | Replenisher |
|---|---|---|
| potassium hydroxide. | | |

| Reversing Solution | Running Solution | Replenisher |
|---|---|---|
| Pentasodium Nitrilo-N,N,N-trimethylenephosphonate | 3.0 g | 3.0 g |
| Stannous Chloride Dihydrate | 1.0 g | 1.0 g |
| p-Aminophenol | 0.1 g | 0.1 g |
| Sodium Hydroxide | 8 g | 8 g |
| Glacial Acetic Acid | 15 ml | 15 ml |
| Water to make | 1,000 ml | 1,000 ml |
| pH | 6.00 | 6.00 |
| The pH value was adjusted with hydrochloric acid or sodium hydroxide. | | |

| Color Developer | Running Solution | Replenisher |
|---|---|---|
| Pentasodium Nitrilo-N,N,N-trimethylenephosphonate | 2.0 g | 2.0 g |
| Sodium Sulfite | 7.0 g | 7.0 g |
| Trisodium Phosphate Dodecahydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-Ethyl-(β-methanesulfonamido-ethyl)-3-methyl-4-aminoaniline Sulfate | 11 g | 11 g |
| 3,6-Dithia-1,8-octanediol | 1.0 g | 1.0 g |
| Water to make | 1,000 ml | 1,000 ml |
| pH | 11.80 | 12.00 |
| The pH value was adjusted with hydrochloric acid or potassium hydroxide. | | |

| Adjusting Solution | Running Solution | Replenisher |
|---|---|---|
| Disodium Ethylenediaminetetra-acetate Dihydrate | 8.0 g | 8.0 g |
| Sodium Sulfite | 12 g | 12 g |
| 1-Thioglycerin | 0.4 ml | 0.4 ml |
| Sorbitan Ester* | 0.1 g | 0.1 g |
| Water to make | 1,000 ml | 1,000 ml |
| pH | 6.20 | 6.20 |
| The pH value was adjusted with hydrochloric acid or sodium hydroxide. | | |

| Bleaching Solution | Running Solution | Replenisher |
|---|---|---|
| Disodium Ethylenediaminetetra-acetate Dihydrate | 2.0 g | 4.0 g |
| Ferric Ammonium Ethylene-diaminetetraacetate Dihydrate | 120 g | 240 g |
| Potassium Bromide | 100 g | 200 g |
| Ammonium Nitrate | 10 g | 20 g |
| Water to make | 1,000 ml | 1,000 ml |
| pH | 5.70 | 5.50 |
| The pH value was adjusted with hydrochloric acid or sodium hydroxide. | | |

| Fixing Solution | Running Solution | Replenisher |
|---|---|---|
| Ammonium Thiosulfate | 8.0 g | 8.0 g |
| Sodium Sulfite | 5.0 g | 5.0 g |
| Sodium Bisulfite | 5.0 g | 5.0 g |
| Water to make | 1,000 ml | 1,000 ml |
| pH | 6.60 | 6.60 |
| The pH was adjusted with hydrochloric acid or aqueous ammonia. | | |

| Stabilizing Solution | Running Solution | Replenisher |
|---|---|---|
| 37% Formalin | 5.0 ml | 5.0 ml |
| Polyoxyethylene-p-monononyl-phenylether (mean polymerization degree: 10) | 0.5 ml | 0.5 ml |
| Water to make | 1,000 ml | 1,000 ml |
| pH | Not adjusted | No adjusted |

Sorbitan Ester*

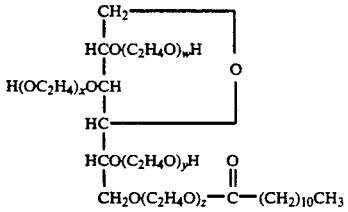

(w + x + y + z = 20)

The samples thus obtained were then examined for sharpness (MTF) and $D_{max}$ change ($\Delta D_{max}$) after being stored at a temperature of 40° C. and a relative humidity of 55% over 7 days. The results are set forth in Table 1.

For the evaluation of improvement in sharpness, MTF (Modulation Transfer Function) of dye images were determined in terms of 10 lines/mm.

TABLE 1 (1)

| | First Layer | | Second Layer | |
|---|---|---|---|---|
| Sample No. | Antihalation Material | Coated Amount ($g/m^2$) | Yellow Filter Material | Coated Amount ($g/m^2$) |
| 101 (Comparison) | Black colloidal silver | 0.25 | Yellow colloidal silver | 0.1 |
| 102 (Invention) | Black colloidal silver | " | I-1 | 0.2 |
| 103 (Invention) | Black colloidal silver | " | II-5 | " |
| 104 (Invention) | Black colloidal silver | " | III-13 | 0.15 |
| 105 (Invention) | Black colloidal silver | " | IV-6 | 0.4 |
| 106 (Invention) | Black colloidal silver | " | V-2 | 0.3 |
| 107 (Invention) | Black colloidal silver | " | VI-13 | " |

TABLE 1 (1)-continued

| Sample No. | First Layer: Antihalation Material | First Layer: Coated Amount ($g/m^2$) | Second Layer: Yellow Filter Material | Second Layer: Coated Amount ($g/m^2$) |
|---|---|---|---|---|
| 108 (Invention) | III-34/I-4/I-1 | 0.3 | Yellow colloidal silver | 0.1 |
| 109 (Invention) | III-11/III-2/II-4 | " | Yellow colloidal silver | " |
| 110 (Invention) | III-3/III-1 | 0.35 | Yellow colloidal silver | " |
| 111 (Invention) | III-12/IV-4 | " | Yellow colloidal silver | " |
| 112 (Invention) | III-3/V-2 | " | Yellow colloidal silver | " |
| 113 (Invention) | III-3/VI-6 | 0.4 | Yellow colloidal silver | " |
| 114 (Invention) | III-34/I-4/I-1 | " | I-1 | 0.2 |
| 115 (Comparison) | Black colloidal silver | 0.25 | Yellow colloidal silver | 0.1 |
| 116 (Comparison) | Black colloidal silver | " | I-1 | 0.2 |
| 117 (Invention) | Black colloidal silver | " | " | " |
| 118 (Invention) | Black colloidal silver | " | " | " |
| 119 (Invention) | Black colloidal silver | 0.25 | I-1 | 0.2 |
| 120 (Invention) | Black colloidal silver | " | " | " |
| 121 (Invention) | Black colloidal silver | " | " | " |
| 122 (Invention) | Black colloidal silver | " | " | " |
| 123 (Comparison) | III-34/I-4/I-1 | 0.3 | Yellow colloidal silver | 0.1 |
| 124 (Invention) | " | " | Yellow colloidal silver | " |
| 125 (Invention) | " | " | Yellow colloidal silver | " |
| 126 (Invention) | " | " | Yellow colloidal silver | " |
| 127 (Invention) | " | " | Yellow colloidal silver | " |
| 128 (Comparison) | Black colloidal silver | 0.25 | Yellow colloidal silver | " |
| 129 (Comparison) | Black colloidal silver | " | Yellow colloidal silver | " |
| 130 (Invention) | Black colloidal silver | " | I-1 | 0.2 |
| 131 (Invention) | III-34/I-4/I-1 | 0.3 | Yellow colloidal silver | 0.1 |
| 132 (Comparison) | " | " | I-1 | 0.2 |

TABLE 1 (2)

| Sample No. | Silver Density ($g/cm^3$): 2nd Layer | 3rd Layer | 4th Layer | 7th Layer | 8th Layer | 9th Layer | 12th Layer |
|---|---|---|---|---|---|---|---|
| 101 (Comparison) | 0.45 | 0.39 | 0.36 | 0.76 | 0.65 | 0.55 | 0.47 |
| 102 (Invention) | " | " | " | " | " | " | " |
| 103 (Invention) | " | " | " | " | " | " | " |
| 104 (Invention) | " | " | " | " | " | " | " |
| 105 (Invention) | " | " | " | " | " | " | " |
| 106 (Invention) | " | " | " | " | " | " | " |
| 107 (Invention) | " | " | " | " | " | " | " |
| 108 (Invention) | " | " | " | " | " | " | " |
| 109 (Invention) | " | " | " | " | " | " | " |
| 110 (Invention) | " | " | " | " | " | " | " |
| 111 (Invention) | " | " | " | " | " | " | " |
| 112 (Invention) | " | " | " | " | " | " | " |
| 113 (Invention) | " | " | " | " | " | " | " |
| 114 (Invention) | " | " | " | " | " | " | " |
| 115 (Comparison) | 0.39 | " | " | 0.35 | 0.35 | 0.35 | 0.33 |
| 116 (Comparison) | " | " | " | " | " | " | " |
| 117 (Invention) | " | " | " | " | " | " | 0.47 |
| 118 (Invention) | " | " | " | " | " | " | 0.65 |
| 119 (Invention) | " | " | " | " | " | " | 0.84 |
| 120 (Invention) | " | " | " | " | " | " | 1.20 |
| 121 (Invention) | " | " | " | " | " | " | 1.83 |
| 122 (Invention) | " | " | " | " | " | " | 2.02 |
| 123 (Comparison) | 0.39 | 0.39 | 0.36 | 0.35 | 0.35 | 0.35 | 0.33 |
| 124 (Invention) | 0.45 | " | " | " | " | " | " |
| 125 (Invention) | " | 0.45 | " | " | " | " | " |
| 126 (Invention) | " | " | 0.43 | " | " | " | " |
| 127 (Invention) | 0.39 | 0.39 | " | " | " | " | " |
| 128 (Comparison) | 0.45 | " | 0.36 | 0.76 | 0.65 | 0.55 | 0.47 |
| 129 (Comparison) | " | " | " | " | " | " | " |
| 130 (Invention) | " | " | " | " | " | " | " |
| 131 (Invention) | " | " | " | " | " | " | " |
| 132 (Comparison) | 0.39 | " | " | 0.35 | 0.35 | 0.35 | 0.33 |

TABLE 1 (3)

| Sample No. | Silver Density (g/cm³) 13th Layer | 14th Layer | MTF R | MTF B | $\Delta D_{max}$ R | $\Delta D_{max}$ B |
|---|---|---|---|---|---|---|
| 101 (Comparison) | 0.24 | 0.23 | 1.13 | 1.24 | 0.07 | 0.10 |
| 102 (Invention) | " | " | 1.14 | 1.25 | 0.05 | 0.03 |
| 103 (Invention) | " | " | " | 1.26 | " | 0.02 |
| 104 (Invention) | " | " | 1.15 | " | 0.04 | " |
| 105 (Invention) | " | " | 1.16 | 1.25 | 0.05 | " |
| 106 (Invention) | " | " | 1.15 | 1.24 | 0.06 | 0.04 |
| 107 (Invention) | " | " | 1.17 | 1.23 | 0.04 | 0.03 |
| 108 (Invention) | " | " | 1.15 | 1.24 | 0.02 | 0.10 |
| 109 (Invention) | " | " | 1.16 | 1.23 | 0.03 | 0.09 |
| 110 (Invention) | " | " | 1.14 | " | 0.02 | 0.08 |
| 111 (Invention) | " | " | " | 1.24 | 0.03 | 0.09 |
| 112 (Invention) | " | " | 1.15 | 1.23 | 0.02 | 0.08 |
| 113 (Invention) | " | " | " | " | " | " |
| 114 (Invention) | " | " | " | 1.28 | 0.03 | 0.03 |
| 115 (Comparison) | " | " | 1.09 | 1.14 | 0.05 | 0.05 |
| 116 (Comparison) | " | " | 1.08 | 1.10 | 0.04 | 0.02 |
| 117 (Invention) | " | " | 1.09 | 1.14 | 0.05 | " |
| 118 (Invention) | " | " | 1.11 | 1.15 | " | 0.03 |
| 119 (Invention) | " | " | 1.13 | 1.17 | " | 0.04 |
| 120 (Invention) | " | " | " | 1.18 | 0.04 | 0.06 |
| 121 (Invention) | " | " | 1.14 | " | 0.05 | 0.09 |
| 122 (Invention) | " | " | 1.16 | 1.19 | " | 0.11 |
| 123 (Comparison) | 0.24 | 0.23 | 1.07 | 1.14 | 0.01 | 0.04 |
| 124 (Invention) | " | " | 1.11 | 1.15 | " | 0.03 |
| 125 (Invention) | " | " | 1.14 | 1.14 | 0.02 | 0.04 |
| 126 (Invention) | " | " | 1.15 | " | 0.03 | 0.03 |
| 127 (Invention) | " | " | 1.09 | " | 0.02 | 0.04 |
| 128 (Comparison) | " | " | 1.10 | 1.23 | " | 0.03 |
| 129 (Comparison) | " | " | 1.12 | 1.20 | " | " |
| 130 (Invention) | " | " | 1.15 | 1.24 | 0.03 | 0.02 |
| 131 (Invention) | " | " | 1.13 | 1.28 | 0.02 | 0.03 |
| 132 (Comparison) | " | " | 1.05 | 1.11 | " | 0.02 |

Table 1 shows that Sample 132 exhibits some improvement in preservability but has a drop in sharpness and Sample 101 exhibits some improvement in sharpness but has a drop in preservability as compared to Sample 115. Samples 102 to 107 have some improvement in sharpness without deterioration of preservability of the blue-sensitive layer. Samples 108 to 113 attain some improvement in sharpness without deterioration of preservability of the red-sensitive layer.

EXAMPLE 2

A multilayer color light-sensitive material was prepared as Sample 201 by coating on an undercoated cellulose triacetate film support various layers having the compositions described below.

Preparation of Light-Sensitive Layer

The figures indicate the amount (unit: g) of each component added per m² of light-sensitive material. The coated amount of silver halide is represented as calculated in terms of silver. The coated amount of sensitizing dye is represented in molar amount per mol of silver halide contained in the same layer.

| | |
|---|---|
| First Layer: Antihalation Layer | |
| Black Colloidal Silver | 0.18 (as Ag) |
| Gelatin | 1.40 |
| Second Layer: Interlayer | |
| 2,5-Di-t-pentadecyl Hydroquinone | 0.18 |
| EX-1 | 0.07 |
| EX-3 | 0.02 |
| EX-12 | 0.002 |
| V-1 | 0.06 |
| V-2 | 0.08 |
| V-3 | 0.10 |
| HBS-1 | 0.10 |

-continued

| | |
|---|---|
| HBS-2 | 0.02 |
| Gelatin | 1.04 |
| Third Layer: First Red-Sensitive Emulsion Layer | |
| Emulsion A | 0.25 (as Ag) |
| Emulsion B | 0.25 (as Ag) |
| Sensitizing Dye 20 | $6.9 \times 10^{-5}$ |
| Sensitizing Dye 21 | $1.8 \times 10^{-5}$ |
| Sensitizing dye 6 | $3.1 \times 10^{-4}$ |
| EX-2 | 0.335 |
| EX-10 | 0.020 |
| V-1 | 0.07 |
| V-2 | 0.05 |
| V-3 | 0.07 |
| HBS-1 | 0.060 |
| Gelatin | 0.87 |
| Fourth Layer: Second Red-Sensitive Emulsion Layer | |
| Emulsion G | 1.0 (as Ag) |
| Sensitizing Dye 20 | $5.1 \times 10^{-5}$ |
| Sensitizing Dye 21 | $1.4 \times 10^{-5}$ |
| Sensitizing Dye 6 | $2.3 \times 10^{-4}$ |
| EX-2 | 0.400 |
| EX-3 | 0.050 |
| EX-10 | 0.015 |
| V-1 | 0.07 |
| V-2 | 0.05 |
| V-3 | 0.07 |
| Gelatin | 1.30 |
| Fifth Layer: Third Red-Sensitive Emulsion Layer | |
| Emulsion D | 1.60 (as Ag) |
| Sensitizing Dye 20 | $5.4 \times 10^{-5}$ |
| Sensitizing Dye 21 | $1.4 \times 10^{-5}$ |
| Sensitizing Dye 6 | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Sixth Layer: Interlayer | |
| EX-5 | 0.040 |
| HBS-1 | 0.020 |
| Gelatin | 0.80 |
| Seventh Layer: First Green-Sensitive Emulsion Layer | |
| Emulsion A | 0.15 (as Ag) |
| Emulsion B | 0.15 (as Ag) |
| Sensitizing Dye 23 | $3.0 \times 10^{-5}$ |
| Sensitizing Dye 24 | $1.0 \times 10^{-4}$ |
| Sensitizing Dye 22 | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| Eighth Layer: Second Green-Sensitive Emulsion Layer | |
| Emulsion C | 0.45 (as Ag) |
| Sensitizing Dye 23 | $2.1 \times 10^{-5}$ |
| Sensitizing Dye 24 | $7.0 \times 10^{-5}$ |
| Sensitizing Dye 22 | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |
| Ninth Layer: Third Green-Sensitive Emulsion Layer | |
| Emulsion E | 1.2 (as Ag) |
| Sensitizing Dye 23 | $3.5 \times 10^{-5}$ |
| Sensitizing Dye 24 | $8.0 \times 10^{-5}$ |
| Sensitizing dye 22 | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Tenth Layer: Yellow Filter Layer | |
| Yellow Colloidal Silver | 0.05 (as Ag) |
| EX-5 | 0.08 |

-continued

| | |
|---|---|
| HBS-1 | 0.03 |
| Gelatin | 0.95 |
| Eleventh Layer: First Blue-Sensitive Emulsion Layer | |
| Emulsion A | 0.08 (as Ag) |
| Emulsion B | 0.07 (as Ag) |
| Emulsion F | 0.07 (as Ag) |
| Sensitizing Dye 14 | $3.5 \times 10^{-4}$ |
| EX-9 | 0.721 |
| EX-8 | 0.042 |
| HBS-1 | 0.28 |
| Gelatin | 1.10 |
| Twelfth Layer: Second Blue-Sensitive Emulsion Layer | |
| Emulsion G | 0.45 (as Ag) |
| Sensitizing Dye 14 | $2.1 \times 10^{-4}$ |
| EX-9 | 0.154 |
| EX-10 | 0.007 |
| HBS-1 | 0.05 |
| Gelatin | 0.78 |
| Thirteenth Layer: Third Blue-Sensitive Emulsion Layer | |
| Emulsion H | 0.77 (as Ag) |
| Sensitizing Dye 14 | $2.2 \times 10^{-4}$ |
| EX-9 | 0.20 |
| HBS-1 | 0.07 |
| Gelatin | 0.69 |
| Fourteenth Layer: First Protective Layer | |
| Emulsion I | 0.20 (as Ag) |
| V-4 | 0.11 |
| V-5 | 0.17 |
| HBS-1 | 0.05 |
| Gelatin | 1.00 |
| Fifteenth Layer: Second Protective Layer | |
| Polymethyl Acrylate Grains (diameter: about 1.5 μm) | 0.54 |
| S-1 | 0.20 |
| Gelatin | 1.20 |

In addition the above mentioned components, Gelatin Hardener H-1 and surface active agents were incorporated in each layer.

| | % Mean AgI Content | Mean Grain Diameter (μm) | % Grain Diameter Fluctuation | Diameter/Thickness Ratio | Silver Content Ratio (% AgI content) |
|---|---|---|---|---|---|
| Emulsion A | 4.0 | 0.45 | 27 | 1 | Core/shell = ⅓ (13/1), double structure grain |
| Emulsion B | 8.9 | 0.70 | 14 | 1 | Core/shell = 3/7 (25/2), double structure grain |
| Emulsion C | 10 | 0.75 | 30 | 2 | Core/shell = ½ (24/3), double structure grain |
| Emulsion D | 16 | 1.05 | 35 | 2 | Core/shell = 4/6 (40/0), double structure grain |
| Emulsion E | 10 | 1.05 | 35 | 3 | Core/shell = ½ (24/3), double structure grain |
| Emulsion F | 4.0 | 0.17 | 28 | 1 | Core/shell = ⅓ (13/1), double structure grain |
| Emulsion G | 14.5 | 0.75 | 25 | 2 | Core/shell = ½ (42/0), double structure grain |
| Emulsion H | 14.5 | 1.30 | 25 | 3 | Core/shell = 37/63 (34/3), double structure grain |
| Emulsion I | 1 | 0.07 | 15 | 1 | Homogeneous grain |

EX-1

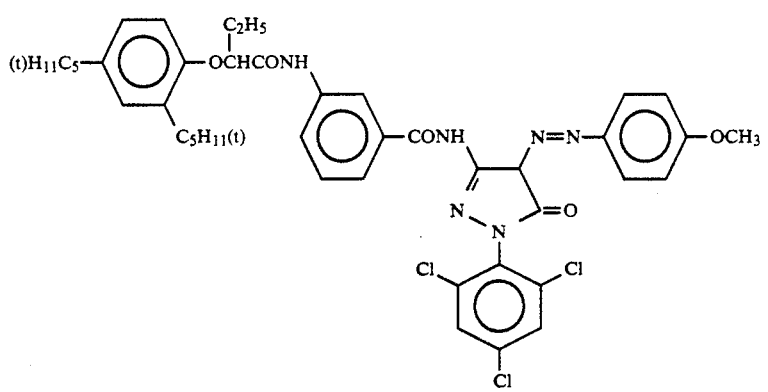

EX-2

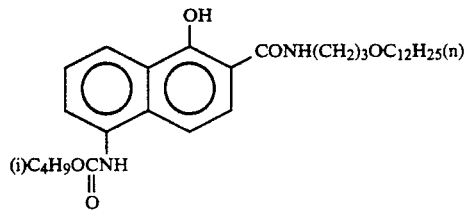

-continued
EX-3
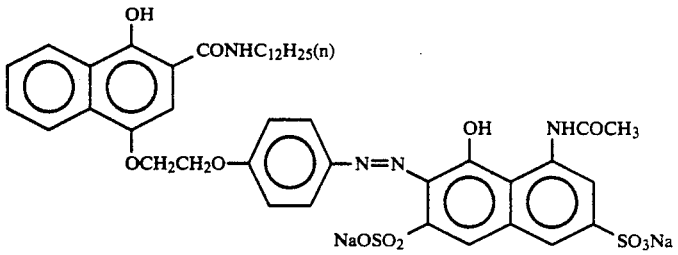
EX-4
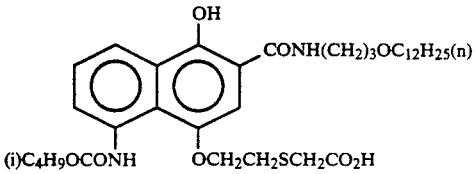
EX-5
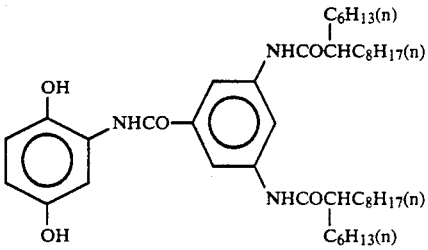
EX-6
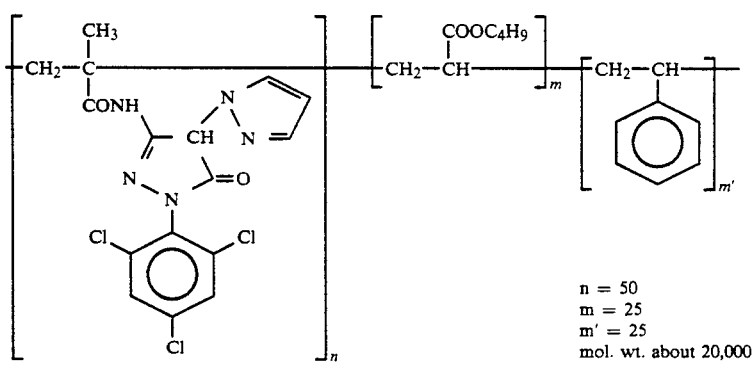
EX-7
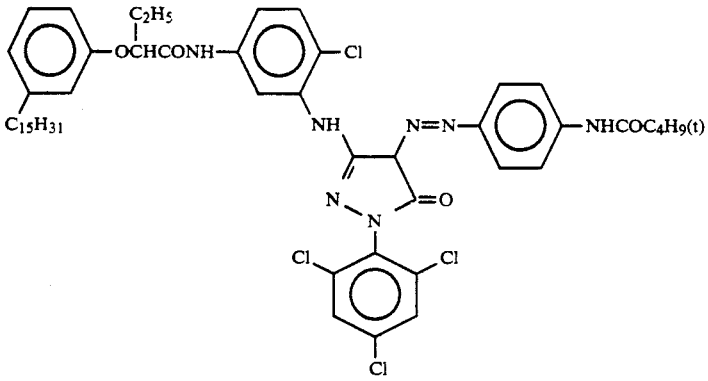

-continued
EX-8
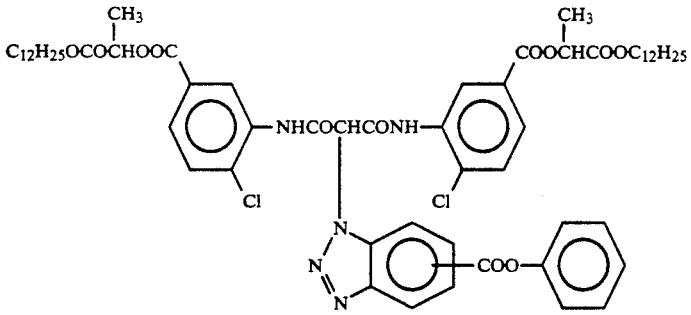
EX-9
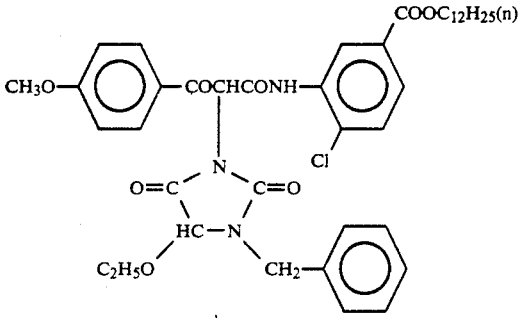
EX-10
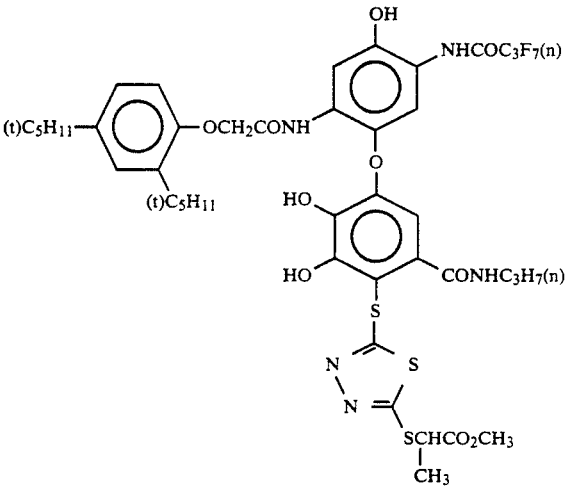
EX-11
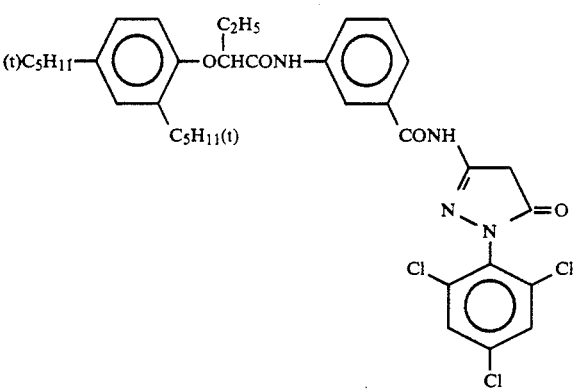

-continued
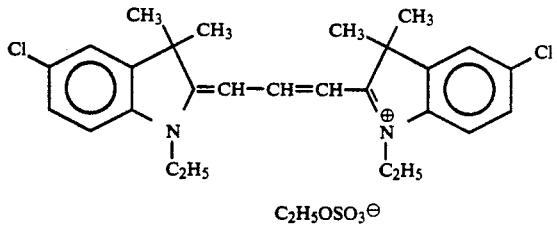
EX-12
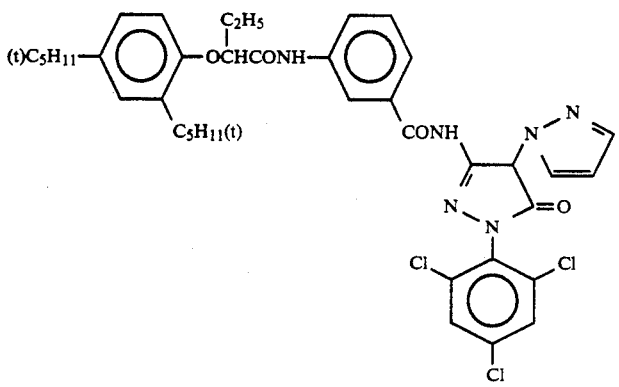
EX-13
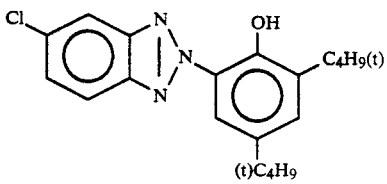
V-1
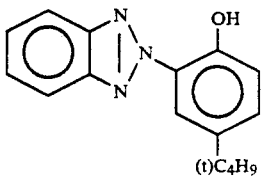
V-2
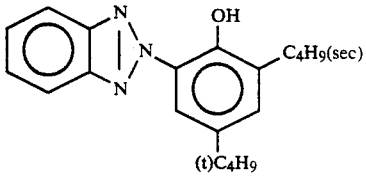
V-3
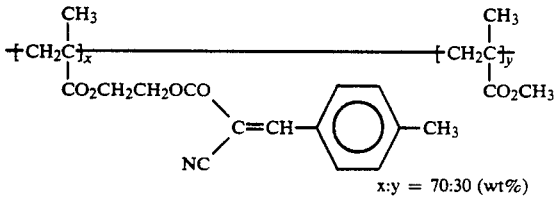
x:y = 70:30 (wt%)
V-4
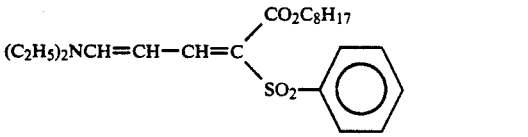
V-5
Tricresyl phosphate HBS-1
Di-n-butyl phthalate HBS-2

-continued

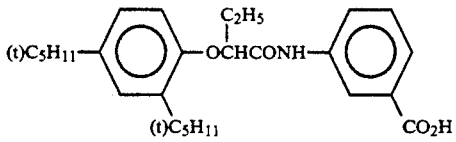

HBS-3

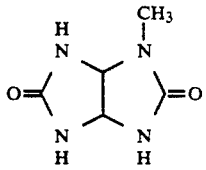

S-1

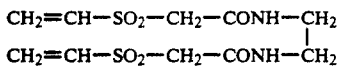

H-1

Samples 202 to 208 were prepared in the same manner as Sample 201 except that the yellow colloidal silver incorporated in the tenth layer was replaced by the dye dispersions set forth in Table 2 and the silver density was altered as shown in Table 2 by altering the gelatin content in each light-sensitive emulsion layer.

These photographic elements were exposed to light of 25 CMS from a tungsten lamp with its color temperature adjusted through a filter to 4,800° K., and then subjected to development at a temperature of 38° C. in accordance with the following steps outlined below.

| | |
|---|---|
| Color Development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 5 sec |

Composition of the processing solutions used for the steps outlined above:

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.0 |
| Bleaching Solution: | |
| Ferric Ammonium Ethylenediaminetetraacetate | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| pH | 6.0 |
| Fixing Solution: | |
| Disodium Ethylenediaminetetraacetate | 1.0 g |
| Sodium Sulfite | 4.0 g |
| 70% Aqueous Solution of Ammonium Thiosulfate | 175.0 ml |
| Sodium Bisulfite | 1.0 liter |
| Water to make | 1.0 liter |
| pH | 6.6 |
| Stabilizing Solution: | |
| 40% Formalin | 2.0 ml |
| Polyoxyethylene-p-monononylphenylether (mean polymerization degree: 10) | 0.3 g |
| Water to make | 1.0 liter |

-continued

The samples thus obtained were then examined for sharpness (MTF) and $D_{min}$ change after being stored at a temperature of 40° C. and a relative humidity of 55% over 7 days ($\Delta D_{min}$).

The results are set forth in Table 2.

TABLE 2

| Sample No. | Yellow Filter Material | Coated Amount (g/m²) | Silver Density (g/m³) 11th Layer | Silver Density (g/m³) 12th Layer | MTF (R) | $\Delta D_{min}$ (B) |
|---|---|---|---|---|---|---|
| 101 (Comparison) | Yellow colloidal silver | 0.05 | 0.30 | 0.27 | 1.15 | 0.03 |
| 102 (Comparison) | Yellow colloidal silver | " | 0.50 | " | 1.16 | 0.05 |
| 103 (Comparison) | Yellow colloidal silver | " | 0.30 | 0.40 | " | 0.07 |
| 104 (Comparison) | Yellow colloidal silver | " | 0.50 | " | 1.17 | 0.08 |
| 105 (Comparison) | II-5 | 0.10 | 0.30 | 0.27 | 1.13 | 0.03 |
| 106 (Invention) | " | " | 0.50 | " | 1.18 | " |
| 107 (Invention) | " | " | 0.30 | 0.40 | 1.16 | " |
| 108 (Invention) | " | " | 0.50 | " | 1.19 | 0.04 |

EXAMPLE 3

Preparation of Monodisperse Octahedral Silver Bromoiodide Emulsion J 5 ml of a 0.1% methanol solution of 3,4-dimethyl-4-thiazoline-2-thione was added to 1.2 liters of a 3.0% gelatin solution containing 0.06M potassium bromide with stirring and then kept at a temperature of 60° C. in a reaction vessel. 50 cc of a 0.3M silver nitrate solution and 50 cc of an aqueous solution of halide containing 0.063M potassium iodide and 0.19M potassium bromide were then charged into the reaction vessel in a double jet process in 3 minutes. Silver bromoiodide grains having a diameter of 0.3 μm calculated in terms of projected area and a silver iodide content of 25 mol % were obtained to form nuclei. Similarly, 800 ml of a 1.5M silver nitrate solution and 800 ml of a halide solution containing 0.375 M potassium iodide and 1.13M potassium bromide were simultaneously added to the system at a temperature of 60° C. in a double jet process in 100 minutes. The emulsion was then cooled to a temperature of 35° C., and washed with water in the ordinary flocculation process. 70 g of gelatin was added to the emulsion so that the pH value and pAg value were adjusted to 6.2 and 8.8, respectively. Thus, a first coating layer was formed. As a result, an emulsion of octahedral silver bromoiodide grains having a diameter of 0.44 μm calculated in terms of projected area was obtained (silver iodide content: 25 mol %).

A silver bromide shell (second coating layer) was then formed on the above mentioned emulsion as a core emulsion. The molar proportion of the first coating layer to the second coating layer was ¼. As a result, a monodisperse emulsion of core/shell octahedral grains having an average diameter of 0.7 μm (fluctuation coefficient: 14%, calculated in terms of sphere) and an internal silver iodide content of 25 mol % was obtained.

$K_3IrCl_6$ was added to the emulsion in an amount of $4\times10^{-4}$ mol per mol of silver halide. The emulsion was then subjected to optimum gold-sulfur sensitization with sodium thiosulfate, chloroauric acid and potassium thiocyanate at a temperature of 60° C.

Preparation of Monodisperse Octahedral Silver Bromoiodide Emulsion K 20 ml of a 0.1% methanol solution of 3,4-dimethyl-4-thiazoline-2-thione was added to 1.2 liters of a 3.0 wt % gelatin solution containing 0.06M potassium bromide with stirring and then kept at a temperature of 75° C. in a reaction vessel. 50 cc of a 0.3M silver nitrate solution and 50 cc of an aqueous solution of halide containing 0.063M potassium iodide and 0.19M potassium bromide were then charged into the reaction vessel in a double jet process in 3 minutes. Thus, silver bromoiodide grains having a diameter of 0.3 μm calculated in terms of projected area and a silver iodide content of 25 mol % were obtained to form nuclei. Similarly, 800 ml of a 1.5M silver nitrate solution and 800 ml of a halide solution containing 0.375M potassium iodide and 1.13M potassium bromide were simultaneously added to the system at a temperature of 75° C. in a double jet process in 100 minutes. The emulsion was then cooled to 35° C., and washed with water in the ordinary flocculation process. 70 g of gelatin was added to the emulsion so that the pH value and pAg value thereof were adjusted to 6.2 and 8.8, respectively. Thus, a first coating layer was formed. As a result, an emulsion of octahedral silver bromoiodide grains having a diameter of 0.7 μm calculated in terms of projected area was obtained (silver iodide content: 25 mol %).

A silver bromide shell (second coating layer) was then formed on the above mentioned emulsion as core emulsion. The molar proportion of the first coating layer to the second coating layer was ½. As a result, a monodisperse emulsion of core/shell octahedral grains having an average diameter of 1.0 μm (fluctuation coefficient: 10%) calculated in terms of sphere and an internal silver iodide content of 25 mol % was obtained.

$K_3IrCl_6$ was added to the emulsion in an amount of $7\times10^{-4}$ mol per mol of silver halide. The emulsion was then subjected to optimum gold-sulfur sensitization with sodium thiosulfate, chloroauric acid, and potassium thiocyanate at a temperature of 60° C.

Preparation of Monodisperse Tabular Silver Bromoiodide Emulsion L 15 cc of a 2.0M silver nitrate solution and 15 cc of an aqueous halide solution containing 0.5M potassium iodide and 1.5M potassium bromide were added to 1.3 liters of a 0.8 wt % gelatin solution of 0.02M potassium bromide in 30 seconds in a double jet process while the latter was kept at a temperature of 30° C. 30 g of gelatin which had been heated to a temperature of 70° C. was added to the system. The system was subjected to ripening over 30 minutes. Thus, silver bromoiodide nuclear grains having a silver iodide content of 25 mol % were obtained. The grains were then adjusted with a silver nitrate solution to a pBr value of 2.0. A potassium bromide solution containing 75 g of silver nitrate and 25 mol % of potassium iodide was added to the system in an amount equimolecular with silver nitrate at an accelerated flow rate (the final flow rate was 10 times the initial value) over 40 minutes. 75 g of silver nitrate and an equimolecular amount of potassium bromide to the above silver nitrate were then added to the system at an accelerated flow rate (the final flow rate was twice the initial value) over 20 minutes (formation of shell). The emulsion was cooled to a temperature of 35° C., and washed with water in the ordinary flocculation process. 60 g of gelatin was added to and dissolved in the emulsion at a temperature of 40° C. The pH value and pAg value of the emulsion were adjusted to 6.5 and 8.6, respectively. The resulting tabular grains had a core/shell structure (core/shell ratio: 1) comprising a core made of silver bromoiodide having a silver iodide content of 25 mol % and a shell made of pure silver bromide. The tabular grains thus obtained also had average diameter of 2.3 μm calculated in terms of sphere, a diameter fluctuation coefficient of 15%, and a thickness of 0.33 μm.

In the same manner as in Emulsion J, Emulsion L thus obtained was subjected to optimum gold-sulfur sensitization with sodium thiosulfate, chloroauric acid and potassium thiocyanate at a temperature of 60° C.

Emulsions J, K and L were subjected to spectral sensitization with sensitizing dyes as set forth in Tables 3, 4 and 5 to prepare Emulsions J-1 to J-15, K-1 to K-15, and L-1 to L-15.

TABLE 3

| Emulsion | Emulsion to Which Sensitizing Dye Was Added | Sensitizing Dye Added and Its Amount Added per Mol of Silver Halide (mol) | Time and Temperature at Which Sensitizing Dye Was Added |
|---|---|---|---|
| J-1 | J | (20) $4.3\times10^{-5}$<br>(21) $1.1\times10^{-5}$<br>(6) $1.9\times10^{-4}$ | After chemical sensitization, 40° C. |
| J-2 | " | (20) $4.3\times10^{-5}$<br>(21) $1.1\times10^{-5}$<br>(6) $1.9\times10^{-4}$ | After chemical sensitization, 60° C. |
| J-3 | " | (20) $4.3\times10^{-5}$<br>(21) $1.1\times10^{-5}$<br>(6) $1.9\times10^{-4}$ | Before chemical sensitization, 60° C. |
| J-4 | " | (20) $4.3\times10^{-5}$<br>(21) $1.1\times10^{-5}$<br>(6) $1.9\times10^{-4}$ | After formation of grains, 60° C. |
| J-5 | " | (20) $4.3\times10^{-5}$<br>(21) $1.1\times10^{-5}$<br>(6) $1.9\times10^{-4}$ | Over 100 minutes during the formation of first coating |

TABLE 3-continued

| Emulsion | Emulsion to Which Sensitizing Dye Was Added | Sensitizing Dye Added and Its Amount Added per Mol of Silver Halide (mol) | Time and Temperature at Which Sensitizing Dye Was Added |
|---|---|---|---|
| | | | layer, 60° C. |
| J- 6 | J | (23) $2.6 \times 10^{-5}$<br>(24) $9.0 \times 10^{-5}$<br>(22) $3.3 \times 10^{-4}$ | Same as J-1 |
| J- 7 | " | (23) $2.6 \times 10^{-5}$<br>(24) $9.0 \times 10^{-5}$<br>(22) $3.3 \times 10^{-4}$ | Same as J-2 |
| J- 8 | " | (23) $2.6 \times 10^{-5}$<br>(24) $9.0 \times 10^{-5}$<br>(22) $3.3 \times 10^{-4}$ | Same as J-3 |
| J- 9 | " | (23) $2.6 \times 10^{-5}$<br>(24) $9.0 \times 10^{-5}$<br>(22) $3.3 \times 10^{-4}$ | Same as J-4 |
| J-10 | " | (23) $2.6 \times 10^{-5}$<br>(24) $9.0 \times 10^{-5}$<br>(22) $3.3 \times 10^{-4}$ | Same as J-5 |
| J-11 | " | (18) $3.0 \times 10^{-4}$ | Same as J-1 |
| J-12 | " | (18) $3.0 \times 10^{-4}$ | Same as J-2 |
| J-13 | J | (18) $3.0 \times 10^{-4}$ | Same as J-3 |
| J-14 | " | (18) $3.0 \times 10^{-4}$ | Same as J-4 |
| J-15 | " | (18) $3.0 \times 10^{-4}$ | Same as J-5 |

TABLE 4

| Emulsion | Emulsion to Which Sensitizing Dye Was Added | Sensitizing Dye Added and Its Amount Added per Mol of Silver Halide (mol) | Time and Temperature at Which Sensitizing Dye Was Added |
|---|---|---|---|
| K- 1 | K | (20) $3.0 \times 10^{-5}$<br>(21) $8.0 \times 10^{-6}$<br>(6) $1.3 \times 10^{-4}$ | After chemical sensitization, 40° C. |
| K- 2 | " | (20) $3.0 \times 10^{-5}$<br>(21) $8.0 \times 10^{-6}$<br>(6) $1.3 \times 10^{-4}$ | After chemical sensitization, 60° C. |
| K- 3 | " | (20) $3.0 \times 10^{-5}$<br>(21) $8.0 \times 10^{-6}$<br>(6) $1.3 \times 10^{-4}$ | Before chemical sensitization, 60° C. |
| K- 4 | " | (20) $3.0 \times 10^{-5}$<br>(21) $8.0 \times 10^{-6}$<br>(6) $1.3 \times 10^{-4}$ | After formation of grains, 75° C. |
| K- 5 | " | (20) $3.0 \times 10^{-5}$<br>(21) $8.0 \times 10^{-6}$<br>(6) $1.3 \times 10^{-4}$ | Over 100 minutes during the formation of first coating layer, 75° C. |
| K- 6 | K | (23) $1.8 \times 10^{-5}$<br>(24) $6.3 \times 10^{-5}$<br>(22) $2.3 \times 10^{-4}$ | Same as K-1 |
| K- 7 | " | (23) $1.8 \times 10^{-5}$<br>(24) $6.3 \times 10^{-5}$<br>(22) $2.3 \times 10^{-4}$ | Same as K-2 |
| K- 8 | " | (23) $1.8 \times 10^{-5}$<br>(24) $6.3 \times 10^{-5}$<br>(22) $2.3 \times 10^{-4}$ | Same as K-3 |
| K- 9 | " | (23) $1.8 \times 10^{-5}$<br>(24) $6.3 \times 10^{-5}$<br>(22) $2.3 \times 10^{-4}$ | Same as K-4 |
| K-10 | " | (23) $1.8 \times 10^{-5}$<br>(24) $6.3 \times 10^{-5}$<br>(22) $2.3 \times 10^{-4}$ | Same as K-5 |
| K-11 | " | (18) $2.0 \times 10^{-4}$ | Same as K-1 |
| K-12 | " | (18) $2.0 \times 10^{-4}$ | Same as K-2 |
| K-13 | K | (18) $2.0 \times 10^{-4}$ | Same as K-3 |
| K-14 | " | (18) $2.0 \times 10^{-4}$ | Same as K-4 |
| K-15 | " | (18) $2.0 \times 10^{-4}$ | Same as K-5 |

TABLE 5

| Emulsion | Emulsion to Which Sensitizing Dye Was Added | Sensitizing Dye Added and Its Amount Added per Mol of Silver Halide (mol) | Time and Temperature at Which Sensitizing Dye Was Added |
|---|---|---|---|
| L- 1 | K | (20) $3.0 \times 10^{-5}$<br>(21) $8.0 \times 10^{-6}$<br>(6) $1.3 \times 10^{-4}$ | After chemical sensitization, 40° C. |
| L- 2 | " | (20) $3.0 \times 10^{-5}$<br>(21) $8.0 \times 10^{-6}$<br>(6) $1.3 \times 10^{-4}$ | After chemical sensitization, 60° C. |
| L- 3 | " | (20) $3.0 \times 10^{-5}$<br>(21) $8.0 \times 10^{-6}$<br>(6) $1.3 \times 10^{-4}$ | Before chemical sensitization, 60° C. |
| L- 4 | " | (20) $3.0 \times 10^{-5}$<br>(21) $8.0 \times 10^{-6}$<br>(6) $1.3 \times 10^{-4}$ | After formation of grains, 70° C. |
| L- 5 | " | (20) $3.0 \times 10^{-5}$<br>(21) $8.0 \times 10^{-6}$<br>(6) $1.3 \times 10^{-4}$ | Over 20 minutes during the formation of shell, 70° C. |
| L- 6 | K | (23) $1.8 \times 10^{-5}$<br>(24) $6.3 \times 10^{-5}$<br>(22) $2.3 \times 10^{-4}$ | Same as L-1 |
| L- 7 | " | (23) $1.8 \times 10^{-5}$<br>(24) $6.3 \times 10^{-5}$<br>(22) $2.3 \times 10^{-4}$ | Same as L-2 |
| L- 8 | " | (23) $1.8 \times 10^{-5}$<br>(24) $6.3 \times 10^{-5}$<br>(22) $2.3 \times 10^{-4}$ | Same as L-3 |
| L- 9 | " | (23) $1.8 \times 10^{-5}$<br>(24) $6.3 \times 10^{-5}$<br>(22) $2.3 \times 10^{-4}$ | Same as L-4 |
| L-10 | " | (23) $1.8 \times 10^{-5}$<br>(24) $6.3 \times 10^{-5}$<br>(22) $2.3 \times 10^{-4}$ | Same as L-5 |
| L-11 | " | (18) $2.0 \times 10^{-4}$ | Same as L-1 |
| L-12 | " | (18) $2.0 \times 10^{-4}$ | Same as L-2 |
| L-13 | K | (18) $2.0 \times 10^{-4}$ | Same as L-3 |
| L-14 | " | (18) $2.0 \times 10^{-4}$ | Same as L-4 |
| L-15 | " | (18) $2.0 \times 10^{-4}$ | Same as L-5 |

Preparation of Samples 5 301 to 305

Multilayer color light-sensitive material Samples 301 to 305 were prepared in the same manner as Sample 201 of Example 2 except that silver halide emulsions as set forth in Table 6 were used.

Preparation of Samples 306 to 310

Samples 306 to 310 were prepared in the same manner as Samples 301 to 305, respectively, except that the first layer was formed by coating a dye dispersion which had been prepared in the same manner as in Example 1 from a 1/1 (by weight) mixture of Compound III-34 and Compound I-4 free of black colloidal silver in such an amount that the sum of the content of the d-yes reached 0.26 g/m$^2$ and the tenth layer was formed by coating a dye dispersion of Compound I-1 free of colloidal silver in such an amount that the coated amount of Compound I-1 reached 0.23 g/m$^2$.

TABLE 6

| Emulsion No. | Material Incorporated in First and Tenth Layers: 1st Layer | 10th Layer | Emulsion Incorporated in Each Emulsion Layer: 3rd Layer | 4th Layer | 5th Layer | 7th Layer | 8th Layer | 9th Layer | 11th Layer | 12th Layer | 13th Layer |
|---|---|---|---|---|---|---|---|---|---|---|---|
| 301 (Comparison) | Black silver | Yellow colloidal silver | J-1 | K-1 | L-1 | J-6 | K-6 | L-6 | J-11 | K-11 | L-11 |
| 302 (Comparison) | Black silver | Yellow colloidal silver | J-2 | K-2 | L-2 | J-7 | K-7 | L-7 | J-12 | K-12 | L-12 |
| 303 (Comparison) | Black silver | Yellow colloidal silver | J-3 | K-3 | L-3 | J-8 | K-8 | L-8 | J-13 | K-13 | L-13 |
| 304 (Comparison) | Black silver | Yellow colloidal silver | J-4 | K-4 | L-4 | J-9 | K-9 | L-9 | J-14 | K-14 | L-14 |
| 305 (Comparison) | Black silver | Yellow colloidal silver | J-5 | K-5 | L-5 | J-10 | K-10 | L-10 | J-15 | K-15 | L-15 |
| 306 (Invention) | 1/1 (by weight) Dispersion of III-34 and I-1 | I-1 | J-1 | K-1 | L-1 | J-6 | K-6 | L-6 | J-11 | K-11 | L-11 |
| 307 (Invention) | 1/1 (by weight) Dispersion of III-34 and I-1 | " | J-2 | K-2 | L-2 | J-7 | K-7 | L-7 | J-12 | K-12 | L-12 |
| 308 (Invention) | 1/1 (by weight) Dispersion of III-34 and I-1 | " | J-3 | K-3 | L-3 | J-8 | K-8 | L-8 | J-13 | K-13 | L-13 |
| 309 (Invention) | 1/1 (by weight) Dispersion of III-34 and I-1 | " | J-4 | K-4 | L-4 | J-9 | K-9 | L-9 | J-14 | K-14 | L-14 |
| 310 (Invention) | 1/1 (by weight) Dispersion of III-34 and I-1 | " | J-5 | K-5 | L-5 | J-10 | K-10 | L-10 | J-15 | K-15 | L-15 |

Stripped pieces taken from Samples 301 to 310 were wedgewise exposed to light, processed as outlined below and then subjected to sensitometry for comparison of sensitivity. At the same time, the residual amount of silver at the maximum density portion was determined for comparison. The results of these comparisons are set forth in Table 7.

As shown in Table 7, Samples 302 to 305 prepared by incorporating sensitizing dyes in silver halide emulsions at an elevated temperature exhibit an improved sensitivity but poor desilverability as compared to Sample 301 prepared by incorporating a sensitizing dye in a silver halide emulsion at a low temperature. However, Samples 307 to 310, prepared by replacing black silver in the antihalation layer or colloidal silver in the yellow filter layer by a dye dispersion, exhibit remarkably improved desilverability compared to Sample 301. Samples 307 to 310 exhibit substantially the same desilverability as Sample 306, prepared simply by replacing the colloidal silver in the antihalation layer and the yellow filter layer by a dye dispersion.

Processing Steps for Samples 301 to 310

| Step | Processing Temperature (°C.) | Time | Replenishment Rate* (liter/m²) | Tank Volume (liter) |
|---|---|---|---|---|
| Color Development | 37.8 | 3 min 15 sec | 21 | 5 |
| Bleach | 38.0 | 45 sec | 45 | 2 |
| Fixing 1 | 38.0 | 45 sec | 30 | 2 |
| Fixing 1 | 38.0 | 45 sec | (two-tank countercurrent process) | 2 |
| Stabilizing 1 | 38.0 | 20 sec | 35 | 1 |
| Stabilizing 2 | 38.0 | 20 sec | (three-tank countercurrent process) | 1 |
| Stabilizing 3 | 38.0 | 20 sec | | 1 |
| Drying | 55 | 1 min 00 sec | | |

*Replenishment rate: per m of 35 mm wide light-sensitive material

The fixing tank in the automatic developing machine used was equipped with a jet agitator as described in JP-A-62-183460 (Page 3). In this arrangement, the fixing solution was jetted to the surface of the light-sensitive material to be processed.

| | Running Solution | Replenisher |
|---|---|---|
| Color Developer: | | |
| Hydroxyethyliminodiacetic Acid | 5.0 g | 6.0 g |
| Sodium Sulfite | 4.0 g | 5.0 g |
| Potassium Carbonate | 30.0 g | 37.0 g |
| Potassium Bromide | 1.3 g | 0.5 g |
| Potassium Iodide | 1.2 mg | — |
| Hydroxylamine Sulfate | 2.0 g | 3.6 g |
| 4-[N-Lithyl-N-β-hydroxyethylamino]-2-methylaniline Sulfate | $1.0 \times 10^{-2}$ mol | $1.3 \times 10^{-2}$ mol |
| Water to make | 1.0 liter | 1.0 liter |
| pH | 10.00 | 10.15 |
| Bleaching Solution: | | |
| Ferric 1,3-Diaminopropanetetraacetic Acid Complex Salt | 130 g | 190 g |
| 1,3-Diaminopropanetetraacetic Acid | 3.0 g | 4.0 g |
| Ammonium Bromide | 85 g | 120 g |
| Acetic Acid | 50 g | 70 g |
| Ammonium Nitrate | 30 g | 40 g |
| Water to make | 1.0 liter | 1.0 liter |
| pH adjusted with acetic acid and ammonia to | 4.3 | 3.5 |
| Fixing Solution: | | |
| 1-Hydroxyethylidene-1,1-diphosphonic Acid | 5.0 g | 7.0 g |
| Disodium Ethylenediaminetetraacetate | 0.5 g | 0.7 g |
| Sodium Sulfite | 10.0 g | 12.0 g |
| Sodium Bisulfite | 8.0 g | 10.0 g |
| Aqueous Solution of Ammonium Thiosulfate (700 g/liter) | 170.0 ml | 200.0 ml |
| Ammonium Thiocyanate | 100.0 g | 150.0 g |
| Thiourea | 3.0 g | 5.0 g |
| 3,6-Dithia-1,8-octanediol | 3.0 g | 5.0 g |
| Water to make | 1.0 liter | 1.0 liter |
| pH adjusted with acetic | 6.5 | 6.7 |

-continued

| | Running Solution | Replenisher |
|---|---|---|
| acid and ammonia to | | |
| Stabilizing Solution: | | |
| 37% Formalin | 1.2 ml | 1.2 ml |
| 5-Chloro-2-methyl-4-isothiazoline-3-one | 6.0 ml | 6.0 ml |
| 2-Methyl-4-isothiazoline-3-one | 3.0 mg | 3.0 mg |
| Surface Active Agent $C_{10}H_{21}O(CH_2CH_2O)_{10}H$ | 0.4 g | 0.4 g |
| Ethylene Glycol | 1.0 g | 1.0 g |
| Water to make | 1.0 liter | 1.0 liter |
| pH | 5.0–7.0 | |

TABLE 7

| Sample No. | Relative Sensitivity Cyan Image | Magenta Image | Yellow Image | Residual Amount of Silver on Maximum Density Portion (μg/cm²) |
|---|---|---|---|---|
| 301 (Comparison) | 100 | 100 | 100 | 17 |
| 302 (Comparison) | 120 | 125 | 115 | 25 |
| 303 (Comparison) | 130 | 135 | 120 | 35 |
| 304 (Comparison) | 140 | 140 | 125 | 35 |
| 305 (Comparison) | 140 | 140 | 125 | 40 |
| 306 (Invention) | 100 | 100 | 100 | 6 |
| 307 (Invention) | 120 | 125 | 115 | 8 |
| 308 (Invention) | 130 | 135 | 120 | 9 |
| 309 (Invention) | 140 | 140 | 125 | 9 |
| 310 (Invention) | 140 | 140 | 125 | 9 |

Note:
The relative sensitivity is represented by the reciprocal of the exposure giving the minimum density plus 0.15 on each image, relative to that of Sample 101 as 100.

EXAMPLE 4

Preparation of Sample 401

Sample 401 was prepared in the same manner as Sample 101 of Example 1.

Preparation of Sample 402

Sample 402 was prepared in the same manner as Sample 401 except that the yellow colloidal silver incorporated in the eleventh layer was replaced by 0.28 g/m² of Comparative Compound A.

Preparation of Sample 403

Sample 403 was prepared in the same manner as Sample 402 except that Comparative Compound A in the eleventh layer was replaced by a dispersion-of Compound I-25 in an amount of 0.25 g/m² calculated in terms of amount of I-25.

Preparation of Sample 404

Sample 404 was prepared in the same manner as Sample 403 except that the dispersion of I-25 was replaced by a dispersion of I-28 in an amount of 0.27 g/m² as calculated in terms of amount of I-28.

Preparation of Samples 405 to 408

Samples 405 to 408 were prepared in the same manner as Samples 403 and 404 except that the compound represented by general formula (VII) was incorporated in the layers as set forth in Table 1.

Preparation of Samples 409 to 412

Samples 409 to 412 were prepared in the same manner as Samples 401 to 404 except that the black colloidal silver incorporated in the first layer was replaced by dispersions of Dyes III-3 and III-12 in such an amount that the sum of the amounts of III-3 and III-12 was 0.26 g/m².

Preparation of Samples 413 to 416

Samples 413 to 416 were prepared in the same manner as Samples 411 and 412 except that the compound represented by general formula (VII) was incorporated in the layers as set forth in Table 1.

Preparation of Sample 417

Sample 417 was prepared in the same manner as Sample 401 except that the half amount of the black colloidal silver incorporated in the first layer was replaced by dispersions of Dyes III-3 and III-12 in such an amount that the sum of the content of III-3 and III-12 was 0.13 g/m², and that the half amount of the yellow colloidal silver incorporated in the thirteenth layer was replaced by a dispersion of Dye I-25 in such an amount that the content of I-25 was 0.125 g/m².

Preparation of Sample 418

Sample 418 was prepared in the same manner as Sample 417 except that the compound represented by general formula (VIII) was incorporated in the layers as set forth in Table 8.

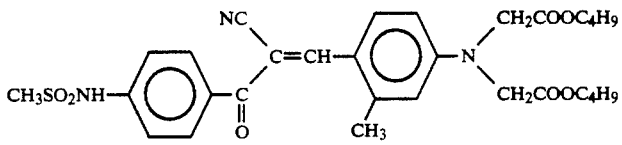

(the same compound as disclosed in JP-A-62-32460)

Samples 401 to 418 thus prepared were exposed to white light through a continuous wedge, and developed in the same manner as shown in Example 1. These samples were then measured for cyan, magenta and yellow density to determine the maximum density ($D_{max}$).

Another batch of Samples 401 to 418 were exposed to red light through a continuous wedge, and developed in the same manner as shown in Example 1. A further batch of Samples 401 to 418 were exposed to white light (red+green+blue) through a continuous wedge with the three color lights adjusted so as to the samples thus developed turned gray. These samples were then similarly developed. The exposure to red light during the exposure to red light was the same as the exposure to red light during the exposure to white light.

The developed samples were measured for density. The difference ΔlogE (R) in exposure that gave a cyan density of 1.0 between upon the exposure to red light and upon the exposure to white light was determined as the degree of interimage effect for the red-sensitive silver halide emulsion layer. Similarly, the degree of interimage effects for the green-sensitive silver halide emulsion layer and the blue-sensitive silver halide emulsion layer were determined. The results are set forth in Table 9.

TABLE 8

| Sample No. | 11th Layer Yellow Filter Layer | 1st Layer Antihalation Layer | Compound Added and Its Added Amount (mol/mol Ag) |
|---|---|---|---|
| 401 (Comparison) | Yellow colloidal silver | Black colloidal silver | — |
| 402 | Compound A | Black | — |

TABLE 8-continued

| Sample No. | 11th Layer Yellow Filter Layer | 1st Layer Antihalation Layer | Compound Added and Its Added Amount (mol/mol Ag) |
|---|---|---|---|
| (Comparison) | | colloidal silver | |
| 403 (Invention) | Dispersion (I-23) | Black colloidal silver | — |
| 404 (Invention) | Dispersion (I-26) | Black colloidal silver | — |
| 405 (Invention) | Dispersion (I-23) | Black colloidal silver | VII-1 incorporated in 8th, 9th, 13th, 14th layers; ($5 \times 10^{-4}$) |
| 406 (Invention) | Dispersion (I-23) | Black colloidal silver | VII-10 incorporated in 8th, 9th, 13th, 14th layers; ($5 \times 10^{-4}$) |
| 407 (Invention) | Dispersion (I-26) | Black colloidal silver | VII-1 incorporated in 8th, 9th, 13th, 14th layers; ($5 \times 10^{-4}$) |
| 408 (Invention) | Dispersion (I-26) | Black colloidal silver | VII-10 incorporated in 8th, 9th, 13th, 14th layers; ($5 \times 10^{-4}$) |
| 409 (Comparison) | Yellow colloidal silver | Dispersion (III-3/III-12) | — |
| 410 (Comparison) | Compound A | Dispersion (III-3/III-12) | — |
| 411 (Invention) | Dispersion (I-23) | Dispersion (III-3/III-12) | — |
| 412 (Invention) | Dispersion (I-26) | Dispersion (III-3/III-12) | — |
| 413 (Invention) | Dispersion (I-23) | Dispersion (III-3/III-12) | VII-1 incorporated in 8th, 9th, 13th and 14th layers ($5 \times 10^{-4}$); VII-1 incorporated in 4th layer ($5 \times 10^{-4}$) |
| 414 (Invention) | Dispersion (I-23) | Dispersion (III-3/III-12) | VII-1 incorporated in 8th, 9th, 13th and 14th layers ($5 \times 10^{-4}$); VII-11 incorporated in 4th layer ($5 \times 10^{-4}$) |
| 415 (Invention) | Dispersion (I-26) | Dispersion (III-3/III-12) | VII-1 incorporated in 8th, 9th, 13th and 14th layers ($5 \times 10^{-4}$); VII-1 incorporated in 4th layer ( ) |
| 416 (Invention) | Dispersion (I-26) | Dispersion (III-3/III-12) | VII-1 incorporated in 8th, 9th, 13th and 14th layers ($5 \times 10^{-4}$); VII-11 incorporated in 4th layer ($5 \times 10^{-4}$) |
| 417 (Invention) | Yellow colloidal silver + Dispersion (I-23) | Black colloidal silver + Dispersion (III-3/III-12) | — |
| 418 (Invention) | Yellow colloidal silver + Dispersion (I-23) | Black colloidal silver + Dispersion (III-3/III-12) | VII-1 incorporated in 8th, 9th, 13th and 14th layers ($5 \times 10^{-4}$); VII-1 incorporated in 4th layer ($5 \times 10^{-4}$) |

TABLE 9

| Sample No. | $D_{max}$ Cyan | $D_{max}$ Magenta | $D_{max}$ Yellow | ΔlogE(R) | ΔlogE(G) | ΔlogE(B) |
|---|---|---|---|---|---|---|
| 401 (Comparison) | 2.80 | 2.90 | 2.80 | 0.15 | 0.17 | 0.15 |
| 402 (Comparison) | 2.80 | 2.90 | 2.85 | 0.10 | 0.04 | 0.03 |
| 403 (Comparison) | 2.83 | 3.09 | 3.17 | 0.11 | 0.05 | 0.05 |
| 404 (Comparison) | 2.83 | 3.08 | 3.15 | 0.11 | 0.04 | 0.04 |
| 405 (Invention) | 2.84 | 3.11 | 3.20 | 0.15 | 0.18 | 0.16 |
| 406 (Invention) | 2.83 | 3.10 | 3.19 | 0.16 | 0.17 | 0.16 |
| 407 (Invention) | 2.82 | 3.10 | 3.20 | 0.15 | 0.19 | 0.16 |
| 408 (Invention) | 2.83 | 3.09 | 3.18 | 0.15 | 0.17 | 0.15 |
| 409 (Comparison) | 3.05 | 2.90 | 2.80 | 0.04 | 0.16 | 0.15 |
| 410 (Comparison) | 3.06 | 2.90 | 2.84 | 0.04 | 0.04 | 0.03 |
| 411 (Comparison) | 3.05 | 3.10 | 3.18 | 0.03 | 0.04 | 0.04 |
| 412 (Comparison) | 3.05 | 3.09 | 3.16 | 0.04 | 0.04 | 0.04 |
| 413 (Invention) | 3.07 | 3.10 | 3.18 | 0.20 | 0.23 | 0.21 |
| 414 (Invention) | 3.06 | 3.10 | 3.16 | 0.18 | 0.22 | 0.20 |
| 415 (Invention) | 3.08 | 3.11 | 3.17 | 0.19 | 0.22 | 0.20 |
| 416 (Invention) | 3.07 | 3.10 | 3.17 | 0.18 | 0.21 | 0.19 |
| 417 (Comparison) | 2.93 | 3.00 | 3.00 | 0.10 | 0.11 | 0.10 |
| 418 (Invention) | 2.94 | 3.02 | 3.01 | 0.23 | 0.24 | 0.23 |

Table 9 shows that the samples corresponding to the present invention exhibit improved $D_{max}$, high interimage effect, and excellent color reproducibility given by the decrease in fog compared to the comparative samples.

Samples were then prepared by incorporating a dispersion of Dye I-29 in the seventh layer in Samples 405 to 408, 413 to 416, and 418 in such an amount that the content of Dye I-29 was 0.15 g/m$^2$. These samples exhibit less unnecessary sensitivity to green light in the red-sensitive emulsion layer and provide more excellent color reproducibility.

EXAMPLE 5

Preparation of Sample 501

Sample 501 was prepared in the same manner as Sample 101.

The amount of colloidal silver or the compound of the present invention incorporated and the silver iodide content in silver halide grains incorporated in the light-sensitive silver halide emulsions are set forth in Table 10.

Preparation of Sample 502

Sample 502 was prepared in the same manner as Sample 501 except that the silver iodide content of the light-sensitive silver halide grains incorporated in the 2nd, 3rd, 7th, 8th, 9th, 14th, and 15th layers was 2 mol %.

Preparation of Sample 503

Sample 503 was prepared in the same manner as Sample 501 except that the silver iodide content of the entire light-sensitive emulsion was 6 mol %.

Preparation of Sample 504

Sample 504 was prepared in the same manner as Sample 501 except that the silver iodide content of the entire light-sensitive emulsion was 8 mol %.

Preparation of Sample 505

Sample 505 was prepared in the same manner as Sample 501 except that the silver iodide content of the entire light-sensitive emulsion was 10 mol %.

Preparation of Sample 506

Sample 506 was prepared in the same manner as Sample 501 except that the silver iodide content of the entire light-sensitive emulsion was 15 mol %.

Preparation of Samples 507, 510, 513, 516, 519, 522

Samples 507, 510, 513, 516, 519 and 522 were prepared in the same manner as Sample 501 except that the colloidal silver incorporated in the first layer and eleventh layer was replaced by the compounds of the present invention set forth in Table 10, respectively.

Preparation of Samples 508, 511, 514, 517, 520, 523

Samples 508, 511, 514, 517, 520 and 523 were prepared in the same manner as Sample 503 except that the colloidal silver incorporated in the first layer and eleventh layer was replaced by the compounds of the present invention set forth in Table 10, respectively.

Preparation of Samples 509, 512, 515, 518, 521, 524

Samples 509, 512, 515, 518, 521 and 524 were prepared in the same manner as Sample 505 except that the colloidal silver incorporated in the first layer and eleventh layer was replaced by the compounds of the present invention set forth in Table 10, respectively.

Preparation of Samples 525, 526, 527

Samples 525, 526 and 527 were prepared in the same manner as Sample 507 except that the silver iodide content of the entire light-sensitive emulsion was 2 mol %, 8 mol % and 15 mol %, respectively.

The adjustment of the silver iodide content in the light-sensitive silver halide emulsion was accomplished by altering the amount of iodine ion to be added during the formation of silver halide grains.

TABLE 10

| Sample No. | Additive for First Layer | Additive for Eleventh Layer | Average Silver Iodide Content in Light Sensitive Silver Halide Grains (mol %) |
|---|---|---|---|
| 501 | Black colloidal silver; 0.25 g/m$^2$ | Yellow colloidal silver; 0.10 g/m$^2$ | 3 |
| 502 | Black colloidal silver; 0.25 g/m$^2$ | Yellow colloidal silver; 0.10 g/m$^2$ | 2 |
| 503 | Black colloidal silver; 0.25 g/m$^2$ | Yellow colloidal silver; 0.10 g/m$^2$ | 6 |
| 504 | Black colloidal silver; 0.25 g/m$^2$ | Yellow colloidal silver; 0.10 g/m$^2$ | 8 |
| 505 | Black colloidal silver; 0.25 g/m$^2$ | Yellow colloidal silver; 0.10 g/m$^2$ | 10 |
| 506 | Black colloidal silver; 0.25 g/m$^2$ | Yellow colloidal silver; 0.10 g/m$^2$ | 15 |
| 507 | Dispersion S-1; such am amount that the sum of the content of I-1, I-4 and III-34 reached 0.24 g/m$^2$ | Dispersion S-7; such an amount that the content of I-1 reached 0.22 g/m$^2$ | 3 |
| 508 | Dispersion S-1; such am amount that the sum of the content of I-1, I-4 and III-34 reached 0.24 g/m$^2$ | Dispersion S-7; such an amount that the content of I-1 reached 0.22 g/m$^2$ | 6 |
| 509 | Dispersion S-1; such am amount that the sum of the content of I-1, I-4 and III-34 reached 0.24 g/m$^2$ | Dispersion S-7; such an amount that the content of I-1 reached 0.22 g/m$^2$ | 10 |
| 510 | Dispersion S-2; such an amount that the sum of the content of II-4, III-2 and III-11 reached 0.24 g/m$^2$ | Dispersion S-8; such an amount that the content of II-5 reached 0.22 g/m$^2$ | 3 |
| 511 | Dispersion S-2; such an amount that the sum of the content of II-4, III-2 and III-11 reached 0.24 g/m$^2$ | Dispersion s-8; such an amount that the content of II-5 reached 0.22 g/m$^2$ | 6 |
| 512 | Dispersion S-2; such an amount that the sum of the content of II-4, III-2 and III-11 reached 0.24 g/m$^2$ | Dispersion s-8; such an amount that the content of II-5 reached 0.22 g/m$^2$ | 10 |
| 513 | Dispersion S-3; such an amount that the sum of the content of III-1 and III-3 reached 0.24 g/m$^2$ | Dispersion S-9; such an amount that the content of III-13 reached 0.22 g/m$^2$ | 3 |
| 514 | Dispersion S-3; such an amount that the sum of the content of III-1 and III-3 reached 0.24 g/m$^2$ | Dispersion S-9; such an amount that the content of III-13 reached 0.22 g/m$^2$ | 6 |
| 515 | Dispersion S-3; such an amount that the sum of the content of III-1 and III-3 reached 0.24 g/m$^2$ | Dispersion S-9; such an amount that the content of III-13 reached 0.22 g/m$^2$ | 10 |
| 516 | Dispersion S-4; such an amount that the sum of the content of III-12 and IV-4 reached 0.24 g/m$^2$ | Dispersion S-10; such an amount that the content of IV-6 reached 0.22 g/m$^2$ | 3 |
| 517 | Dispersion S-4; such an amount that the sum of the content of III-12 and IV-4 reached 0.24 g/m$^2$ | Dispersion S-10; such an amount that the content of IV-6 reached 0.22 g/m$^2$ | 6 |
| 518 | Dispersion S-4; such an amount that the sum of the content of III-12 and IV-4 reached 0.24 g/m$^2$ | Dispersion S-10; such an amount that the content of IV-6 reached 0.22 g/m$^2$ | 10 |
| 519 | Dispersion S-5; such an amount that the sum of the content of III-3 and V-2 reached 0.24 g/m$^2$ | Dispersion S-11 such an amount that the content of V-2 reached 0.22 g/m$^2$ | 3 |
| 520 | Dispersion S-5; such an amount that | Dispersion S-11 such an amount that | 6 |

TABLE 10-continued

| Sample No. | Additive for First Layer | Additive for Eleventh Layer | Average Silver Iodide Content in Light Sensitive Silver Halide Grains (mol %) |
|---|---|---|---|
| | the sum of the content of III-3 and V-2 reached 0.24 g/m$^2$ | the content of V-2 reached 0.22 g/m$^2$ | |
| 521 | Dispersion S-5; such an amount that the sum of the content of III-3 and V-2 reached 0.24 g/m$^2$ | Dispersion S-11 such an amount that the content of V-2 reached 0.22 g/m$^2$ | 10 |
| 522 | Dispersion S-6; such an amount that the sum of the content of III-3 and VI-6 reached 0.24 g/m$^2$ | Dispersion S-12; such an amount that the content of VI-13 reached 0.22 g/m$^2$ | 3 |
| 523 | Dispersion S-6; such an amount that the sum of the content of III-3 and VI-6 reached 0.24 g/m$^2$ | Dispersion S-12; such an amount that the content of VI-13 reached 0.22 g/m$^2$ | 6 |
| 524 | Dispersion S-6; such an amount that the sum of the content of III-3 and VI-6 reached 0.24 g/m$^2$ | Dispersion S-12; such an amount that the content of VI-13 reached 0.22 g/m$^2$ | 10 |
| 525 | Dispersion S-1; such an amount that the sum of the content of I-1, I-4 and III-34 reached 0.24 g/m$^2$ | Dispersion S-7; such an amount that the content of I-1 reached 0.22 g/m$^2$ | 2 |
| 526 | Dispersion S-1; such an amount that the sum of the content of I-1, I-4 and III-34 reached 0.24 g/m$^2$ | Dispersion S-7; such an amount that the content of I-1 reached 0.22 g/m$^2$ | 8 |
| 527 | Dispersion S-1; such an amount that the sum of the content of I-1, I-4 and III-34 reached 0.24 g/m$^2$ | Dispersion S-7; such an amount that the content of I-1 reached 0.22 g/m$^2$ | 15 |

Dispersion S-1 comprises Compounds I-1, I-4, and III-34.
Dispersion S-2 comprises Compounds II-4, III-2, and III-11.
Dispersion S-3 comprises Compounds III-1 amd III-3.
Dispersion S-4 comprises Compounds III-12 and IV-4.
Dispersion S-5 comprises Compounds III-3 and V-2.
Dispersion S-6 comprises Compounds III-3 and VI-6.
Dispersion S-7 comprises Compounds I-1.
Dispersion S-8 comprises Compounds II-5.
Dispersion S-9 comprises Compounds III-13.
Dispersion S-10 comprises Compounds IV-6.
Dispersion S-11 comprises Compounds V-2.
Dispersion S-12 comprises Compounds VI-13.

Samples 501 to 527 thus prepared were then evaluated as follows:

(1) Preservability

Samples 501 to 527 were allowed to stand in atmospheres of 0° C. and 50° C., 55% RH over 3 days, exposed to white light through a continuous wedge, and then subjected to development in the same manner as in Example 1. These samples were then measured for cyan, magenta and yellow densities to determine the maximum density ($D_{max}$). The change in the maximum density with the change in the preservation conditions were determined as follows:

Change in Cyan Density:

$$\Delta D_{max}(R) = D_{max}(\text{present at } 0^\circ \text{ C.}) - D_{max}(\text{present at } 50^\circ \text{ C., } 55\% \ RH)$$

Similarly, the magenta density change $\Delta D_{max}$(G) and the yellow density change $\Delta D_{max}$(B) were determined. The results are set forth in Table 11.

(2) Interimage Effect

Samples 501 to 527 were exposed to red light through a continuous wedge, and then subjected to development in the same manner as shown in Example 1. These samples were exposed to white light (red+green+blue) through a continuous wedge with the three color lights adjusted so as to the samples thus developed turned gray. These samples were then developed in the same manner as shown in Example 1. The exposure to red light during the exposure to red light was the same as the exposure to red light during the exposure to white light.

The samples thus developed were measured for density. The difference ΔlogE (R) in exposure that gave a cyan density of 1.0 between exposure to red light and exposure to white light was determined as the degree of interimage effect for a red-sensitive silver halide emulsion layer. Similarly, the degree of interimage effects for a green-sensitive silver halide emulsion layer, and a blue-sensitive silver halide emulsion layer were determined. The results are set forth in Table 11.

TABLE 11

| | Dmax | | | ΔlogE | | |
|---|---|---|---|---|---|---|
| Sample No. | Dmax (R) | Dmax (G) | Dmax (B) | logE (R) | Δlog E (G) | ΔlogE (B) |
| 501 (Comparison) | 0.30 | 0.35 | 0.30 | 0.30 | 0.31 | 0.27 |
| 502 (Comparison) | 0.35 | 0.45 | 0.40 | 0.32 | 0.33 | 0.29 |
| 503 (Comparison) | 0.27 | 0.32 | 0.30 | 0.29 | 0.32 | 0.28 |
| 504 (Comparison) | 0.27 | 0.27 | 0.30 | 0.28 | 0.28 | 0.27 |
| 505 (Comparison) | 0.30 | 0.30 | 0.25 | 0.27 | 0.27 | 0.27 |
| 506 (Comparison) | 0.27 | 0.27 | 0.27 | 0.25 | 0.27 | 0.26 |
| 507 (Invention) | 0.10 | 0.15 | 0.10 | 0.29 | 0.30 | 0.28 |
| 508 (Invention) | 0.11 | 0.14 | 0.13 | 0.28 | 0.30 | 0.26 |
| 509 (Invention) | 0.10 | 0.14 | 0.12 | 0.13 | 0.14 | 0.13 |
| 510 (Invention) | 0.11 | 0.14 | 0.12 | 0.29 | 0.28 | 0.27 |
| 511 (Invention) | 0.12 | 0.15 | 0.12 | 0.28 | 0.30 | 0.27 |
| 512 (Invention) | 0.11 | 0.14 | 0.11 | 0.15 | 0.14 | 0.15 |
| 513 (Invention) | 0.10 | 0.13 | 0.11 | 0.29 | 0.30 | 0.27 |
| 514 (Invention) | 0.11 | 0.14 | 0.14 | 0.28 | 0.28 | 0.26 |
| 515 (Invention) | 0.11 | 0.15 | 0.11 | 0.15 | 0.17 | 0.16 |
| 516 (Invention) | 0.12 | 0.13 | 0.09 | 0.29 | 0.29 | 0.28 |
| 517 (Invention) | 0.13 | 0.14 | 0.11 | 0.28 | 0.30 | 0.26 |
| 518 (Invention) | 0.12 | 0.12 | 0.12 | 0.15 | 0.14 | 0.14 |
| 519 (Invention) | 0.10 | 0.15 | 0.10 | 0.28 | 0.31 | 0.28 |
| 520 | 0.12 | 0.15 | 0.10 | 0.30 | 0.29 | 0.26 |

TABLE 11-continued

| Sample No. | Dmax Dmax (R) | Dmax Dmax (G) | Dmax Dmax (B) | ΔlogE logE (R) | ΔlogE Δlog E (G) | ΔlogE ΔlogE (B) |
|---|---|---|---|---|---|---|
| (Invention) 521 | 0.11 | 0.14 | 0.12 | 0.16 | 0.14 | 0.13 |
| (Invention) 522 | 0.13 | 0.17 | 0.10 | 0.29 | 0.31 | 0.25 |
| (Invention) 523 | 0.11 | 0.14 | 0.12 | 0.27 | 0.30 | 0.26 |
| (Invention) 524 | 0.11 | 0.14 | 0.13 | 0.16 | 0.16 | 0.16 |
| (Invention) 525 | 0.10 | 0.13 | 0.11 | 0.31 | 0.31 | 0.30 |
| (Invention) 526 | 0.11 | 0.11 | 0.12 | 0.26 | 0.26 | 0.25 |
| (Invention) 527 | 0.11 | 0.11 | 0.11 | 0.06 | 0.06 | 0.06 |
| (Invention) | | | | | | |

As shown in Table 11, Samples 507, 508, 510, 511, 513, 514, 516, 517, 519, 520, 522, 523, 525 and 526 having a low average silver iodide content exhibit a great ΔlogE and interimage effect and an excellent color reproducibility. Furthermore, Samples 507 to 527 exhibit a small change in the maximum density with the change in the storage conditions.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising:

a support;

at least a blue-sensitive emulsion layer, a green-sensitive emulsion layer, and a red-sensitive emulsion layer on said support, and further comprising:

one or more hydrophilic colloidal layers containing a dispersion of microcrystals of at least one compound represented by general formulae (I), (II), (III), (IV), (V), or (VI),

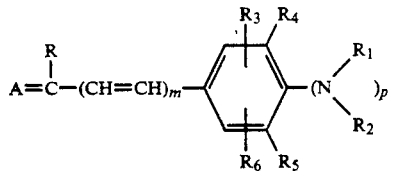

(I)

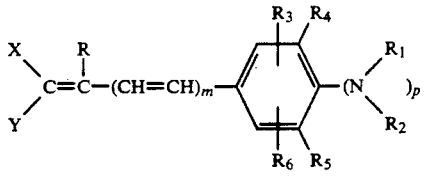

(II)

$$A{=}L_1{-}(L_2{=}L_3)_n{-}A \quad \text{(III)}$$

$$A{=}(L_1{-}L_2)_{2-q}{=}B \quad \text{(IV)}$$

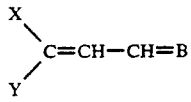

(V)

-continued

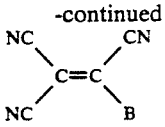

(VI)

wherein

A and A' may be the same or different and each represents an acidic nucleus;

B represents a basic nucleus;

X and Y may be the same or different and each represents an electrophilic group;

R represents a hydrogen atom or an alkyl group;

$R_1$ and $R_2$ each represents an alkyl group, an aryl group, an acyl group, or a sulfonyl group, and $R_1$ and $R_2$ may be connected to each other to form a 5- or 6-membered ring;

$R_3$ and $R_6$ each represents a hydrogen atom, a hydroxyl group, a carboxyl group, an alkoxy group, or a halogen atom; $R_4$ and $R_5$ each represents a hydrogen atom or a nonmetallic atom group required to connect $R_1$ and $R_4$ or $R_2$ and $R_5$ to each other to form a 5- or 6-membered ring.

$L_1$, $L_2$, and $L_3$ each represents a methine group;

m represents 0 or 1;

n and q each represents 0, 1 or 2;

p represents 0 or 1; and

B' represents a carboxyl group, a sulfamoyl group, or a heterocyclic group containing a sulfonamide group, with the proviso that when (i) p is 0, $R_3$ is a hydroxyl group or a carboxyl group and $R_4$ and $R_5$ each represents a hydrogen atom, (ii) the compound represented by general formula (I), (II), (III), (IV), (V), or (VI) contains per molecule at least one dissociative group having a pKa of 4 to 11 in a 1/1 mixture by volume of water and ethanol;

and at least one light-sensitive silver halide emulsion layer having a silver density (d) of 0.4 g/m$^3$ or more, wherein d is N/V; where N represents the total number of grams of silver in said one or more light-sensitive silver halide emulsion layers and V represents the volume in cm$^3$ of said light-sensitive silver halide emulsion layer;

and wherein said at least one light-sensitive silver halide emulsion layer contains at least one light-sensitive silver halide emulsion spectrally sensitized by the addition of a photographic sensitizing dye at a temperature of 50° C. or higher.

2. A silver halide color photographic material as claimed in claim 1, wherein said photographic sensitizing dye is added to said at least one light-sensitive silver halide emulsion between the completion of the formation of the silver halide grains and the completion of chemical sensitization.

3. A silver halide color photographic material as claimed in claim 1, wherein said photographic sensitizing dye is added to said at least one light-sensitive silver halide emulsion layer before the completion of the formation of the silver halide grains.

4. A silver halide color photographic material as claimed in claim 1, wherein said at least one light-sensitive silver halide emulsion layer contains silver halide grains containing silver iodide wherein the average silver iodide content in at least one light-sensitive silver halide emulsion layer is about 8 mol % or less.

5. A silver halide color photographic material as claimed in claim 1, further comprising:

an emulsion layer containing at least one compound represented by general formula (VII):

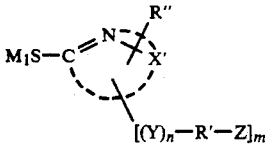

(VII)

wherein $M_1$ represents a hydrogen atom, a cation, or a protective group for a mercapto group which undergoes cleavage by an alkali;

X' represents an atomic group required for the formation of a 5- or 6-membered heterocyclic group containing sulfur, selenium, nitrogen, or oxygen as hetero atoms and which may be substituted or part of a condensed ring;

R' represents a straight or branched chain alkylene group, a straight or branched chain alkenylene group, a straight or branched chain aralkylene group, or an arylene group;

R'' represents a hydrogen atom or a group which can substitute for the hydrogen atom;

Z represents a polar substituent;

Y represents —S—, —O—,

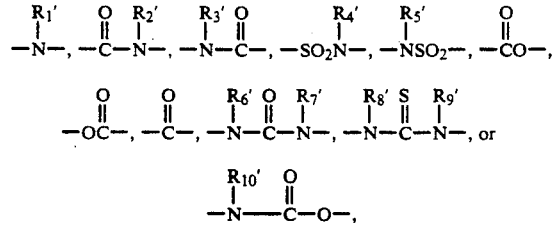

in which $R'_1$, $R'_2$, $R'_4$, $R'_5$, $R'_6$, $R'_7$, $R'_8$, $R'_9$, and $R'_{10}$ each represents a hydrogen atom, a substituted or unsubstituted alkyl group, an aryl group, an alkenyl group, or an aralkyl group;

n represents 0 or 1; and m represents 0, 1, or 2.

6. A silver halide color photographic material as claimed in claim 1, wherein said dispersion of microcrystals is of a compound represented by formula (I).

7. A silver halide color photographic material as claimed in claim 1, wherein said dispersion of microcrystals is of a compound represented by formula (II).

8. A silver halide color photographic material as claimed in claim 1, wherein said dispersion of microcrystals is of a compound represented by formula (III).

9. A silver halide color photographic material as claimed in claim 1, wherein said dispersion of microcrystals is of a compound represented by formula (IV).

10. A silver halide color photographic material as claimed in claim 1, wherein said dispersion of microcrystals is of a compound represented by formula (V).

11. A silver halide color photographic material as claimed in claim 1, wherein said dispersion of microcrystals is of a compound represented by formula (VI).

* * * * *